US010738798B2

(12) United States Patent
Maekawa et al.

(10) Patent No.: US 10,738,798 B2
(45) Date of Patent: Aug. 11, 2020

(54) ENERGY RECOVERY DEVICE AND ENERGY RECOVERY METHOD

(71) Applicants: KOBE STEEL, LTD., Hyogo (JP); Kochi Prefectural Public University Corporation, Kochi (JP)

(72) Inventors: Satoshi Maekawa, Kobe (JP); Naoki Sugano, Kobe (JP); Yoshio Inoue, Kochi (JP); Motomichi Sonobe, Kochi (JP)

(73) Assignees: Kobe Steel, Ltd., Hyogo (JP); Kochi Prefectural Public University Corporation, Kochi (JP)

( * ) Notice: Subject to any disclaimer, the term of this patent is extended or adjusted under 35 U.S.C. 154(b) by 0 days.

(21) Appl. No.: 16/485,370

(22) PCT Filed: Feb. 9, 2018

(86) PCT No.: PCT/JP2018/004725
§ 371 (c)(1),
(2) Date: Aug. 12, 2019

(87) PCT Pub. No.: WO2018/155244
PCT Pub. Date: Aug. 30, 2018

(65) Prior Publication Data

US 2019/0368514 A1 Dec. 5, 2019

(30) Foreign Application Priority Data

Feb. 27, 2017 (JP) ..... 2017-034607
Aug. 10, 2017 (JP) ..... 2017-155216

(51) Int. Cl.
*F15B 1/033* (2006.01)
*F15B 1/04* (2006.01)

(52) U.S. Cl.
CPC ..... *F15B 1/033* (2013.01); *F15B 1/04* (2013.01); *F15B 2201/50* (2013.01)

(58) Field of Classification Search
CPC ..... F15B 1/033; F15B 1/04; F15B 2201/50; F15B 2211/761; F15B 2211/427;
(Continued)

(56) References Cited

U.S. PATENT DOCUMENTS 5,011,180 A * 4/1991 Dunwoody ..... B60G 17/0152 188/297
7,475,538 B2 * 1/2009 Bishop ..... E02F 9/22 60/567
(Continued)

FOREIGN PATENT DOCUMENTS

JP 2014-163419 A 9/2014
JP 2014-169763 A 9/2014
JP 2014169763 A * 9/2014

*Primary Examiner* — Thomas E Lazo
(74) *Attorney, Agent, or Firm* — Studebaker & Brackett PC

(57) ABSTRACT

The energy recovery system includes an inertial fluid container, a low pressure container, a high pressure container, a low pressure valve, and a high pressure valve, a valve flow conduit, and a valve controller. The valve controller switches, in response to a decrease in volume of the fluid chamber, the inertial fluid container between communicating with the low pressure container and the high pressure container, thereby generating inertial forces of the working fluid flowing toward the low pressure container in the inertial fluid container, and causing the working fluid to flow into the high pressure container by the inertial forces. The valve controller sets a switching frequency for the valves to a frequency close to an Nth-order (where N is a natural number) anti-resonance frequency of a flow conduit for the working fluid.

13 Claims, 46 Drawing Sheets

(58) Field of Classification Search
CPC ..... F15B 2211/527; F15B 2211/625; F15B 2211/212; F15B 1/024; F15B 21/087; F15B 21/14
See application file for complete search history.

(56) References Cited

U.S. PATENT DOCUMENTS

| | | | | |
|---|---|---|---|---|
| 8,567,185 | B1 * | 10/2013 | Theobald | B25J 9/144 60/413 |
| 9,021,798 | B2 * | 5/2015 | Sipola | F15B 21/14 60/428 |
| 9,494,168 | B2 * | 11/2016 | Lind | F15B 11/006 |
| 9,657,750 | B1 * | 5/2017 | Theobald | F15B 1/02 |
| 9,856,891 | B2 * | 1/2018 | Rabhi | F15B 11/16 |
| 2018/0306211 | A1 * | 10/2018 | Sipola | F15B 1/027 |

* cited by examiner

ENERGY RECOVERY DEVICE AND ENERGY RECOVERY METHOD

TECHNICAL FIELD

The present invention relates to an energy recovery system and an energy recovery method for recovering energy from a working fluid.

BACKGROUND ART

Patent Literature 1 discloses a conventional technique applied in an energy recovery system for recovering energy from a working fluid. The technique includes an inertial fluid container communicating with an outlet of an actuator, and a low pressure container and a high pressure container connected to the inertial fluid container in parallel. In addition, a low pressure valve which is a solenoid valve is disposed between the inertial fluid container and the low pressure container, and a high pressure valve which is a solenoid valve is disposed between the inertial fluid container and the high pressure container. In this energy recovery system, the high pressure valve is closed and the low pressure valve is opened to cause working fluid to flow from the inertial fluid container into the low pressure container. At this time, the flow of the working fluid generates fluid inertial forces in the inertial fluid container. Subsequently, the low pressure valve is closed and the high pressure valve is opened to cause the working fluid to flow into the high pressure container by the fluid inertial forces generated in the inertial fluid container. In this manner, the high pressure valve and the low pressure valve are opened and closed alternately at high frequency, thereby making it possible to recover the energy of the working fluid in the high pressure container.

CITATION LIST

Patent Literature

Patent Literature 1: Japanese Unexamined Patent Publication No. 2014-163419

In the technique disclosed in Patent Literature 1, the opening and closing operations of the valves may cause pulsation of the working fluid when a switching frequency for opening and closing the valves is set to a specified value. Enhancement of the pulsation in the actuator or in a flow conduit for the working fluid causes backward flow of the working fluid from the high pressure container to the inertial fluid container, which results in reduction in the efficiency of the energy recovery. This is a problem.

SUMMARY OF INVENTION

It is an object of the present invention to provide an energy recovery system and an energy recovery method for recovering energy from a working fluid discharged from a fluid chamber, capable of preventing reduction in the efficiency of the energy recovery caused by flow fluctuations of working fluid in a flow conduit in the energy recovery system.

Provided is an energy recovery system for recovering energy from a working fluid. The energy recovery system comprises: a fluid chamber having a variable volume and the working fluid sealed therein; an inertial fluid container, including a first internal space communicating with the fluid chamber, for receiving the working fluid discharged from the fluid chamber as the volume of the fluid chamber decreases; a low pressure container, including a second internal space set at a lower pressure than the fluid chamber and communicating with the first internal space of the inertial fluid container, for receiving the working fluid discharged from the inertial fluid container; a high pressure container, including a third internal space set at a higher pressure than the second internal space of the low pressure container and communicating with the first internal space of the inertial fluid container, for receiving the working fluid discharged from the inertial fluid container; a low pressure valve having a low pressure opening for permitting flow of the working fluid between the inertial fluid container and the low pressure container, and operable to open and close the low pressure opening; a high pressure valve having a high pressure opening for permitting flow of the working fluid between the high pressure container and the inertial fluid container, and operable to open and close the high pressure opening; a valve flow conduit, extending from the inertial fluid container to the low pressure valve and the high pressure valve, for guiding the working fluid; and a valve controller for controlling, in response to a decrease in volume of the fluid chamber, the opening and closing operations of the high pressure valve and the low pressure valve such that the inertial fluid container alternately communicates with the low pressure container and the high pressure container, thereby generating inertial forces of the working fluid flowing toward the low pressure container in the first internal space of the inertial fluid container, and causing the working fluid to flow into the high pressure container by the inertial forces. The valve controller sets a switching frequency for switching the inertial fluid container between communicating with the low pressure container and communicating with the high pressure container to a frequency close to an Nth-order (where N is a natural number) anti-resonance frequency of a flow conduit for the working fluid including at least the inertial fluid container and the valve flow conduit.

DESCRIPTION OF EMBODIMENTS

Figure 1:
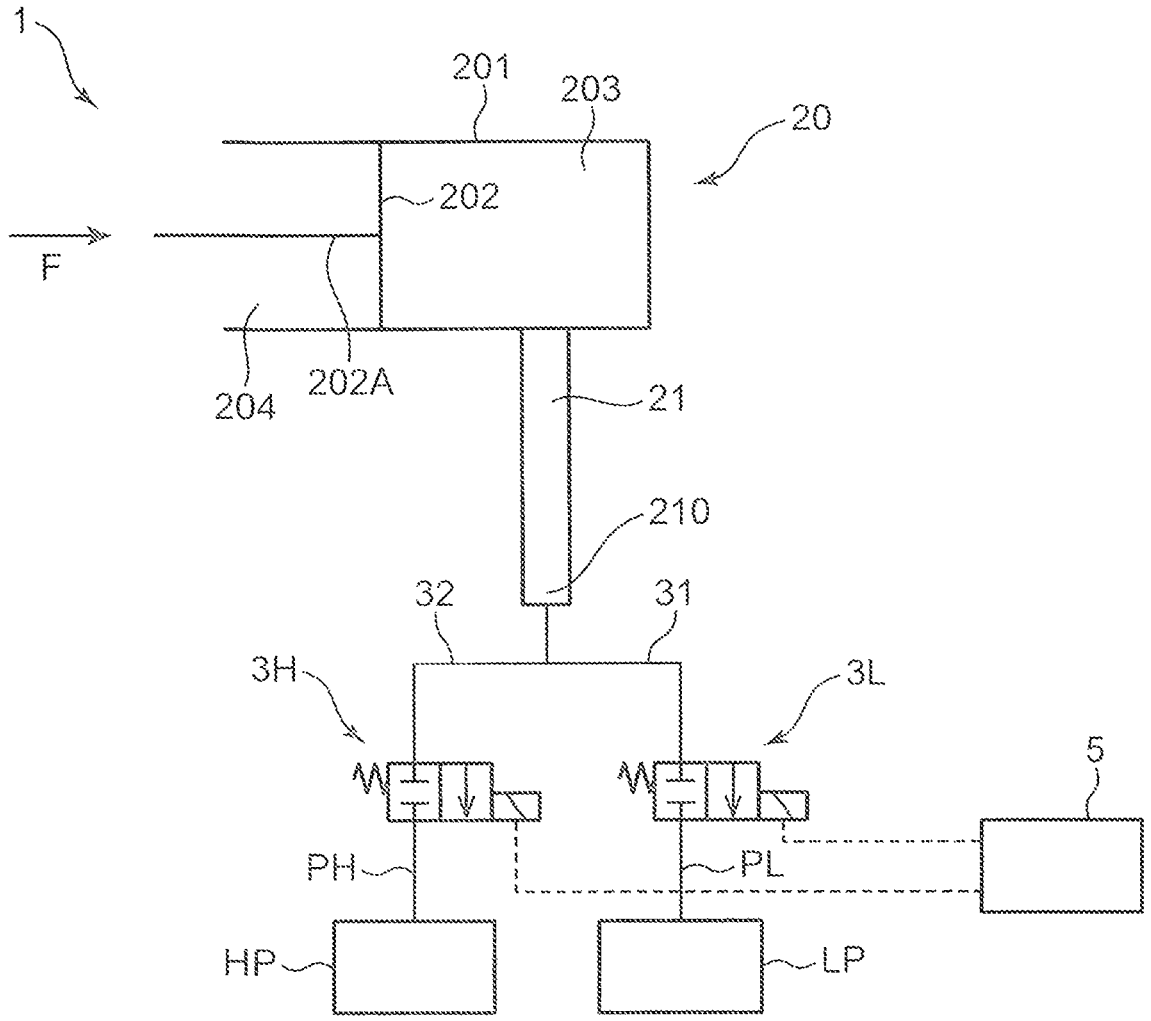
FIG. 1 is a schematic view of a hydraulic circuit of an energy recovery system according a first embodiment of the present invention.
Figure 2:
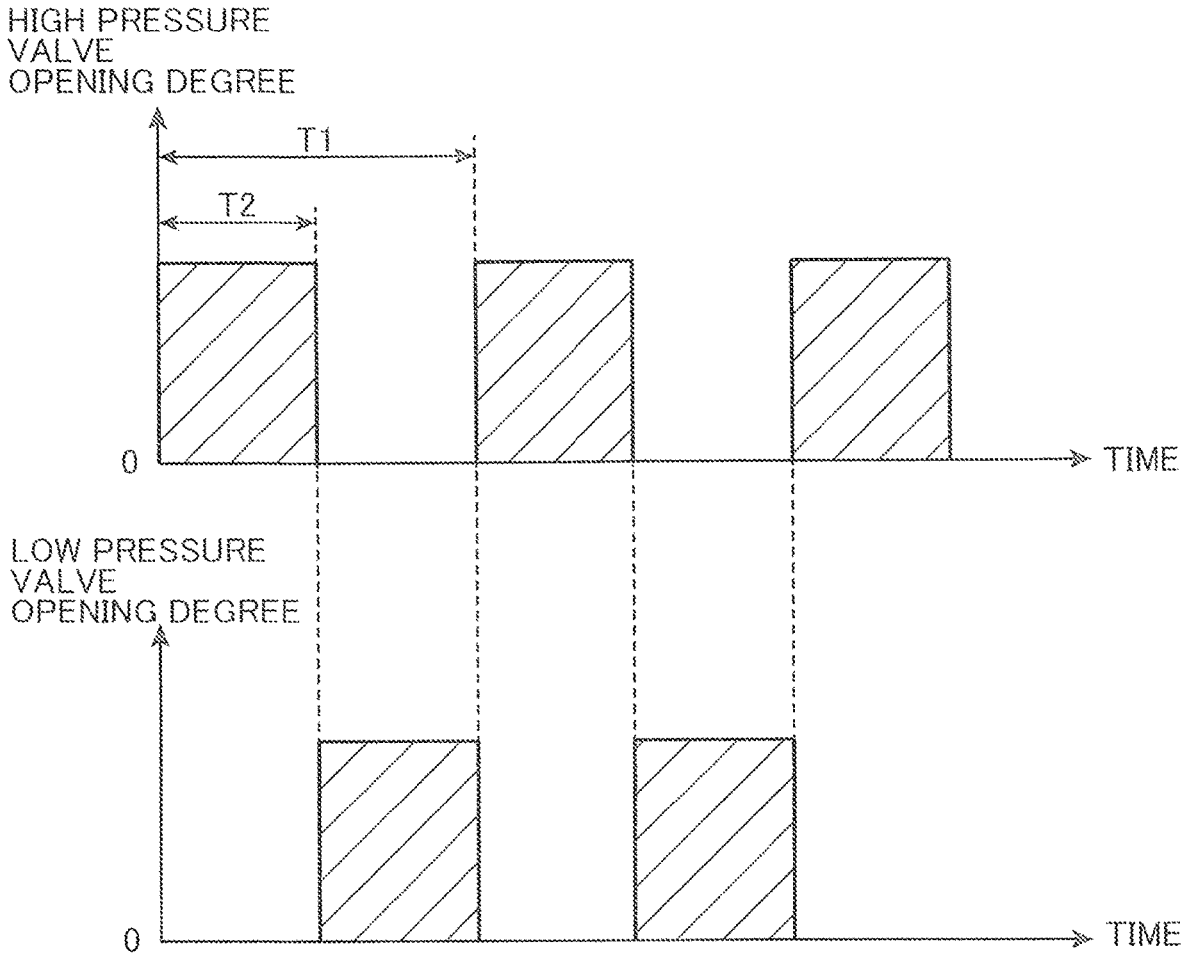
FIG. 2 shows two graphs, one showing a relationship between time and degree of opening of a high pressure valve and the other showing a relationship between time and degree of opening of a low pressure valve, the high pressure and low pressure valves being provided in the energy recovery system according to the first embodiment of the present invention.

A first embodiment of the present invention is hereinafter described with reference to the accompanying drawings. FIG. 1 is a schematic view of a hydraulic circuit of an energy recovery system 1 according to the first embodiment. FIG. 2 shows two graphs, one showing a relationship between time and degree of opening of a high pressure valve and the other showing a relationship between time and degree of opening of a low pressure valve, the high pressure and low pressure valves being provided in the energy recovery system 1 according to the first embodiment. The energy recovery system 1 recovers energy from a working fluid. Examples of working fluids may include, but are not particularly limited to, hydraulic oil, water, and air. In energy recovery of the energy recovery system 1 described below, the hydraulic circuit (fluid circuit) is connected to a hydraulic cylinder, and energy input to the hydraulic cylinder is converted into energy of hydraulic oil and then be recovered in the hydraulic circuit.

With reference to FIG. 1, the energy recovery system 1 includes a hydraulic cylinder 20, an inertial fluid chamber 21 (inertial fluid container), a low pressure valve 3L, a high pressure valve 3H, a low pressure source LP (low pressure container), a high pressure source HP (high pressure container), and a controller 5 (valve controller).

The hydraulic cylinder 20 includes a cylinder body 201 having a cylindrical shape and a piston 202 reciprocally movable in the cylinder body 201. The piston 202 has a rod 202A connected to one end thereof. The piston 202 divides the inner space of the cylinder body 201 into a piston-side chamber 203 (fluid chamber) and a rod-side chamber 204. The hydraulic cylinder 20 can receive and transmit energy from and to the outside via the rod 202A. In the hydraulic cylinder 20, at least the piston-side chamber 203 is filled with hydraulic oil. As shown in FIG. 1, upon application of an external force F to the rod 202A, the piston 202 moves to reduce the volume of the piston-side chamber 203. This causes the hydraulic oil in the piston-side chamber 203 to flow out of the hydraulic cylinder 20 into the inertial fluid chamber 21. The piston-side chamber 203 exemplifies a fluid chamber according to the present invention. The piston-side chamber 203 has a variable volume and hydraulic oil sealed therein.

The inertial fluid chamber 21 has a cylindrical inner space (first internal space) communicating with the piston-side chamber 203 of the hydraulic cylinder 20. The inertial fluid chamber 21 receives hydraulic oil discharged from the piston-side chamber 203 reduced by movement of the piston 202. As an example, the inertial fluid chamber 21 of the first embodiment is in the form of a pipe with a circular cross section. In addition, the inertial fluid chamber 21 is in the form of a cylinder (having a straight pipe shape) linearly extending in the direction of flow of the hydraulic oil. The volume of the inner space of the inertial fluid chamber 21 is smaller than the volume of the inner space of the hydraulic cylinder 20. The inner space of the inertial fluid chamber 21 is filled with hydraulic oil. The inertial fluid chamber 21 has an outlet referred to as a fluid chamber outlet 210, to which a low pressure pipe PL and a high pressure pipe PH are connected in parallel. In other words, the fluid chamber outlet 210 is connected to a flow conduit that branches into two sub-channels immediately downstream of the fluid chamber outlet 210.

The low pressure source LP is connected to a downstream end of the low pressure pipe PL. The low pressure source LP has an inner space (second internal space). The inner space of the low pressure source LP communicates with the inertial fluid chamber 21 via the low pressure pipe PL. The low pressure source LP receives hydraulic oil discharged from the inertial fluid chamber 21. The low pressure source LP is, for example, in the form of a tank for storing hydraulic oil. The inner space of the low pressure source LP is normally kept at atmospheric pressure. Thus, the pressure of hydraulic oil in the low pressure source LP is approximately equal to atmospheric pressure, and is set lower than the internal pressure of the piston-side chamber 203.

The low pressure valve 3L is disposed between the inertial fluid chamber 21 and the low pressure source LP. The low pressure valve 3L is a solenoid valve. The low pressure valve 3L has an opening (low pressure opening), not shown in the drawings, for permitting flow of hydraulic oil between the inertial fluid chamber 21 and the low pressure source LP, and operates to open and close the opening. In other words, the low pressure valve 3L permits and blocks communication between the inertial fluid chamber 21 and the low pressure source LP.

The high pressure source HP is connected to a downstream end of the high pressure pipe PH. The high pressure source HP has an inner space (third internal space). The inner space of the high pressure source HP communicates with the inertial fluid chamber 21 via the high pressure pipe PH. The high pressure source HP receives hydraulic oil discharged from the inertial fluid chamber 21. The high pressure source HP may be in the form of a tank for accumulating hydraulic oil at a higher pressure than that in the low pressure source LP, or in the form of an accumulator. The pressure in the inner space of the high pressure source HP is set at least higher than the pressure in the inner space of the low pressure source LP and, in the first embodiment, set higher than the pressure in the piston-side chamber 203.

The high pressure valve 3H is disposed between the inertial fluid chamber 21 and the high pressure source HP. The high pressure valve 3H is a solenoid valve. The high pressure valve 3H has an opening (High pressure opening), not shown in the drawings, for permitting flow of hydraulic oil between the inertial fluid chamber 21 and the high pressure source HP, and operates to open and close the opening. In other words, the high pressure valve 3H permits and blocks communication between the inertial fluid chamber 21 and the high pressure source HP.

The part of the low pressure pipe PL from the fluid chamber outlet 210 to the opening of the low pressure valve 3L is referred to as a low-pressure-side branch channel 31. Similarly, the part of the high pressure pipe PH from the fluid chamber outlet 210 to the opening of the high pressure valve 3H is referred to as a high-pressure-side branch channel 32. The low-pressure-side branch channel 31 and the high-pressure-side branch channel 32 exemplify a valve flow conduit of the present invention. The valve flow conduit is a flow conduit (pipe channel) branching from the fluid chamber outlet 210 of the inertial fluid chamber 21 for guiding hydraulic oil to the low pressure valve 3L and the high pressure valve 3H.

The controller 5 controls the operations of the high pressure valve 3H and the low pressure valve 3L. The controller 5 instructs the high pressure valve 3H and the low pressure valve 3L when to open and close. The controller 5 controls, in response to a reduction in the volume of the piston-side chamber 203, the opening and closing operations of the low pressure valve 3L and the high pressure valve 3H such that the inertial fluid chamber 21 alternately communicates with the low pressure source LP and the high pressure source HP.

In the energy recovery system 1, the controller 5 closes the opening of the high pressure valve 3H and opens the opening of the low pressure valve 3L to cause hydraulic oil in the inertial fluid chamber 21 to flow into the low pressure source LP. At this time, the flow of the hydraulic oil generates fluid inertial forces in the inner space of the inertial fluid chamber 21. Subsequently, the controller 5 closes the opening of the low pressure valve 3L and opens the opening of the high pressure valve 3H to cause the hydraulic oil to flow into the high pressure source HP by the fluid inertial forces generated in the inertial fluid chamber 21 as mentioned above. This makes it possible to accumulate pressure. Even when the pressure in the high pressure source HP is equal to or greater than the pressure in the inertial fluid chamber 21, the hydraulic oil can be caused to flow into and accumulate in the high pressure source HP as long as the fluid inertial forces remain in the inertial fluid chamber 21. In short, upon application of an external force F to the hydraulic cylinder 20 as shown in FIG. 1, the controller 5 controls the low pressure valve 3L and the high pressure valve 3H, thereby making it possible to recover the energy of the external force F in the high pressure source HP.

The fluid inertial forces in the inertial fluid chamber 21 decrease with time. Accordingly, the controller 5 closes the high pressure valve 3H and opens the low pressure valve 3L again to recover fluid inertial forces. Thus, the controller 5 opens and closes the low pressure valve 3L and the high pressure valve 3H alternately in each specific period. This configuration makes it possible, even when the pressure in the high pressure source HP is equal to or greater than the pressure in the piston-side chamber 203 of the hydraulic cylinder 20, to recover and accumulate energy in the high pressure source HP. The recovered energy may be used to actuate the hydraulic cylinder again, or for other purposes. For example, the energy of hydraulic oil recovered in the high pressure source HP may be supplied to a hydraulic device (such as a hydraulic motor or a hydraulic pump) not shown in the drawings.

With reference to FIG. 2, in the energy recovery, the controller 5 switches the low pressure valve 3L and the high pressure valve 3H alternately between an opening operation and a closing operation at high speed. Specifically, the controller 5 includes a control current output unit, a PWM converter, and a drive circuit. The control current output unit outputs pulse signals for controlling the opening and closing operations of the low pressure valve 3L and the high pressure valve 3H. In this regard, the pulse signal has a predetermined rectangular waveform. Opening and closing times of each of the low pressure valve 3L and the high pressure valve 3H are controlled by a duty ratio of the pulse signal. With reference to FIG. 2, the duty ratio d is defined by the following formula 1:

$$d=T2/T1 \quad \text{(Formula 1)}$$

In the formula, T1 denotes the time (period) taken to complete one opening-and-closing cycle of the low pressure valve 3L and the high pressure valve 3H, and T2 denotes the time during which the high pressure valve 3H is open in one cycle. In other words, the duty ratio d defined by the formula 1 corresponds to a high pressure duty ratio d1 for controlling the opening time of the high pressure valve 3H in the period T1. The time during which the low pressure valve 3L is open corresponds to "T1−T2" in FIG. 2. Thus, a low pressure duty ratio d2 for controlling the opening time of the low pressure valve 3L in the period T1 corresponds to "1−d1". The frequency of the above-mentioned pulse signal is controlled as a switching frequency described later.

As shown in FIG. 1, the flow conduit for the hydraulic oil discharged from the piston-side chamber 203 of the hydraulic cylinder 20 includes a channel (low pressure pipe PL) extending from the inertial fluid chamber 21 to the low pressure source LP and a channel (high pressure pipe PH) extending from the inertial fluid chamber 21 to the high pressure source HP. These channels are made of, for example, a pipe. Thus, specific vibration occurs due to the flow of hydraulic oil. No such vibration occurs when the flow conduit shown in FIG. 1 is made of a completely rigid material. The vibration of the flow conduit (pipe) causes pulsation of hydraulic oil, thus affecting the flow of the hydraulic oil.

Figure 3:
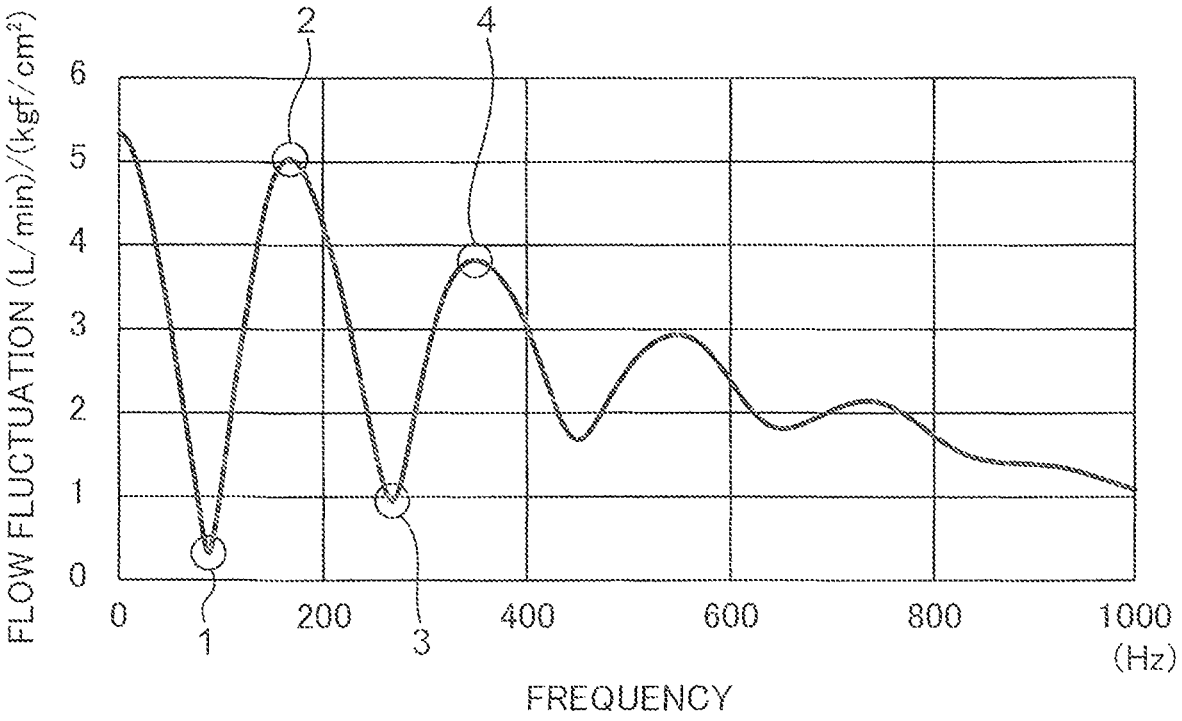
FIG. 3 is a graph showing an example of a relationship between the frequency of pressure fluctuations that occur in a flow conduit for a working fluid and flow fluctuations (frequency response of flow fluctuations) of the working fluid in the energy recovery system according to the first embodiment of the present invention.

FIG. 3 is a graph showing an example of a relationship between the frequency of pressure fluctuations that occur in the flow conduit for hydraulic oil and flow fluctuations (frequency response of flow fluctuations) of the hydraulic oil in the energy recovery system 1 according to the first embodiment. Specifically, the opening of the high pressure valve 3H is fully opened (free end) and the opening of the low pressure valve 3L is fully closed (fixed end) in FIG. 1, and in this state sinusoidal pressure fluctuations are intentionally applied to the high pressure source HP. FIG. 3 shows a waveform representing flow fluctuations (frequency response) of hydraulic oil near the fluid chamber outlet 210 of the inertial fluid chamber 21 at this time. The data shown in FIG. 3 may be computer simulated or measured by a flow meter provisionally provided near the fluid chamber outlet 210.

With reference to FIG. 3, the magnitude of the hydraulic oil flow fluctuations changes according to the frequency of the applied pressure fluctuations, based on the vibrational characteristics of the entire hydraulic oil flow conduit shown in FIG. 1. In the graph of FIG. 3, the symbol "1" indicates the first anti-resonance frequency, the symbol "2" indicates the first resonance frequency, the symbol "3" indicates the second anti-resonance frequency, and the symbol "4" indicates the second resonance frequency, of the flow conduit (system). As can be seen from the graph, the anti-resonance and resonance frequencies appear alternately. In addition, as shown in FIG. 3, the hydraulic oil flow fluctuations reach a maximum value at the resonance frequencies, and the hydraulic oil flow fluctuations reach a minimum value at the anti-resonance frequencies. Generally, when the inertial fluid chamber 21 has a linear uniform cross section, the resonance frequency is twice the anti-resonance frequency. Also in FIG. 3, the first resonance frequency "2" is approximately twice the first anti-resonance frequency "1". As described above, the branches extend from the inertial fluid chamber 21 to the high pressure valve 3H and the low pressure valve 3L, and this is why the first resonance frequency "2" is actually not exactly twice the first anti-resonance frequency "1". Based on this newly found feature of the hydraulic oil flow fluctuations, the controller 5 of the present invention suitably sets the switching frequency f for controlling the low pressure valve 3L and the high pressure valve 3H.

Specifically, in FIG. 1, when the openings of the low pressure valve 3L and the high pressure valve 3H are opened and closed alternately to recover in the high pressure source HP the energy of the hydraulic oil discharged from the hydraulic cylinder 20, the operations for opening and closing the openings cause pressure fluctuations in the hydraulic oil flow conduit. Accordingly, in the first embodiment, the switching frequency f for the high pressure valve 3H and the low pressure valve 3L is set to a frequency close to an anti-resonance point (e.g. "1" and "3" in FIG. 3) of the flow conduit (system). More specifically, the controller 5 sets the switching frequency f, for switching the inertial fluid chamber 21 between communicating with the low pressure source LP and communicating with the high pressure source HP, to a frequency close to the Nth-order (where N is a natural number) anti-resonance frequency of the hydraulic oil flow conduit including at least the inertial fluid chamber 21 and the valve flow conduit (the low-pressure-side branch channel 31 and the high-pressure-side branch channel 32). This makes it possible, as shown in FIG. 3, to reduce the hydraulic oil flow fluctuations compared to cases of other frequency ranges.

<Case where Switching Frequency is Set to Anti-Resonance Frequency (Duty Ratio d=0.5)>

Figure 4A:
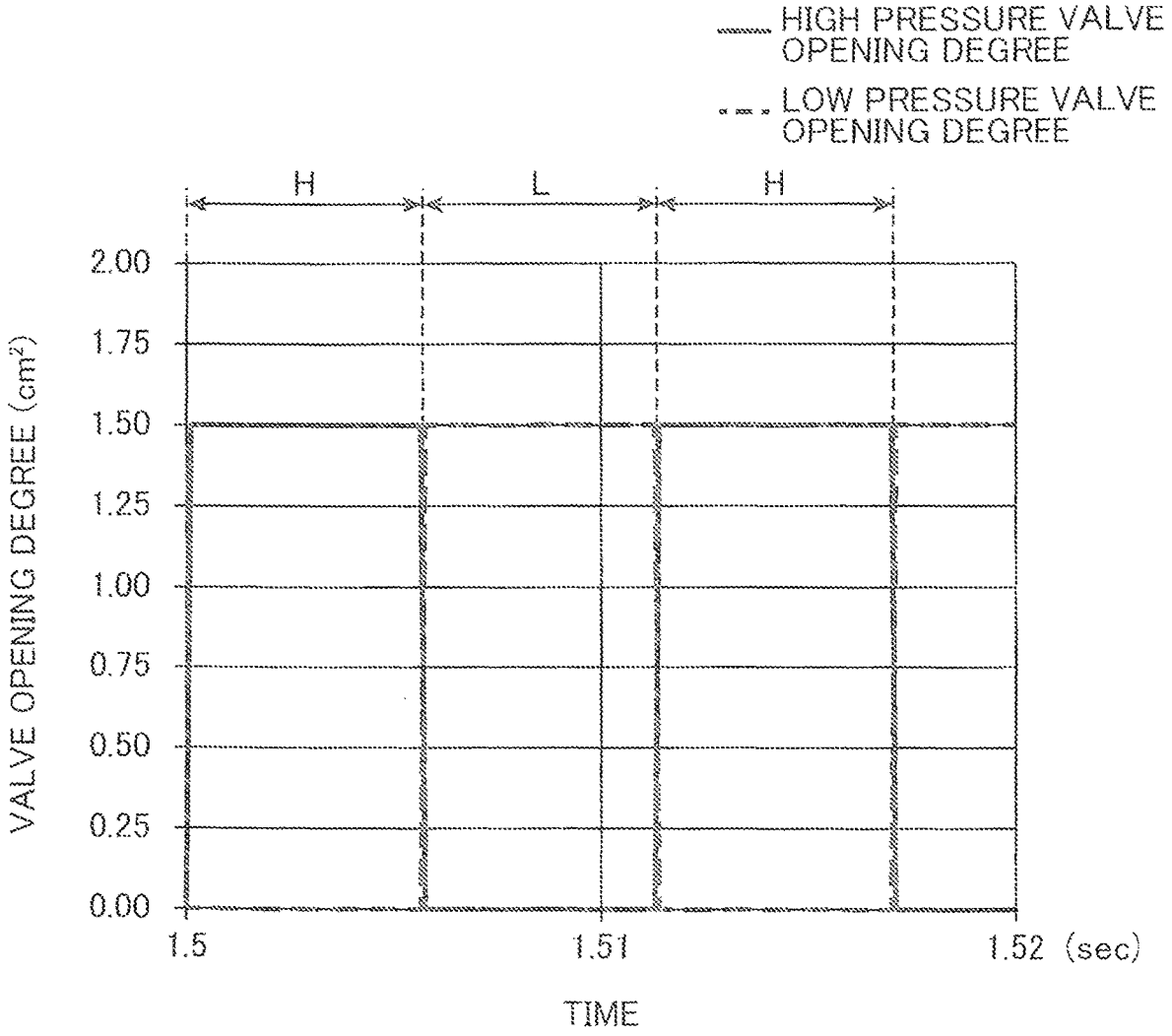
FIG. 4A is a graph showing change over time in the opening degree of the high pressure valve and the low pressure valve.
Figure 4B:
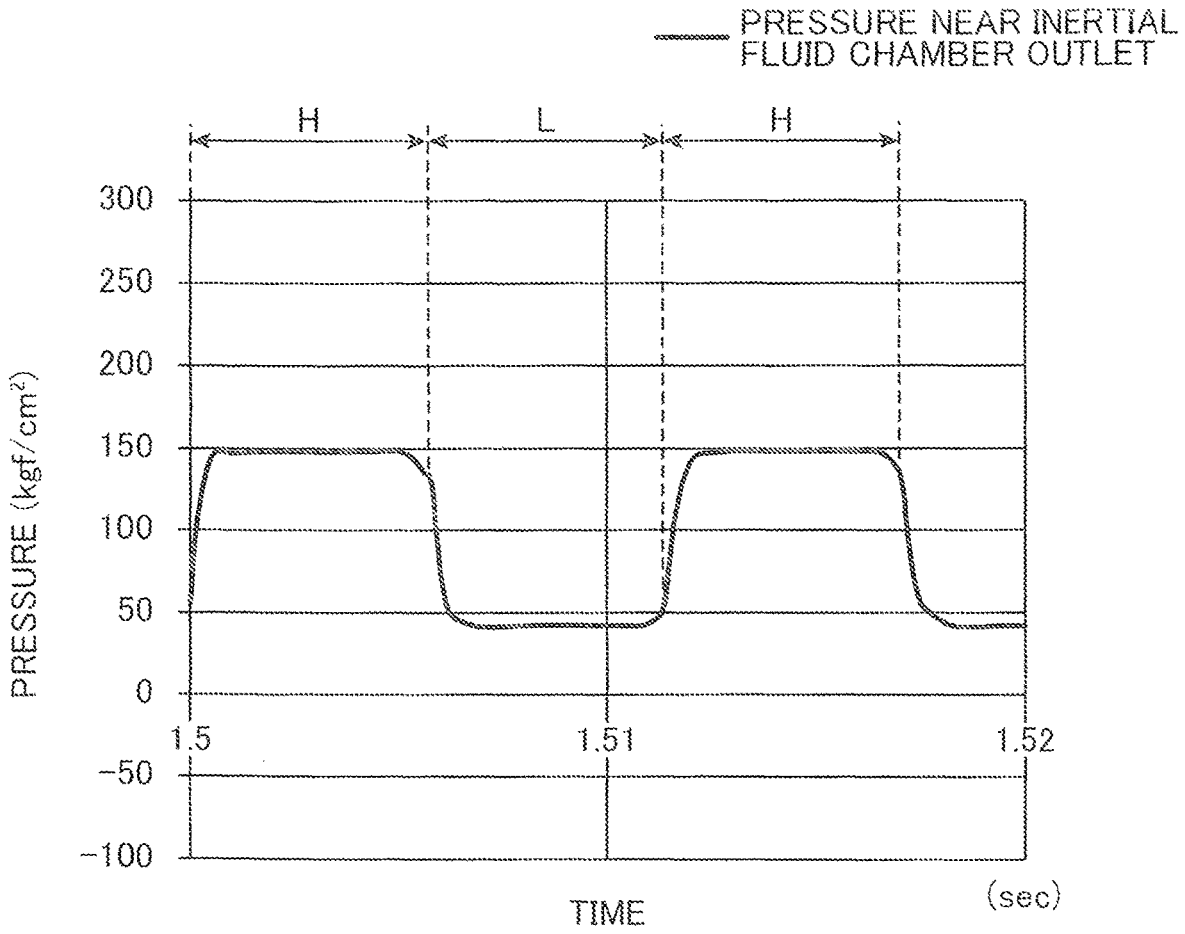
FIG. 4B is a graph showing change over time in the pressure of working fluid near the outlet of an inertial fluid chamber, the graph corresponding to the valve control shown in FIG. 4A.
Figure 4C:
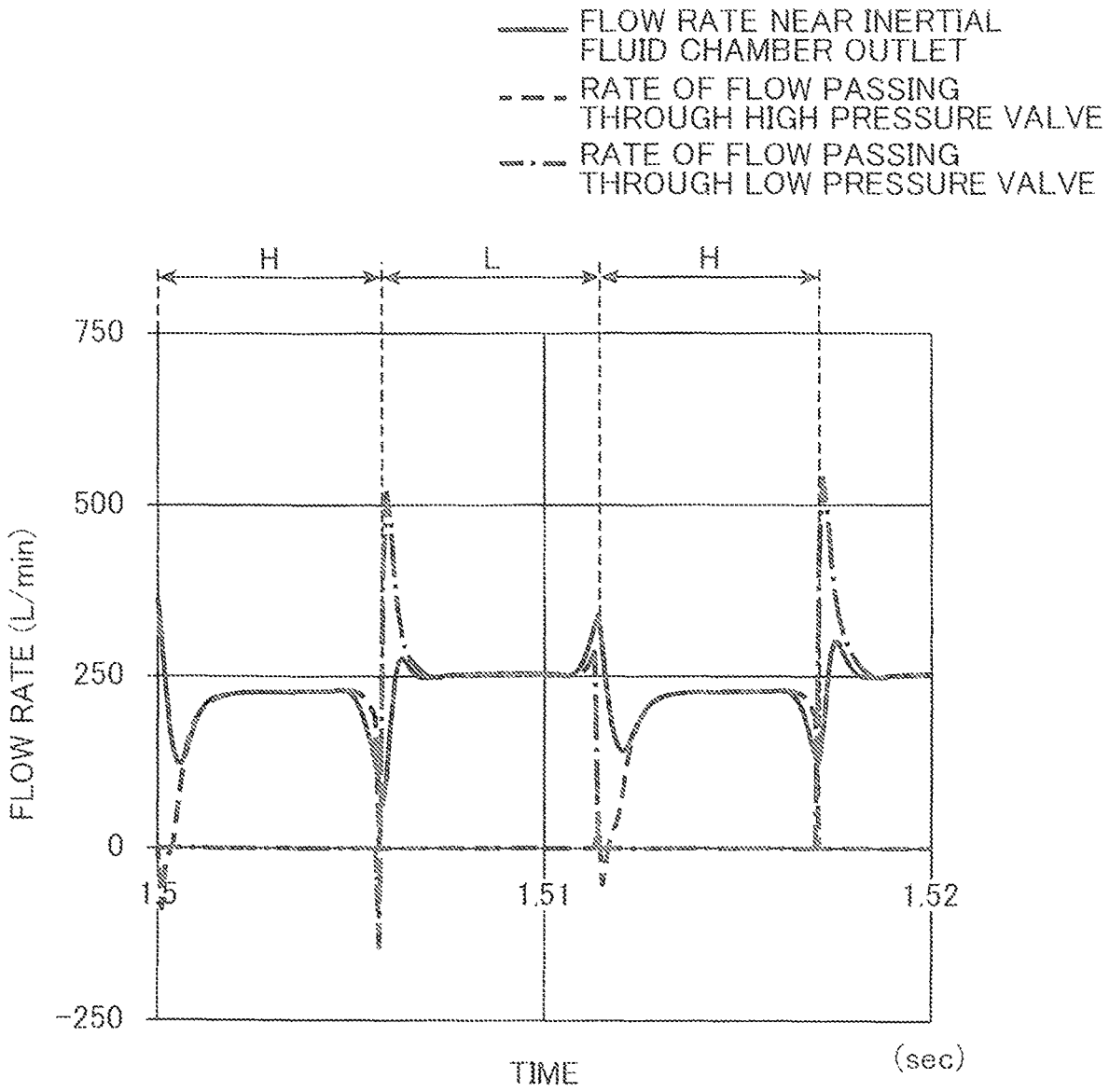
FIG. 4C is a graph showing changes over time in the flow rate of the working fluid near the outlet of the inertial fluid chamber, the flow rate of working fluid passing through the high pressure valve, and the flow rate of working fluid passing through the low pressure valve, the graph corresponding to the valve control shown in FIG. 4A.
Figure 4D:
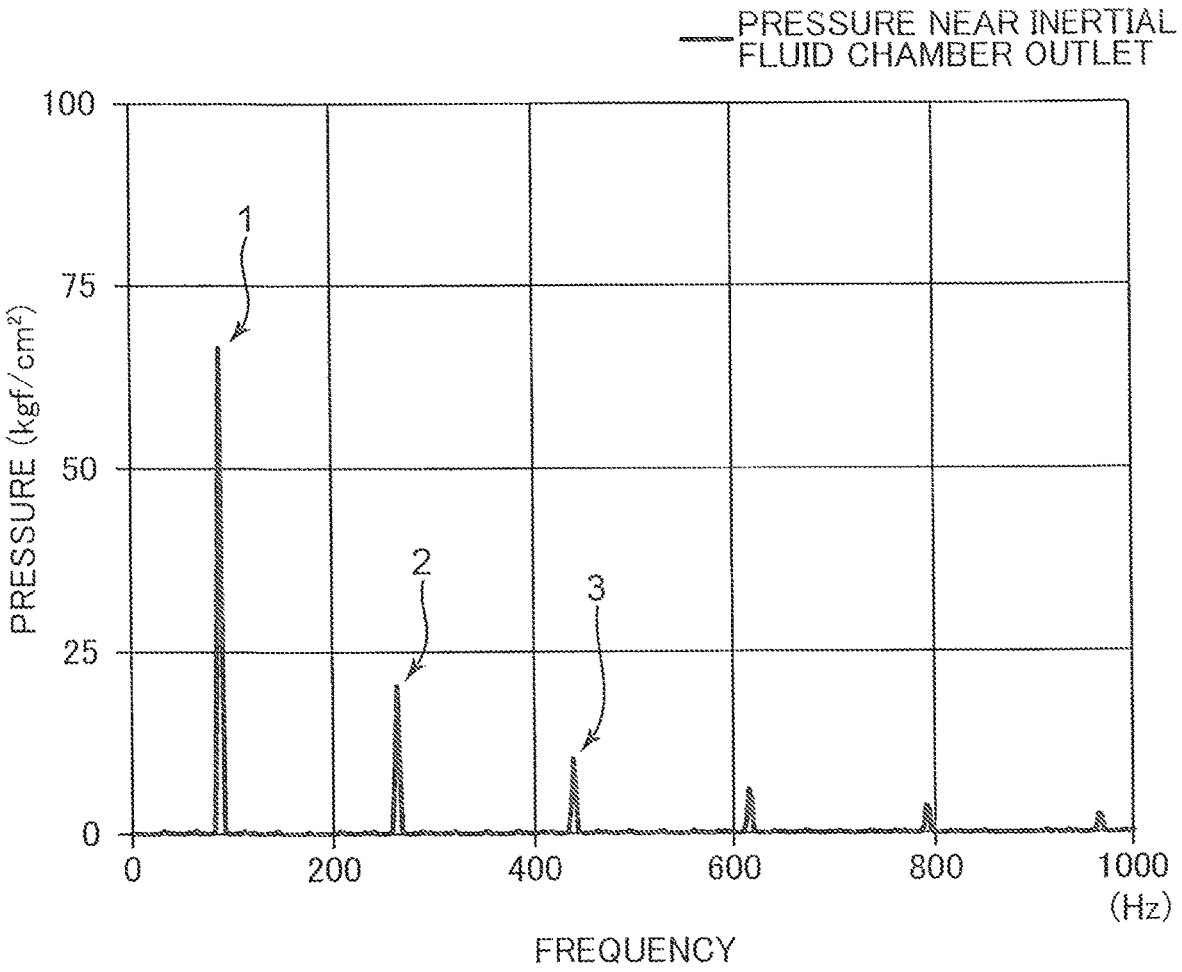
FIG. 4D is a graph showing frequency response of the pressure fluctuations of the working fluid near the outlet of the inertial fluid chamber, the graph corresponding to the valve control shown in FIG. 4A.
Figure 4E:
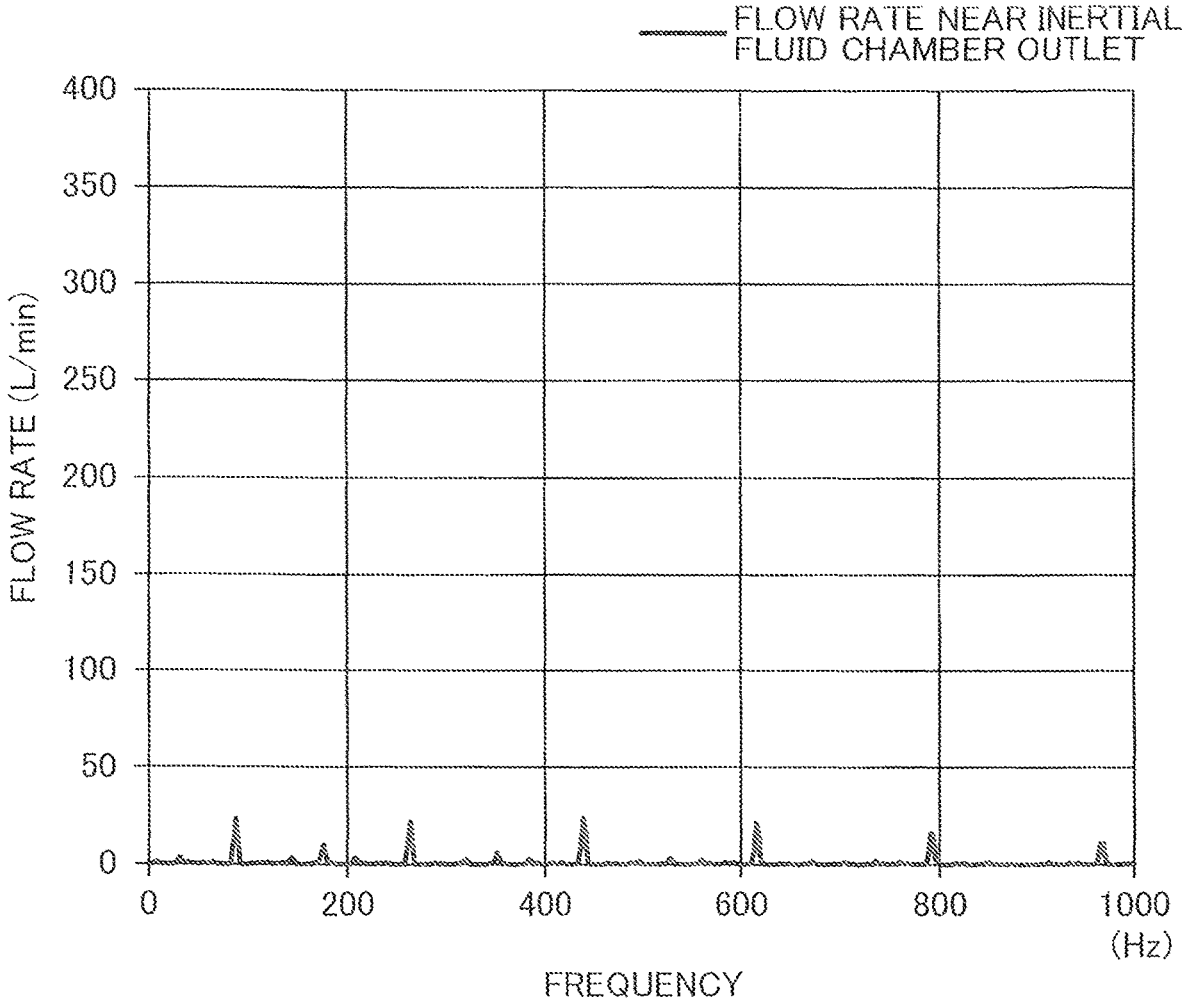
FIG. 4E is a graph showing frequency response of the flow fluctuations of the working fluid near the outlet of the inertial fluid chamber, the graph corresponding to the valve control shown in FIG. 4A.

Described hereinafter are examples of the control of the opening operations of the high pressure valve 3H and the low pressure valve 3L in the energy recovery system 1 shown in FIG. 1. FIGS. 4A to 4E are graphs each showing change in a characteristic value when the switching frequency f for the high pressure valve 3H and the low pressure valve 3L is set to the first anti-resonance frequency (the frequency "1" in FIG. 3, which is 88 Hz). FIG. 4A is a graph showing change over time in the opening degree of the high pressure valve 3H and the low pressure valve 3L. FIG. 4A shows a case where the duty ratio d is 0.5 as described above. FIGS. 4B to 4E correspond to the valve control shown in FIG. 4A. FIG. 4B is a graph showing change over time in the pressure of hydraulic oil near the fluid chamber outlet 210 of the inertial fluid chamber 21. FIG. 4C is a graph showing changes over time in the flow rate of the hydraulic oil near the fluid chamber outlet 210 of the inertial fluid chamber 21, the flow rate of hydraulic oil passing through the high pressure valve 3H, and the flow rate of hydraulic oil passing through the low pressure valve 3L. FIG. 4D is a graph showing frequency response of the pressure fluctuations of the hydraulic oil near the fluid chamber outlet 210 of the inertial fluid chamber 21 (FIG. 4B). In other words, FIG. 4D shows a result obtained by processing the data of the pressure fluctuations shown in FIG. 4B by a known frequency analysis method (the same applies to FIGS. 5D, 8D, 9D, 13D, and 14D described later). FIG. 4E is a graph showing frequency response of the flow fluctuations of the hydraulic oil near the fluid chamber outlet 210 of the inertial fluid chamber 21 (FIG. 4C). In other words, FIG. 4E shows a result obtained by processing the data of the flow fluctuations near the fluid chamber outlet 210 shown in FIG. 4C by the known frequency analysis method (the same applies to FIGS. 5E, 8E, 9E, 13E, and 14E described later). In FIGS. 4A to 4C, the range H indicates the time period during which only the high pressure valve 3H is open to permit communication between the inertial fluid chamber 21 and the high pressure source HP. The range H corresponds to a set time period during which hydraulic oil flows from the inertial fluid chamber 21 to the high pressure source HP (the set rate of flow passing through the high pressure valve is positive). The range L indicates the time period during which only the low pressure valve 3L is open to permit communication between the inertial fluid chamber 21 and the low pressure source LP. The range L corresponds to a set time period during which hydraulic oil flows from the inertial fluid chamber 21 to the low pressure source LP (the set rate of flow passing through the low pressure valve is positive). These definitions of the ranges H and L apply to other graphs described later.

With reference to FIG. 4C, most of the hydraulic oil discharged from the fluid chamber outlet 210 of the inertial fluid chamber 21 passes sequentially through the low pressure valve 3L and the high pressure valve 3H. In this regard, with reference to FIG. 4D, when the duty ratio d for controlling the opening operations of the low pressure valve 3L and the high pressure valve 3H is 0.5, excitation frequencies at which the pressure fluctuates are odd number multiples of the fundamental frequency (i.e. the switching frequency), such as a frequency (indicated by the "arrow 1" in FIG. 4D") that is once the switching frequency (88 Hz), a frequency (indicated by the "arrow 2" in FIG. 4D) that is three times the switching frequency, and a frequency (indicated by the "arrow 3" in FIG. 4D) that is five times the switching frequency. As a result, also in the frequency response of the flow fluctuations near the fluid chamber outlet 210 of the inertial fluid chamber 21 as shown in FIG. 4E, frequency components whose frequencies are odd number multiples of the fundamental frequency are excited with a small amplitude. In other words, the excitation frequencies in this case are not at the first resonance frequency (indicated by the arrow "2" in FIG. 3) of the system. Thus, it is possible to suppress the flow fluctuations of the hydraulic oil near the fluid chamber outlet 210 of the inertial fluid chamber 21. Consequently, it is possible, in the recovery of hydraulic oil energy in the high pressure source HP, to prevent reduction in the efficiency of the energy recovery due to the hydraulic oil flow fluctuations (pulsation).

<Case where Switching Frequency is Set to Resonance Frequency (Duty Ratio d=0.5)>

Figure 5A:
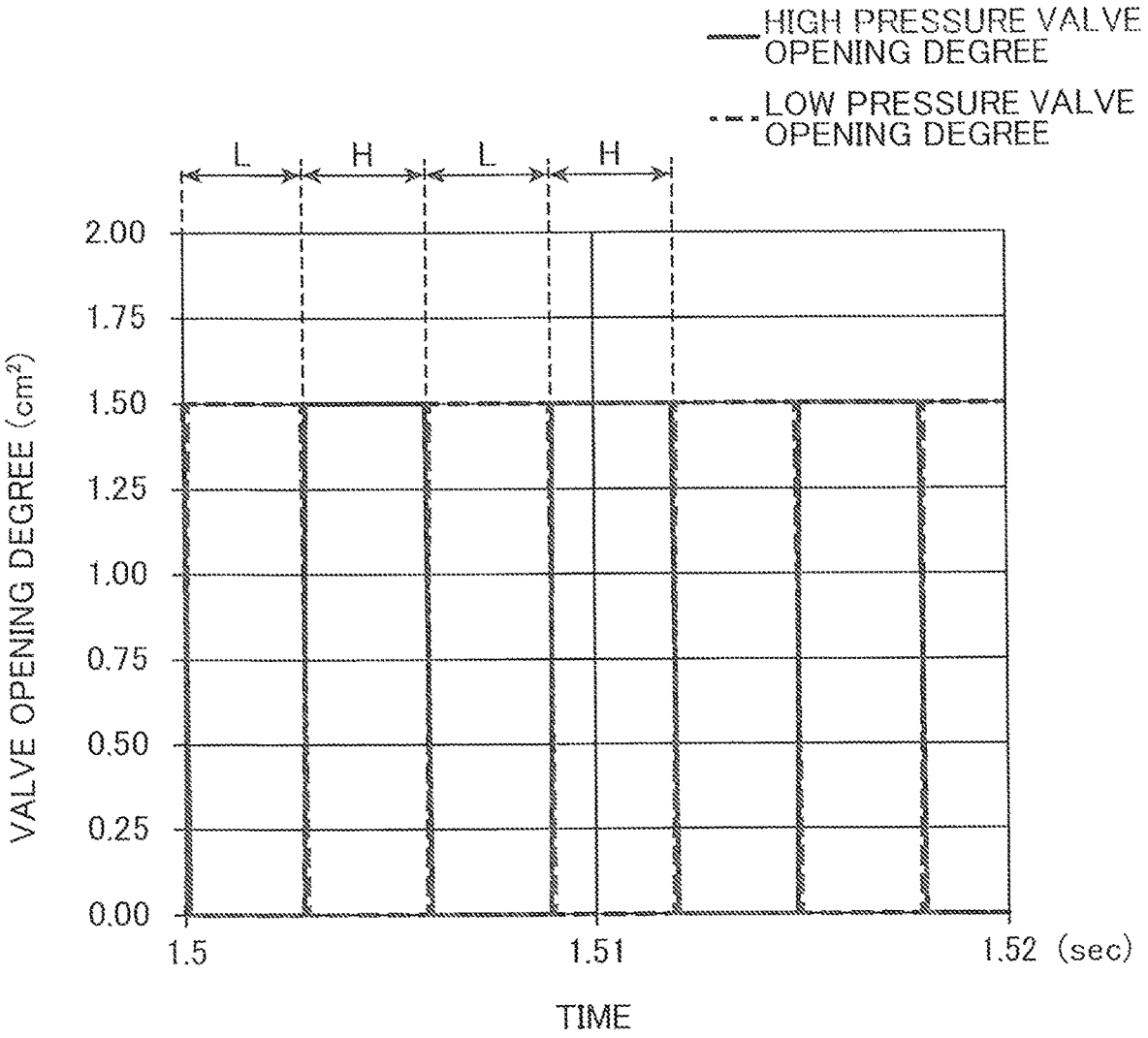
FIG. 5A is a graph showing change over time in the opening degree of the high pressure valve and the low pressure valve.
Figure 5B:
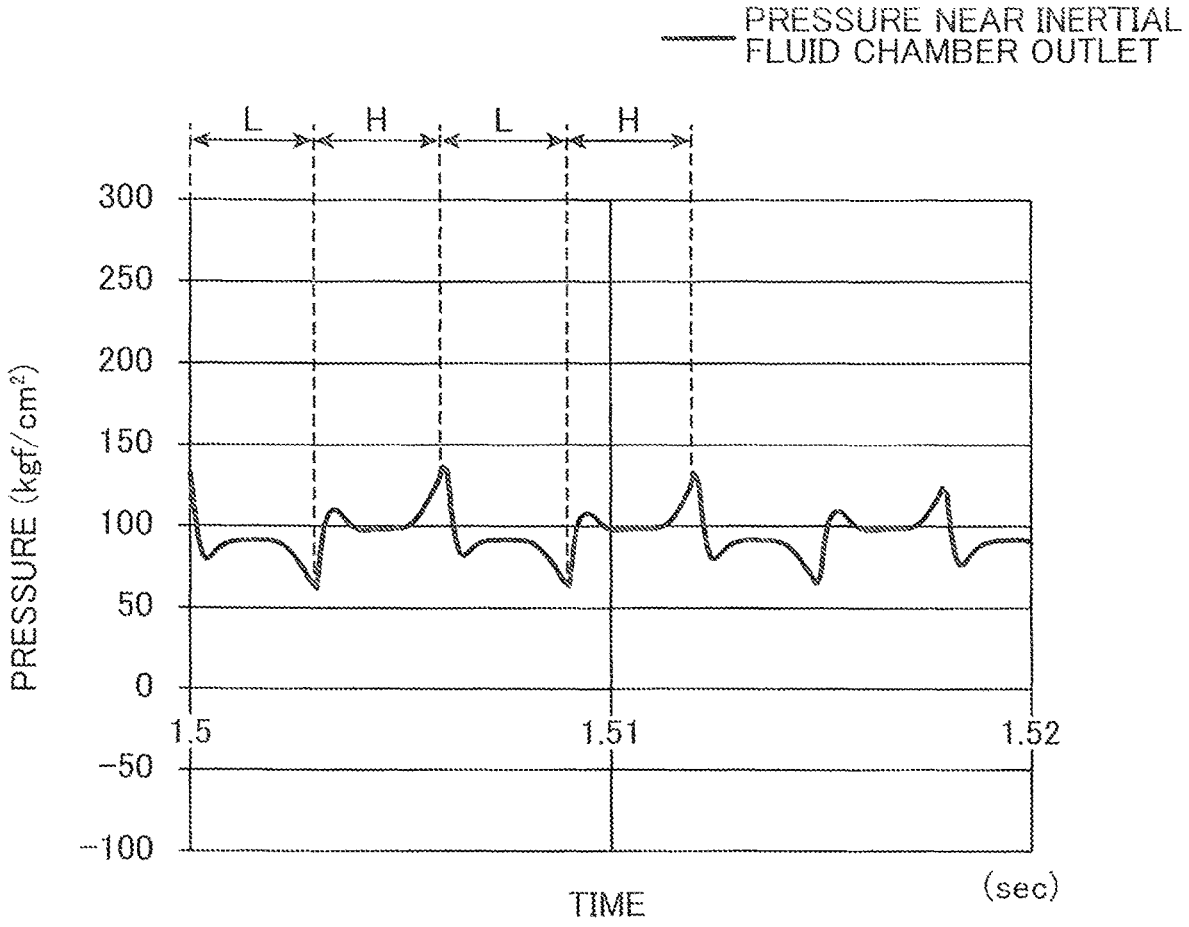
FIG. 5B is a graph showing change over time in the pressure of working fluid near the outlet of the inertial fluid chamber, the graph corresponding to the valve control shown in FIG. 5A.
Figure 5C:
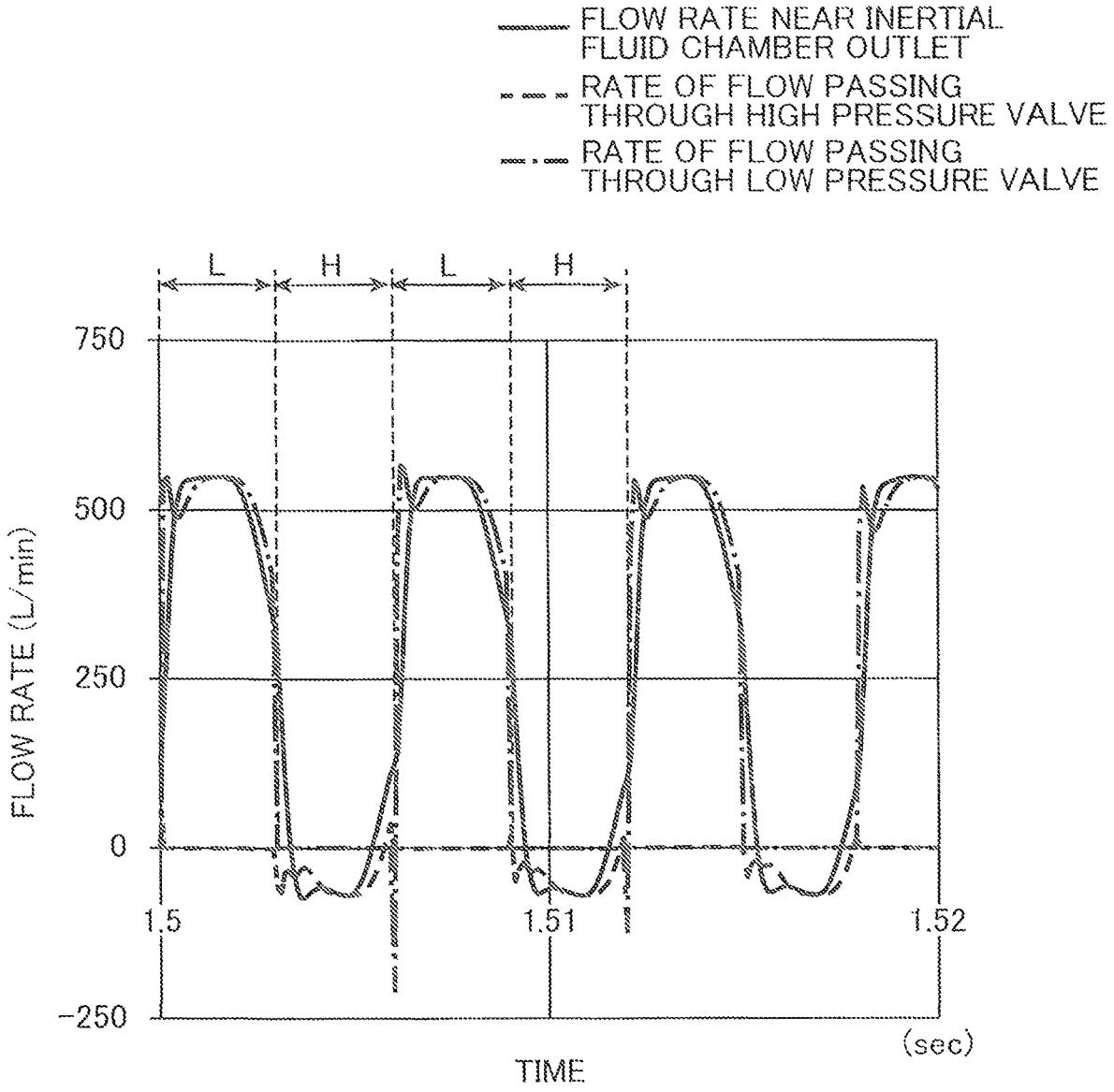
FIG. 5C is a graph showing changes over time in the flow rate of the working fluid near the outlet of the inertial fluid chamber, the flow rate of working fluid passing through the high pressure valve, and the flow rate of working fluid passing through the low pressure valve, the graph corresponding to the valve control shown in FIG. 5A.
Figure 5D:
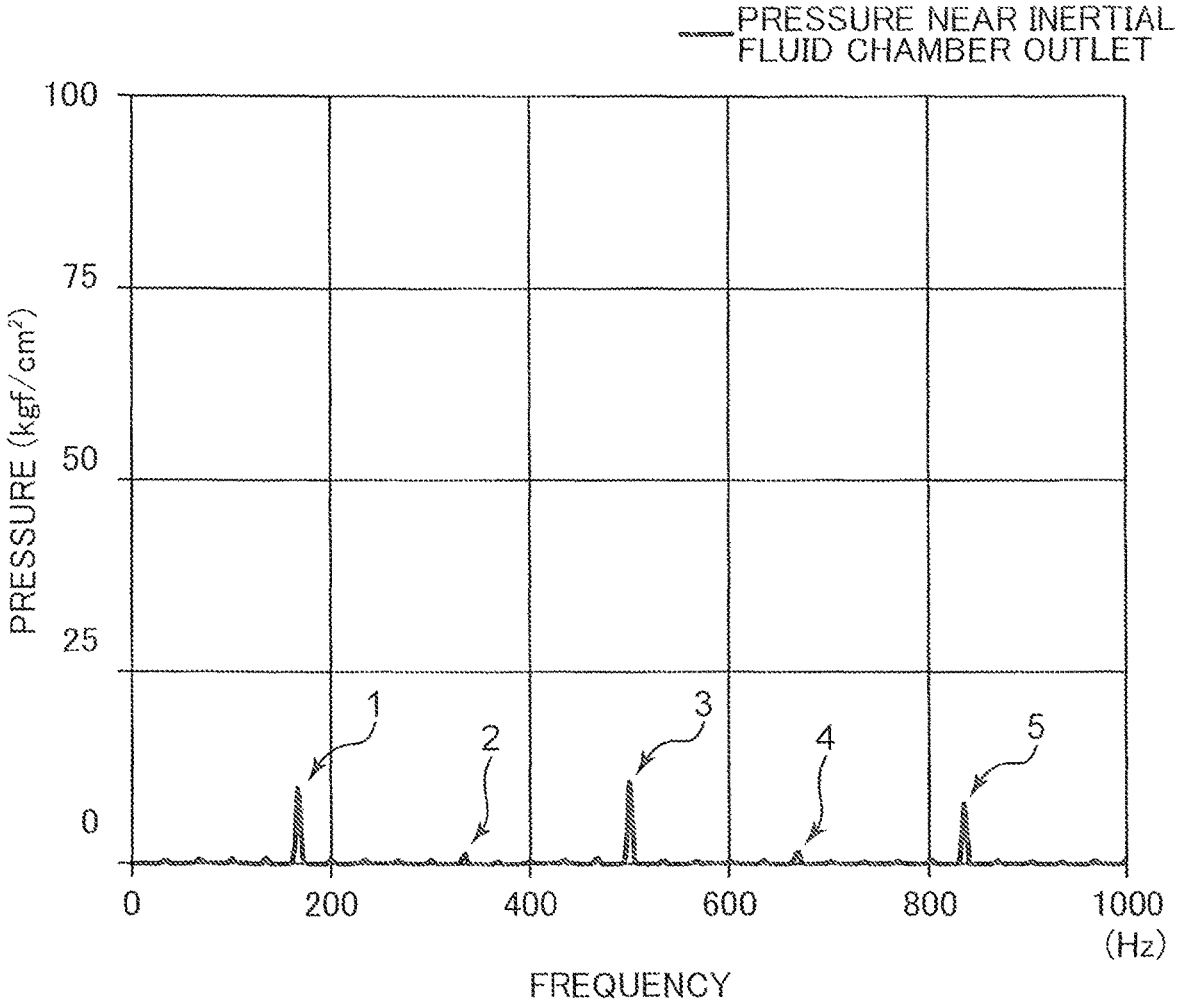
FIG. 5D is a graph showing frequency response of the pressure fluctuations of the working fluid near the outlet of the inertial fluid chamber, the graph corresponding to the valve control shown in FIG. 5A.
Figure 5E:
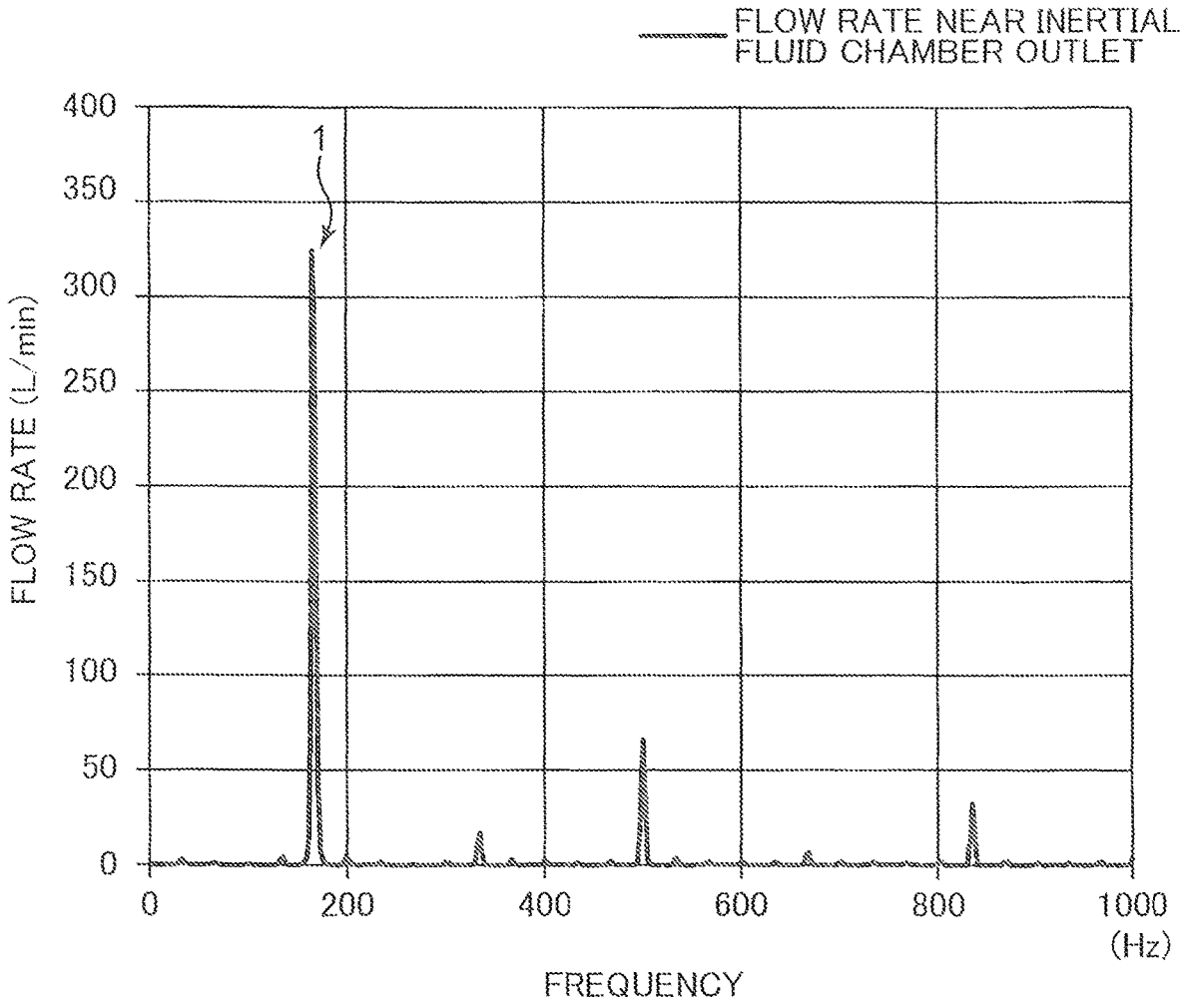
FIG. 5E is a graph showing frequency response of the flow fluctuations of the working fluid near the outlet of the inertial fluid chamber, the graph corresponding to the valve control shown in FIG. 5A.

FIGS. 5A to 5E are graphs each showing change in a characteristic value when the switching frequency for the high pressure valve 3H and the low pressure valve 3L is set to the first resonance frequency (indicated by the arrow "2" in FIG. 3, which is 167 Hz). FIG. 5A is a graph showing change over time in the opening degree of the high pressure valve 3H and the low pressure valve 3L. FIG. 5A shows a case where the duty ratio d is 0.5 as described above. FIGS. 5B to 5E correspond to the valve control shown in FIG. 5A. FIG. 5B is a graph showing change over time in the pressure of hydraulic oil near the fluid chamber outlet 210 of the inertial fluid chamber 21. FIG. 5C is a graph showing changes over time in the flow rate of the hydraulic oil near the fluid chamber outlet 210 of the inertial fluid chamber 21, the flow rate of hydraulic oil passing through the high pressure valve 3H, and the flow rate of hydraulic oil passing through the low pressure valve 3L. FIG. 5D is a graph showing frequency response of the pressure fluctuations of the hydraulic oil near the fluid chamber outlet 210 of the inertial fluid chamber 21 (FIG. 5B). FIG. 5E is a graph showing frequency response of the flow fluctuations of the hydraulic oil near the fluid chamber outlet 210 of the inertial fluid chamber 21 (FIG. 5C).

With reference to FIG. 5C, although the inertial fluid chamber 21 communicates with the high pressure source HP, hydraulic oil flows backward from the high pressure source HP toward the inertial fluid chamber 21 (the rate of flow passing through the high pressure valve is negative) in the ranges H. This phenomenon is caused by the following reasons. Since the switching frequency f for the valves is set to the first resonance frequency of the system, a flow fluctuation at the first resonance component is excited with great amplitude as shown in FIG. 5E (indicated by the arrow "1" in FIG. 5E). In this case, it is difficult in the recovery of hydraulic oil energy to prevent reduction in the energy recovery efficiency.

As described above, in the first embodiment, the controller 5 sets the switching frequency f for switching the inertial fluid chamber 21 between communicating with the low pressure source LP and communicating with the high pressure source HP, to a frequency close to the Nth-order (where N is a natural number) anti-resonance frequency of the hydraulic oil flow conduit including at least the inertial fluid chamber 21 and the valve flow conduit (the low-pressure-side branch channel 31 and the high-pressure-side branch channel 32). This makes it possible to suppress the hydraulic oil flow fluctuations associated with the resonance of the hydraulic oil flow conduit including the inertial fluid chamber 21 and the valve flow conduit. Consequently, it is possible to prevent reduction in the energy recovery efficiency due to the hydraulic oil flow fluctuations.

In particular, the controller 5 preferably sets the switching frequency f to a frequency close to the first anti-resonance frequency of the hydraulic oil flow conduit. In this case, it is possible to further suppress the hydraulic oil flow fluctuations associated with the resonance of the hydraulic oil flow conduit including the inertial fluid chamber 21 and the valve flow conduit (the low-pressure-side branch channel 31 and the high-pressure-side branch channel 32).

Next, a second embodiment of the present invention is described. The second embodiment differs from the above-described first embodiment in that an inertial fluid chamber 22 is provided in place of the inertial fluid chamber 21. Thus, the description given below mainly focuses on such difference from the first embodiment and omits features that are the same as those of the first embodiment.

Figure 6:
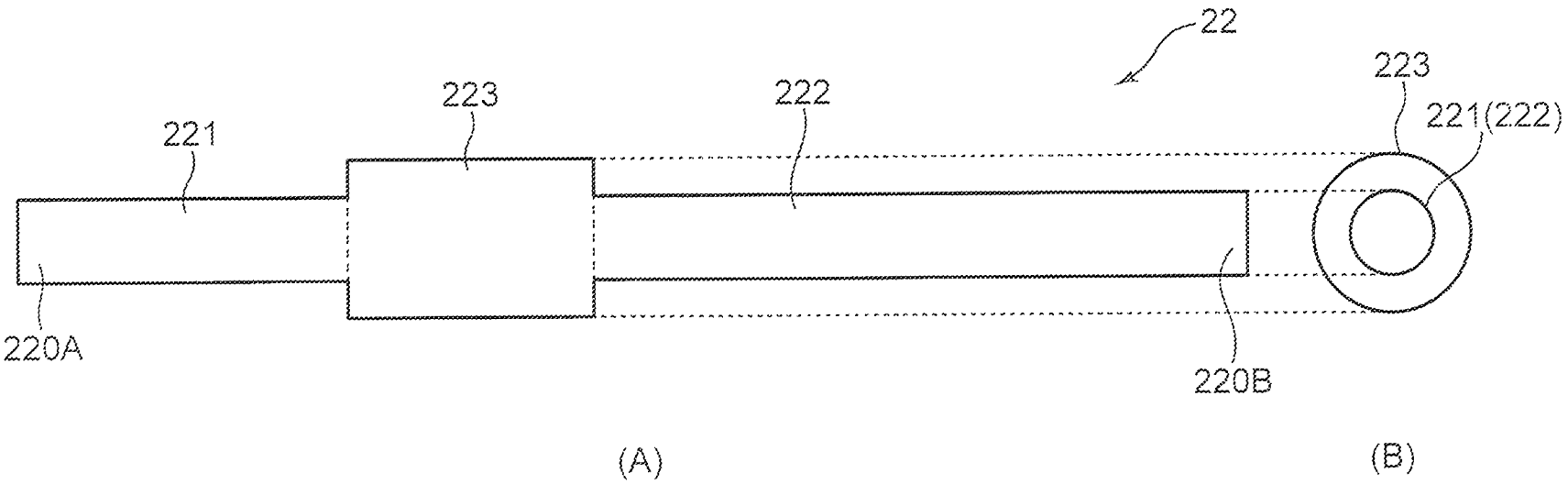
FIG. 6 is a cross-sectional view of an inertial fluid chamber of an energy recovery system according to a second embodiment of the present invention.

In the second embodiment, the energy recovery system 1 (FIG. 1) includes the inertial fluid chamber 22. FIG. 6 is a cross-sectional view of the inertial fluid chamber 22, with the region (A) being a cross-sectional view obtained by cutting the inertial fluid chamber 22 along its length (in the direction of flow of hydraulic oil), and the region (B) being a cross-sectional view obtained by cutting the inertial fluid chamber 22 radially (in the direction orthogonal to the hydraulic oil flow direction).

The inertial fluid chamber 22 has a cylindrical inner space communicating with the piston-side chamber 203 of the hydraulic cylinder 20 (FIG. 1). The inertial fluid chamber 22 receives hydraulic oil discharged from the piston-side chamber 203 by movement of the piston 202. As an example, the inertial fluid chamber 22 of the second embodiment is in the form of a pipe with a circular cross section. The volume of the inner space of the inertial fluid chamber 22 is smaller than the volume of the inner space of the hydraulic cylinder 20. The inner space of the inertial fluid chamber 22 is filled with hydraulic oil. The inertial fluid chamber 21 has an inlet, referred to as a fluid chamber inlet 220A, connected to the piston-side chamber 203 of the hydraulic cylinder 20. The inertial fluid chamber 22 also has an outlet referred to as a fluid chamber outlet 220B, to which the low pressure pipe PL and the high pressure pipe PH (FIG. 1) are connected in parallel.

The inertial fluid chamber 22 includes a first fluid compartment 221 (first pipe channel), a second fluid compartment 222 (third pipe channel), and a middle fluid compartment 223 (second pipe channel). The inner diameter of the middle fluid compartment 223 is larger than that of the first fluid compartment 221 and the second fluid compartment 222. The axial length of the middle fluid compartment 223 is about a quarter of the entire axial length of the inertial fluid chamber 22. The cross section of the middle fluid compartment 223 is preferably twice to three times as large as that of the first fluid compartment 221 and the second fluid compartment 222. The inner diameters of the first fluid compartment 221 and the second fluid compartment 222 may be the same with or different from each other. In the description given below, the first fluid compartment 221 and the second fluid compartment 222 have the same inner diameter. As an example, the inertial fluid chamber 22 of the second embodiment has a total length L in the hydraulic oil flow direction, with the first fluid compartment 221 being four fifteenths as long as L, the second fluid compartment 222 being eight fifteenths as long as L, and the middle fluid compartment 223 being as three fifteenths as long as L. As an example, L is 3,000 (mm).

Figure 7:
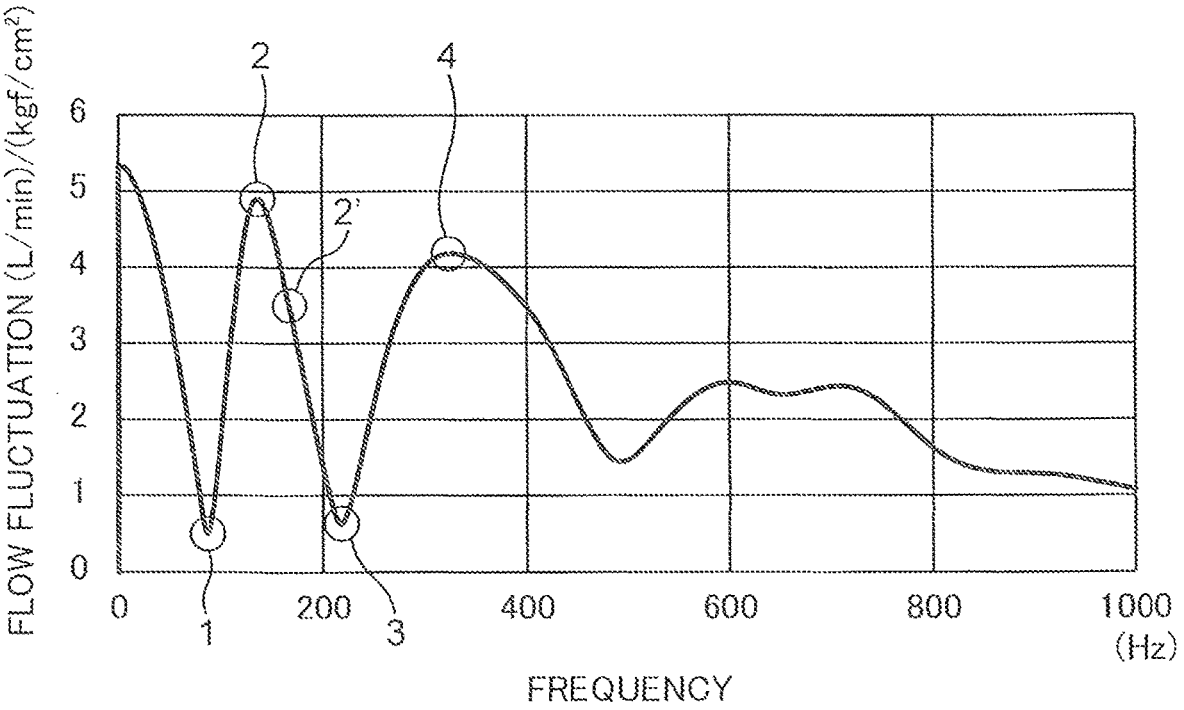
FIG. 7 is a graph showing an example of a relationship between the frequency of pressure fluctuations that occur in a flow conduit for a working fluid and flow fluctuations (frequency response of flow fluctuations) of the working fluid in the energy recovery system according to the second embodiment of the present invention.

FIG. 7 is a graph showing an example of a relationship between the frequency of pressure fluctuations that occur in the flow conduit for hydraulic oil and flow fluctuations (frequency response of flow fluctuations) of the hydraulic oil in the energy recovery system 1 according to the second embodiment. FIG. 7 corresponds to FIG. 3 of the first embodiment. Specifically, the inertial fluid chamber 22 is provided in place of the inertial fluid chamber 21 in FIG. 1. The opening of the high pressure valve 3H is fully opened (free end) and the opening of the low pressure valve 3L is fully closed (fixed end), and in this state sinusoidal pressure fluctuations are intentionally applied to the high pressure source HP. FIG. 7 shows a waveform representing flow fluctuations (frequency response) of hydraulic oil near the fluid chamber outlet 220B of the inertial fluid chamber 22 at this time. The data shown in FIG. 7, similarly to FIG. 3, may be computer simulated or measured by a flow meter provisionally provided near the fluid chamber outlet 220B.

With reference to FIG. 7, the magnitude of the hydraulic oil flow fluctuations changes according to the frequency of the applied pressure fluctuations, based on the vibrational characteristics of the entire hydraulic oil flow conduit. In the graph of FIG. 7, the symbol "1" indicates the first anti-resonance frequency, the symbol "2" indicates the first resonance frequency, the symbol "3" indicates the second anti-resonance frequency, and the symbol "4" indicates the second resonance frequency, of the flow conduit (system). As can be seen from the graph, the anti-resonance and resonance frequencies appear alternately also in FIG. 7.

On the other hand, the result of FIG. 7 shows that the first resonance frequency "2" is lower than twice the first anti-resonance frequency "1". In other words, the frequency "2'", which is twice the first anti-resonance frequency "1", is away from the first anti-resonance frequency. This shows that it is possible to exclude the second harmonic of the fundamental frequency from the first resonance frequency of the system when the first anti-resonance frequency of the system is set as the fundamental frequency (i.e. switching frequency f). In addition, in the case of FIG. 7, the second resonance frequency "2'" of the system may be close to a higher-order (third or higher order) harmonic of the fundamental frequency; however, the magnitude of the second resonance component is smaller than the first resonance component in the flow fluctuations due to attenuation of the system. Thus, no significant effect is found.

Described hereinafter are results of comparison between the inertial fluid chamber 21 shown in FIG. 1 and the inertial fluid chamber 22 shown in FIG. 6, with a duty ratio of 0.75.

<Case where Switching Frequency f is Set to Anti-Resonance Frequency for Inertial Fluid Chamber 21 (Duty Ratio d=0.75)>

Figure 8A:
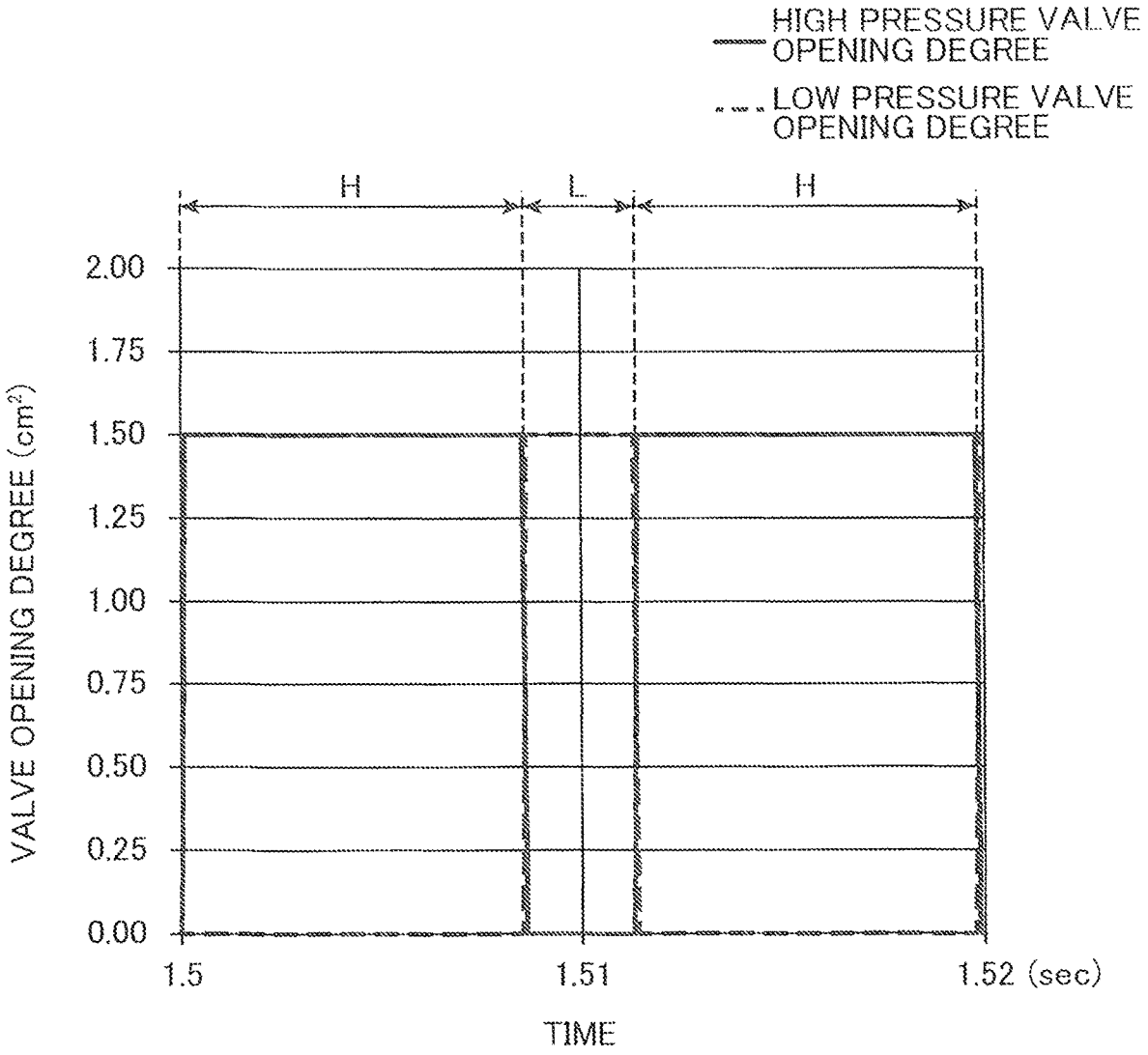
FIG. 8A is a graph showing change over time in the opening degree of a high pressure valve and a low pressure valve.
Figure 8B:
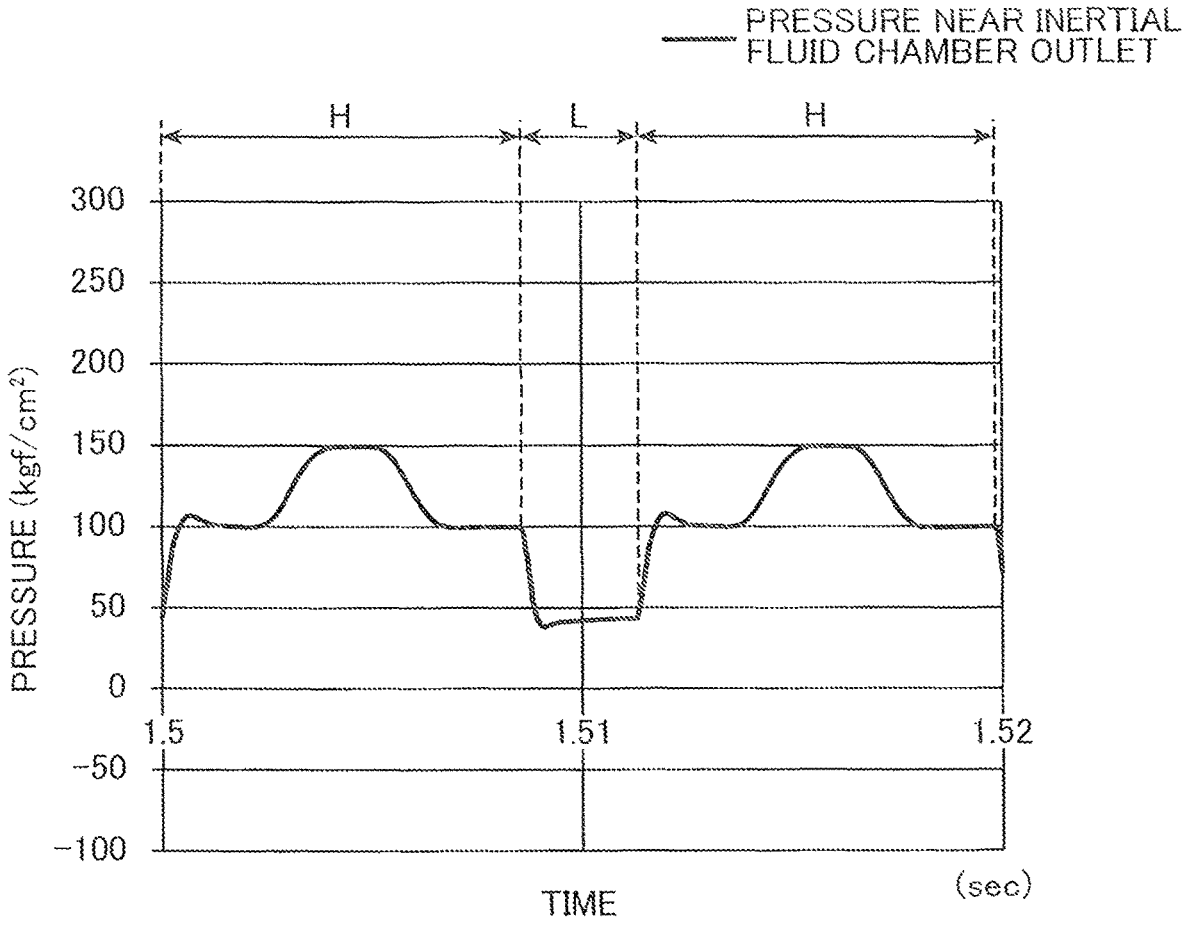
FIG. 8B is a graph showing change over time in the pressure of working fluid near the outlet of the inertial fluid chamber, the graph corresponding to the valve control shown in FIG. 8A.
Figure 8C:
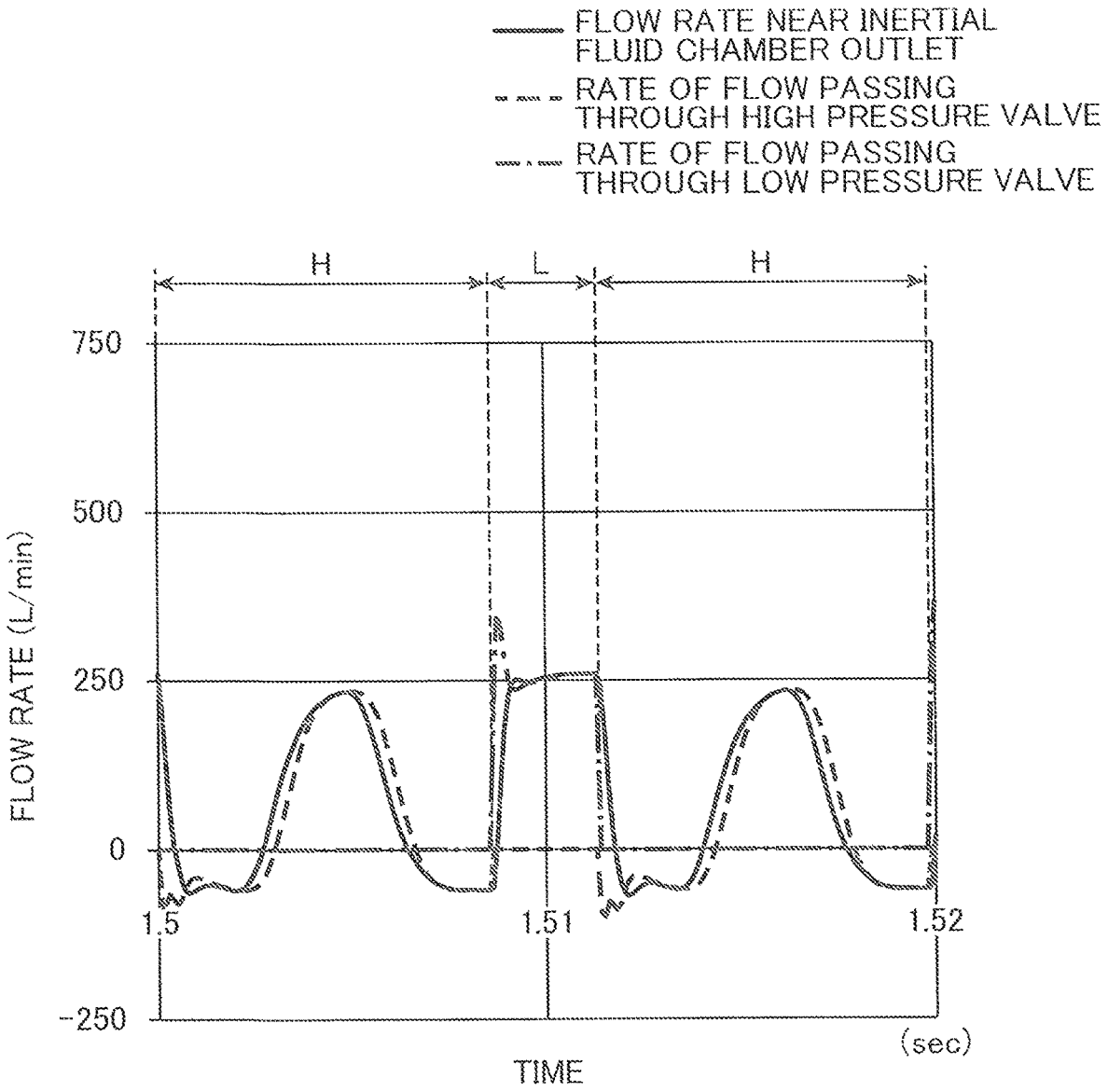
FIG. 8C is a graph showing changes over time in the flow rate of the working fluid near the outlet of the inertial fluid chamber, the flow rate of working fluid passing through the high pressure valve, and the flow rate of working fluid passing through the low pressure valve, the graph corresponding to the valve control shown in FIG. 8A.
Figure 8D:
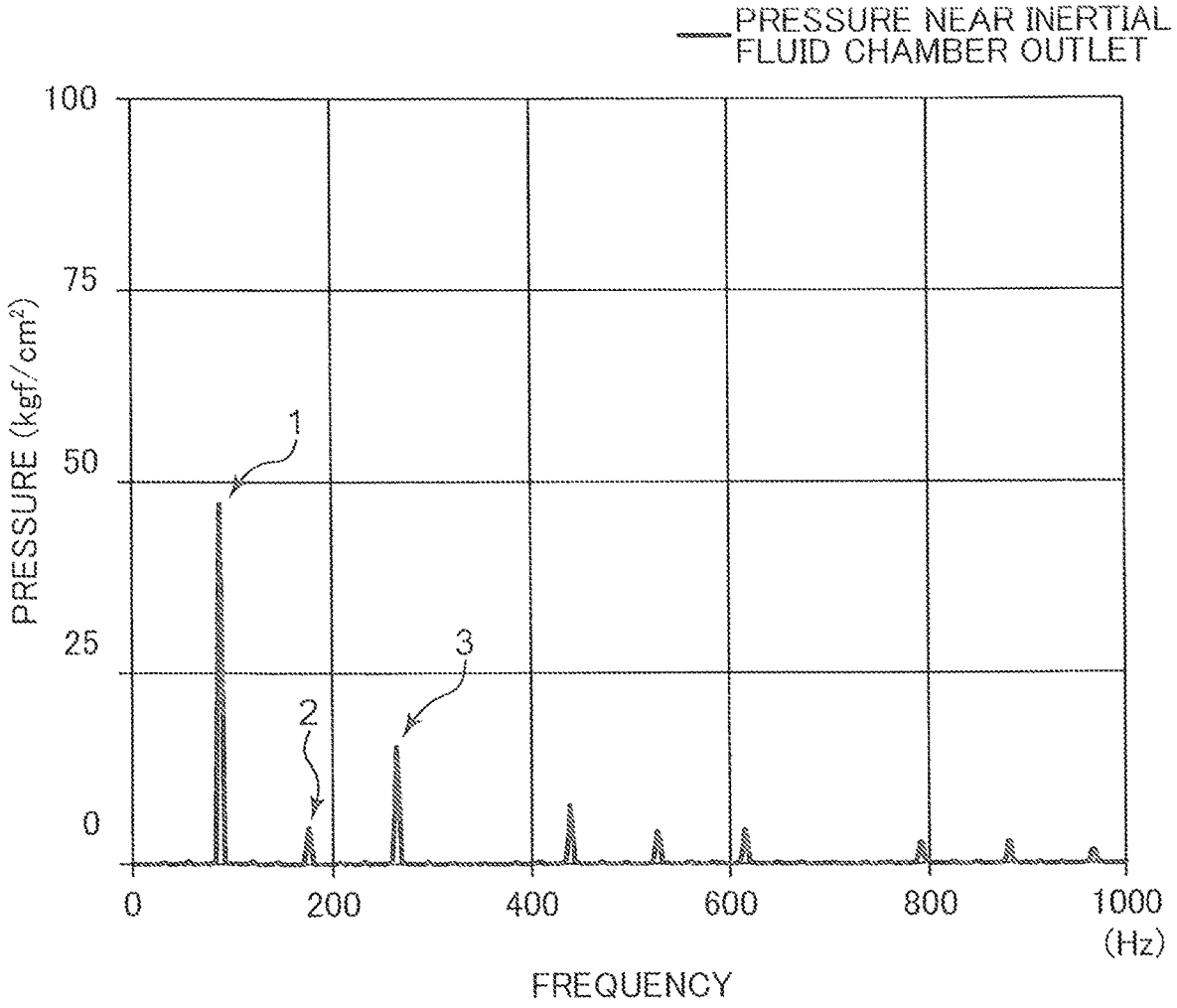
FIG. 8D is a graph showing frequency response of the pressure fluctuations of the working fluid near the outlet of the inertial fluid chamber, the graph corresponding to the valve control shown in FIG. 8A.
Figure 8E:
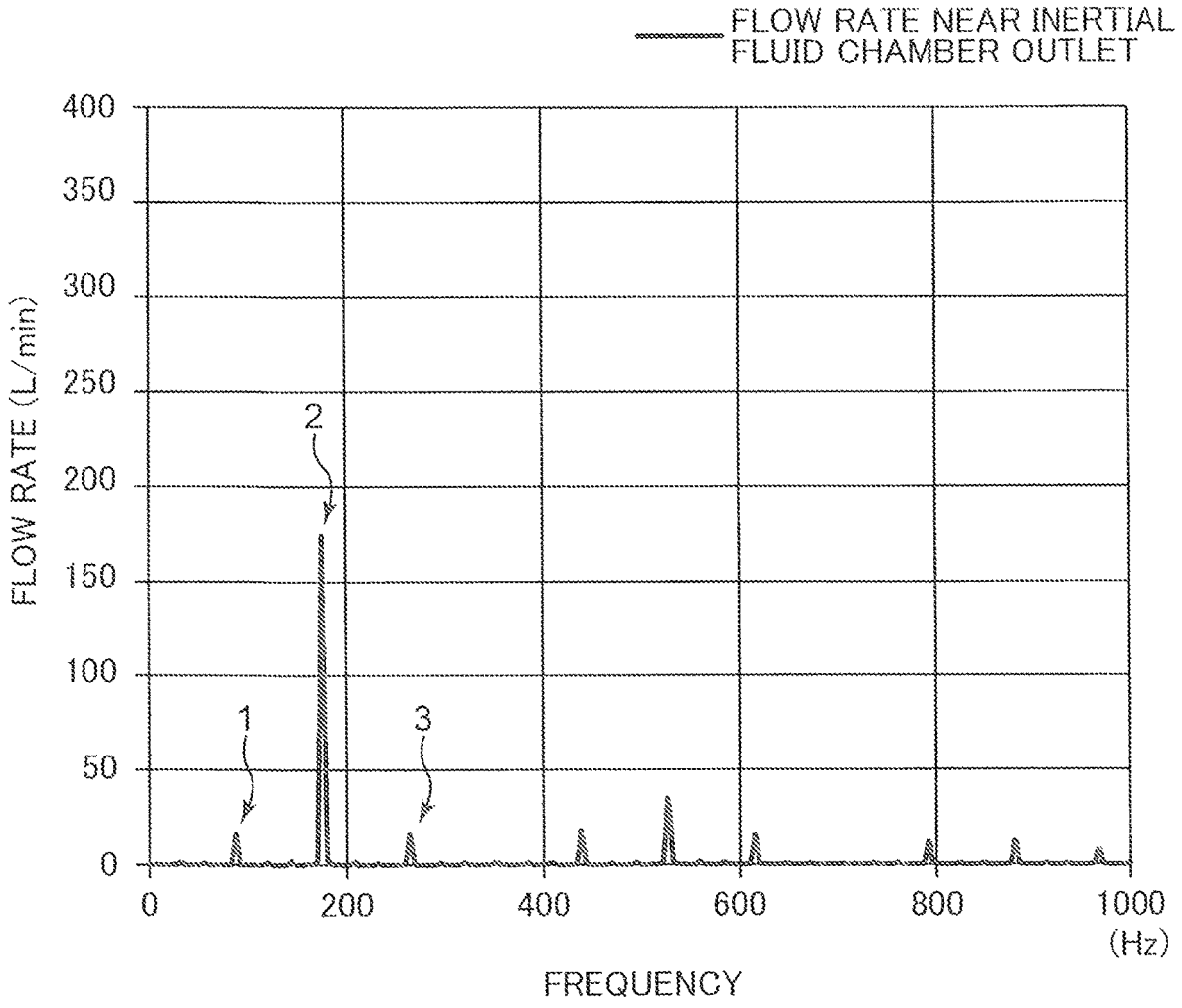
FIG. 8E is a graph showing frequency response of the flow fluctuations of the working fluid near the outlet of the inertial fluid chamber, the graph corresponding to the valve control shown in FIG. 8A.

FIGS. 8A to 8E are graphs each showing change in a characteristic value when the switching frequency f for the high pressure valve 3H and the low pressure valve 3L is set to the first anti-resonance frequency (the frequency "1" in FIG. 3, which is 88 Hz) with the duty ratio d of 0.75, in the energy recovery system 1 including the inertial fluid chamber 21 shown in FIG. 1. FIG. 8A is a graph showing change over time in the opening degree of the high pressure valve 3H and the low pressure valve 3L. FIGS. 8B to 8E correspond to the valve control shown in FIG. 8A. FIG. 8B is a graph showing change over time in pressure fluctuations of hydraulic oil near the fluid chamber outlet 210 of the inertial fluid chamber 21. FIG. 8C is a graph showing changes over time in the flow rate of the hydraulic oil near the fluid chamber outlet 210 of the inertial fluid chamber 21, the flow rate of hydraulic oil passing through the high pressure valve 3H, and the flow rate of hydraulic oil passing through the low pressure valve 3L. FIG. 8D is a graph showing frequency response of the pressure fluctuations of the hydraulic oil near the fluid chamber outlet 210 of the inertial fluid chamber 21 (FIG. 8B). FIG. 8E is a graph showing frequency response of the flow fluctuations of the hydraulic oil near the fluid chamber outlet 210 of the inertial fluid chamber 21 (FIG. 8C).

In the range H of FIG. 8C, although the inertial fluid chamber 21 communicates with the high pressure source HP, hydraulic oil flows backward from the high pressure source HP toward the inertial fluid chamber 21 during some time periods (the rate of flow passing through the high pressure valve is negative). As shown in FIG. 8D, the case of the duty ratio d of 0.75 differs from the case of the duty ratio d of 0.5 in that excitation frequencies occurring in the system include frequencies that are even number multiples of the switching frequency as well as the frequencies that are odd number multiples of the switching frequency. Thus, the excitation frequencies are whole number multiples of the fundamental frequency (i.e. switching frequency f) (the excitation frequencies being indicated by the arrows "1", "2", and "3" in FIG. 8D). Moreover, since the inertial fluid chamber 21 has a linear and uniform cross section, a resonance frequency is twice an anti-resonance frequency. Thus, the first resonance frequency (indicated by the arrow "2" in FIG. 8D) is close to the second harmonic of (a frequency that is twice) the fundamental frequency (indicated by the arrow "1" in FIG. 8D). As a result, the second harmonic component (indicated by the arrow "2" in FIG. 8E) of the fundamental frequency of the flow fluctuations is excited with a great amplitude, which causes the backward flows of hydraulic oil. In this case, it is difficult in the recovery of hydraulic oil energy to prevent reduction in the energy recovery efficiency.

<Case where Switching Frequency f is Set to Anti-Resonance Frequency for Inertial Fluid Chamber 22 (Duty Ratio d=0.75)>

Figure 9A:
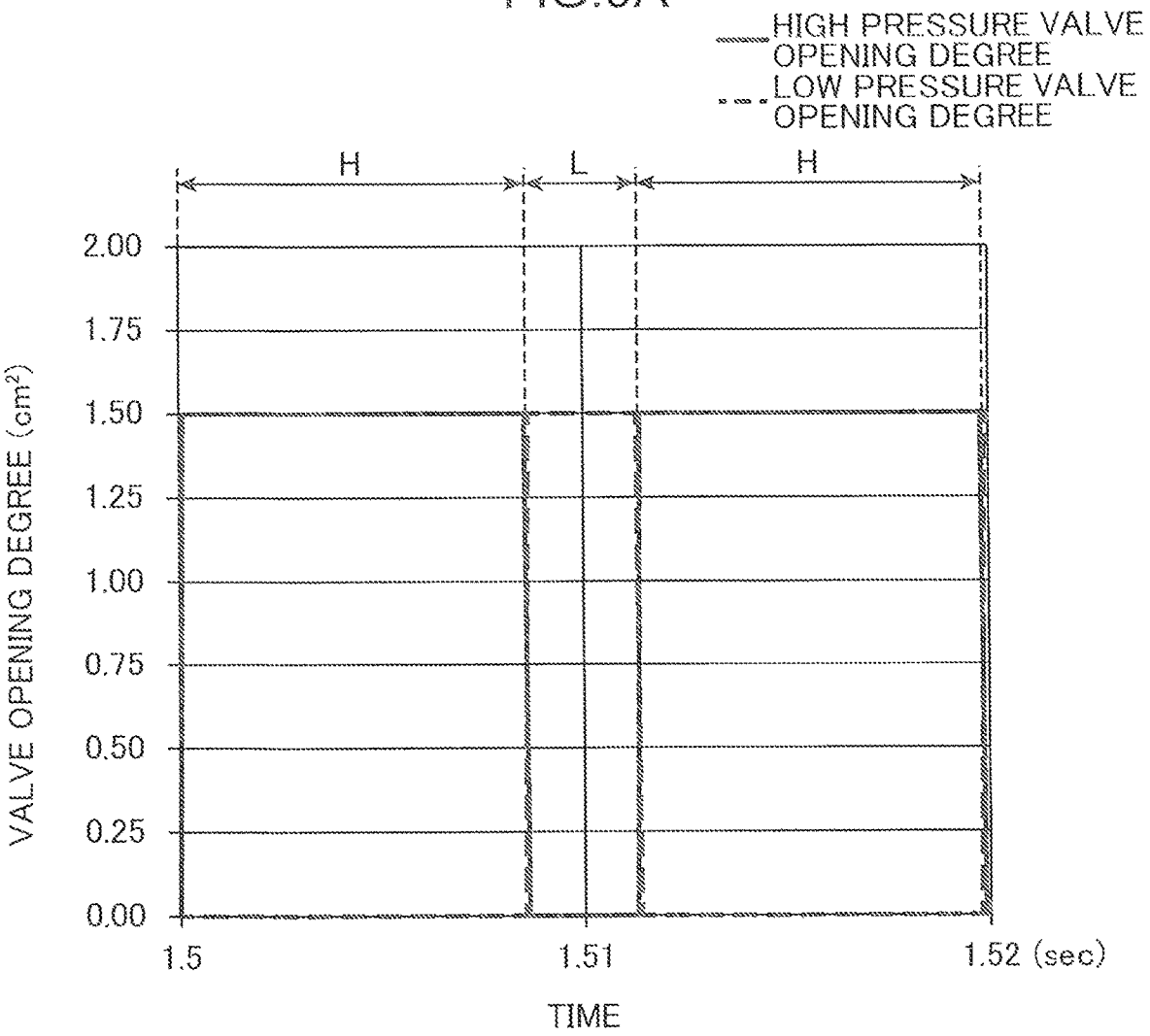
FIG. 9A is a graph showing change over time in the opening degree of the high pressure valve and the low pressure valve.
Figure 9B:
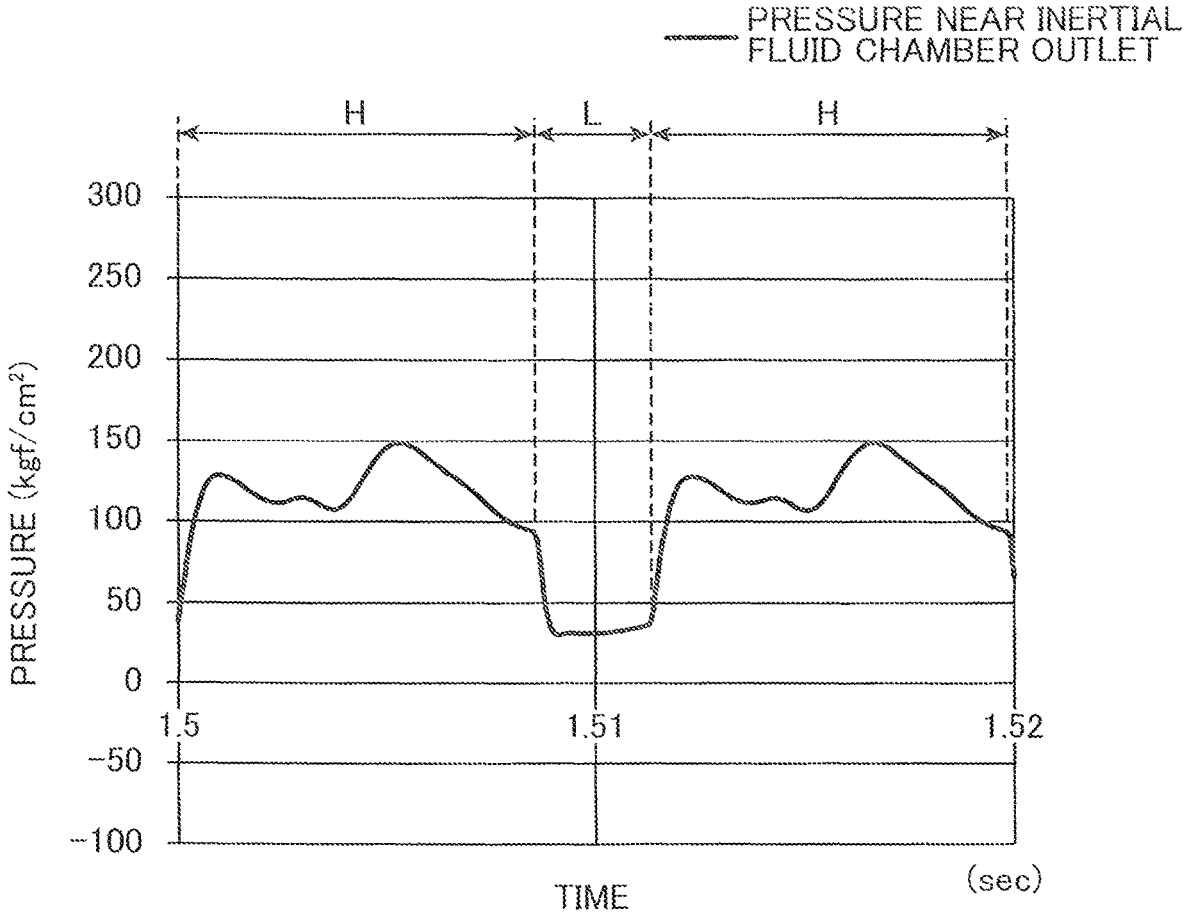
FIG. 9B is a graph showing change over time in the pressure of working fluid near the outlet of the inertial fluid chamber, the graph corresponding to the valve control shown in FIG. 9A.
Figure 9C:
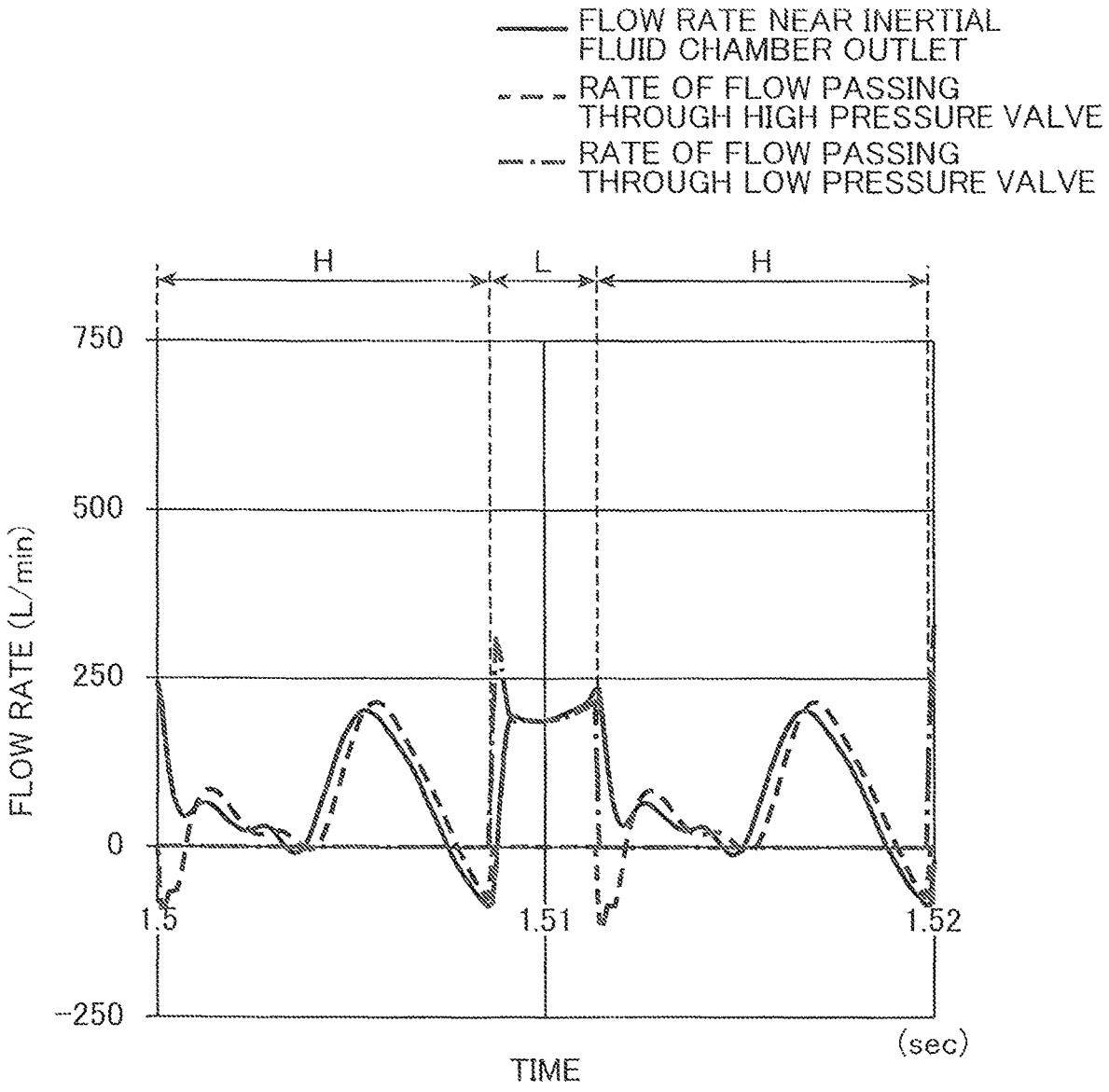
FIG. 9C is a graph showing changes over time in the flow rate of the working fluid near the outlet of the inertial fluid chamber, the flow rate of working fluid passing through the high pressure valve, and the flow rate of working fluid passing through the low pressure valve, the graph corresponding to the valve control shown in FIG. 9A.
Figure 9D:
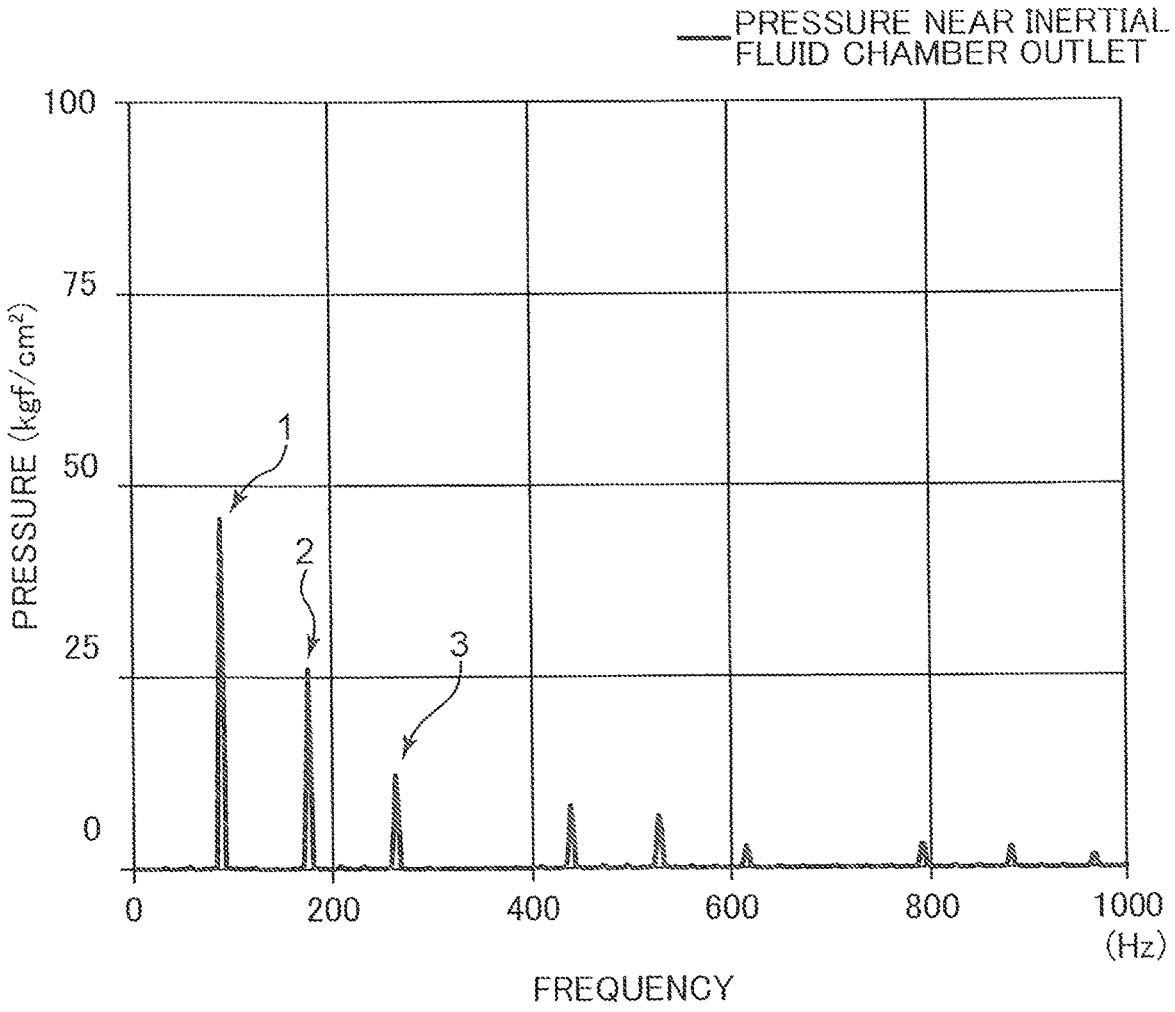
FIG. 9D is a graph showing frequency response of the pressure fluctuations of the working fluid near the outlet of the inertial fluid chamber, the graph corresponding to the valve control shown in FIG. 9A.
Figure 9E:
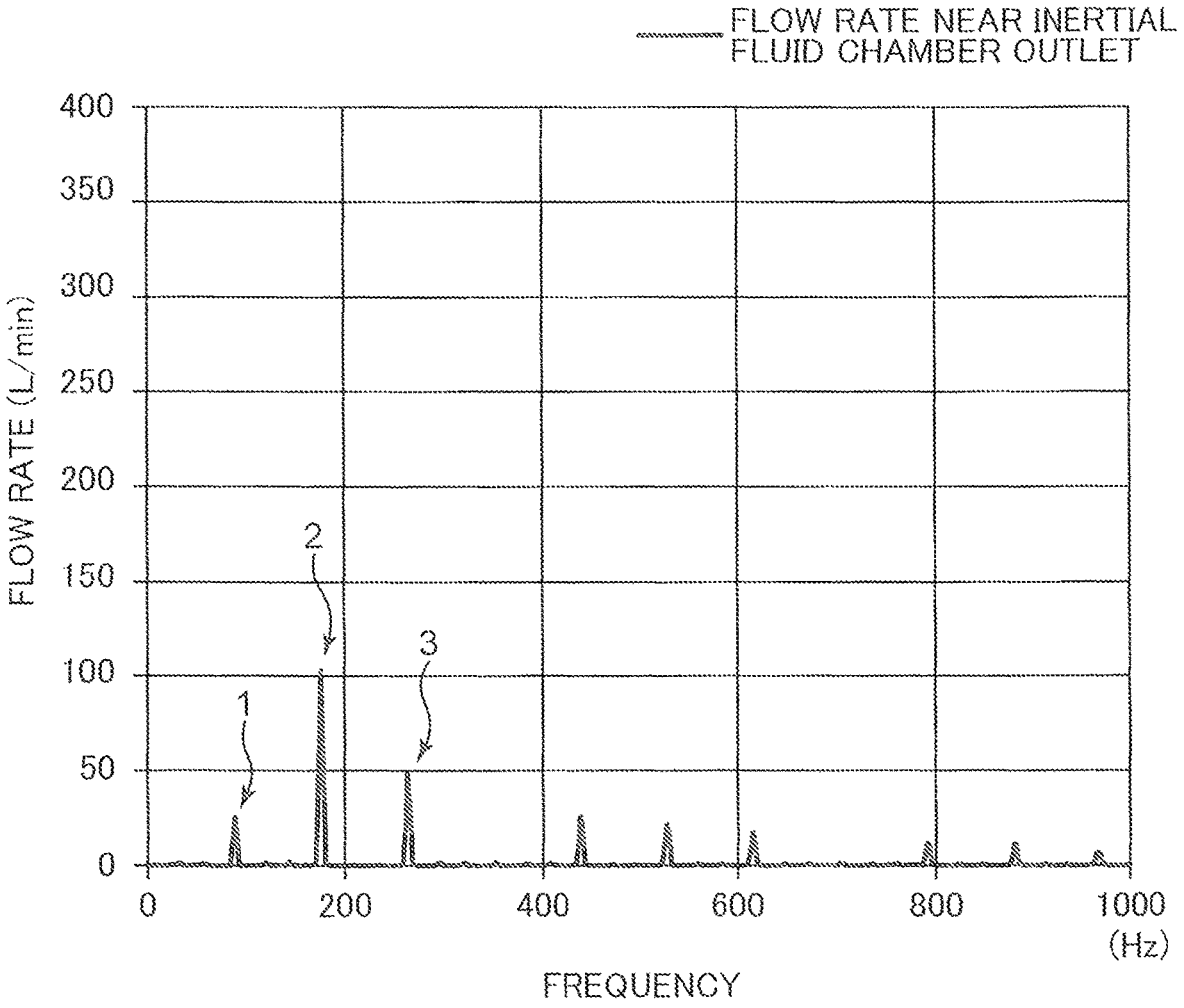
FIG. 9E is a graph showing frequency response of the flow fluctuations of the working fluid near the outlet of the inertial fluid chamber, the graph corresponding to the valve control shown in FIG. 9A.

In contrast, FIGS. 9A to 9E are graphs each showing change in a characteristic value when the switching frequency f for the high pressure valve 3H and the low pressure valve 3L is set to the first anti-resonance frequency (the frequency "1" in FIG. 3, which is 88 Hz) with the duty ratio d of 0.75, in the energy recovery system 1 including the inertial fluid chamber 22 shown in FIG. 6. FIG. 9A is a graph showing change over time in the opening degree of the high pressure valve 3H and the low pressure valve 3L. FIGS. 9B to 9E correspond to the valve control shown in FIG. 9A. FIG. 9B is a graph showing change over time in pressure fluctuations of hydraulic oil near the fluid chamber outlet 220B of the inertial fluid chamber 22. FIG. 9C is a graph showing changes over time in the flow rate of the hydraulic oil near the fluid chamber outlet 220B of the inertial fluid chamber 22, the flow rate of hydraulic oil passing through the high pressure valve 3H, and the flow rate of hydraulic oil passing through the low pressure valve 3L. FIG. 9D is a graph showing frequency response of the pressure fluctuations of the hydraulic oil near the fluid chamber outlet 220B of the inertial fluid chamber 22 (FIG. 9B). FIG. 9E is a graph showing frequency response of the flow fluctuations of the hydraulic oil near the fluid chamber outlet 220B of the inertial fluid chamber 22 (FIG. 9C).

In the range H of FIG. 9C, the inertial fluid chamber 22 communicates with the high pressure source HP, and hydraulic oil flows backward from the high pressure source HP toward the inertial fluid chamber 22 during some time periods (the rate of flow passing through the high pressure valve is negative). However, the hydraulic oil backward flow is less in FIG. 9C than in FIG. 8C. Also in this case with the duty ratio d of 0.75, as shown in FIG. 9D, the excitation frequencies are whole number multiples of the fundamental frequency (i.e. switching frequency) (the excitation frequencies being indicated by the arrows "1", "2", and "3" in FIG. 9D). However, since the inertial fluid chamber 22 includes the middle fluid compartment 223, the second harmonic (indicated by the arrow "2'" in FIG. 7 and the arrow "2" in FIG. 9D) of the fundamental frequency is not at or away from the first resonance frequency (indicated by the arrow "2" in FIG. 7) of the system. Thus, the second harmonic (indicated by the arrow "2" in FIG. 9E) of the fundamental frequency of flow fluctuations is less in FIG. 9E than that in FIG. 8E indicated by the arrow "2". As a result, as shown in FIG. 9C, the rate of hydraulic oil flowing backward is small compared to FIG. 8C, thus preventing, in the recovery of hydraulic oil energy, reduction in the energy recovery efficiency.

As described above, in the second embodiment, the inertial fluid chamber 22 has such a shape as to make the frequency that is twice the first anti-resonance frequency of the hydraulic oil flow conduit away from the first resonance frequency of the hydraulic oil flow conduit. This makes it possible, even when the frequency that is twice the first anti-resonance frequency of the hydraulic oil flow conduit is excited, to suppress the hydraulic oil flow fluctuations associated with the resonance of the hydraulic oil flow conduit.

In particular, the inertial fluid chamber 22 is in the form of a cylinder extending in the hydraulic oil flow direction, and includes the first fluid compartment 221 (first pipe channel) communicating with the piston-side chamber 203, the middle fluid compartment 223 (second pipe channel) communicating with the first fluid compartment 221 and having a larger inner diameter than the first fluid compartment 221, and the second fluid compartment 222 (third pipe channel) communicating with the middle fluid compartment 223 and the valve flow conduit (the low-pressure-side branch channel 31 and the high-pressure-side branch channel 32) and having a smaller inner diameter than the middle fluid compartment 223. This makes it possible, even when the frequency that is twice the first anti-resonance frequency of the hydraulic oil flow conduit is excited, to reliably suppress the hydraulic oil flow fluctuations associated with the resonance of the hydraulic oil flow conduit.

<Comparison Between Duty Ratios d>

Comparison between FIGS. 4A to 4E and FIGS. 8A to 8E makes it possible to examine hydraulic oil recovery performances with different duty ratios d in the energy recovery system 1 that includes the inertia fluid chamber 21 in the form of a cylinder (having a straight pipe shape) linearly extending in the hydraulic oil flow direction. Specifically, in the case where the duty ratio d is 0.5, the frequency components that are odd number multiples of the fundamental frequency (i.e. the switching frequency f) are excited, whereas in the case where the duty ratio d is 0.75, the frequency components that are whole number multiples of the fundamental frequency are excited. Thus, in the case where the inertial fluid chamber according to the present invention has a linear and uniform cross section as the inertial fluid chamber 21, it is possible to reduce the second harmonic component of the fundamental frequency of the flow fluctuations by setting the duty ratio d of the pulse for controlling the low pressure valve 3L and the high pressure valve 3H to a value close to 0.5. This makes it possible to suppress the hydraulic oil flow fluctuations associated with the resonance of the hydraulic oil flow conduit. Consequently, it is possible in the recovery of hydraulic oil energy to prevent reduction in the energy recovery efficiency.

In the control of setting the duty ratio d to a value close to 0.5 as described above, the controller 5 desirably sets the duty ratio d within the range of 0.45 to 0.55. In this case, it is possible to reliably suppress the hydraulic oil flow fluctuations associated with the resonance of the hydraulic oil flow conduit including the inertial fluid chamber 21 and the valve flow conduit.

Next, a third embodiment of the present invention is described. The third embodiment differs from the above-described first embodiment in that an inertial fluid chamber 23 is provided in place of the inertial fluid chamber 21. Thus, the description given below mainly focuses on such difference from the first embodiment and omits features that are the same as those of the first embodiment.

Figure 10:
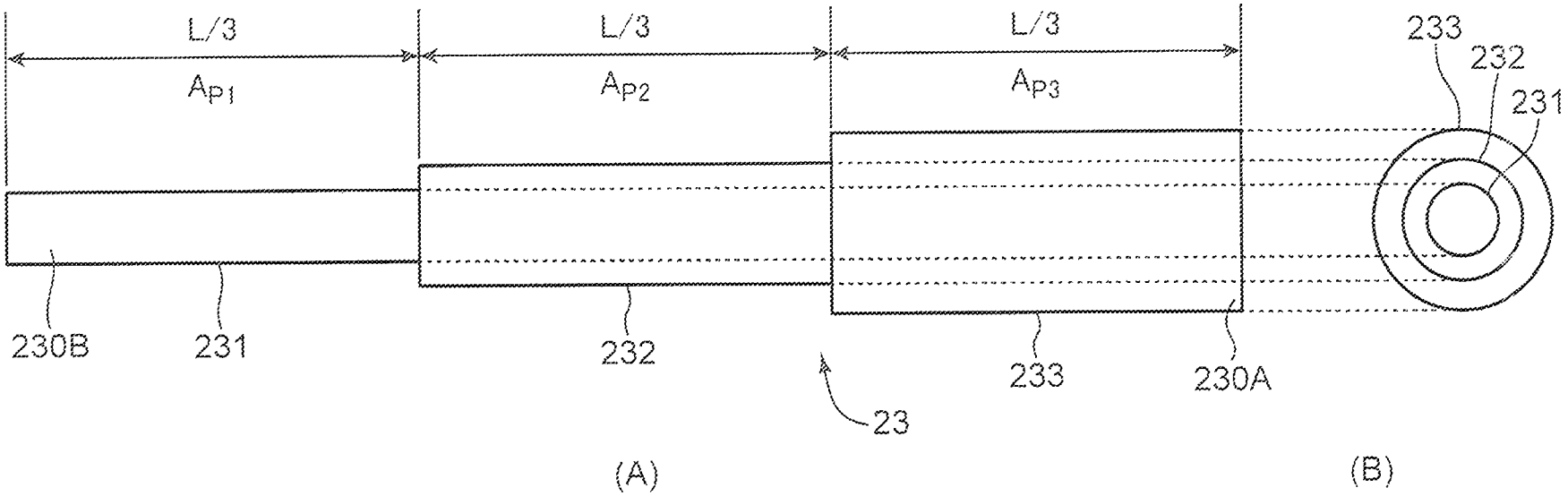
FIG. 10 is a cross-sectional view of an inertial fluid chamber of an energy recovery system according to a third embodiment of the present invention.

In the third embodiment, the energy recovery system 1 (FIG. 1) includes the inertial fluid chamber 23. FIG. 10 is a cross-sectional view of the inertial fluid chamber 23, with the region (A) being a cross-sectional view obtained by cutting the inertial fluid chamber 23 along its length (in the direction of flow of hydraulic oil), and the region (B) being a cross-sectional view obtained by cutting the inertial fluid chamber 23 radially (in the direction orthogonal to the hydraulic oil flow direction).

The inertial fluid chamber 23 has a cylindrical inner space communicating with the piston-side chamber 203 of the hydraulic cylinder 20 (FIG. 1). The inertial fluid chamber 23 receives hydraulic oil discharged from the piston-side chamber 203 by movement of the piston 202. As an example, the inertial fluid chamber 23 of the third embodiment is in the form of a pipe with a circular cross section. The volume of the inner space of the inertial fluid chamber 23 is smaller than the volume of the inner space of the hydraulic cylinder 20. The inner space of the inertial fluid chamber 23 is filled with hydraulic oil. The inertial fluid chamber 23 has a fluid chamber inlet 230A, a fluid chamber outlet 230B, and a plurality of fluid sub-chambers (a third fluid compartment 231, a fourth fluid compartment 232, and a fifth fluid compartment 233) (a plurality of pipe channels). The fluid chamber inlet 230A serves as an inlet of the inertial fluid chamber 23 and communicates with the piston-side chamber 203 of the hydraulic cylinder 20. The fluid chamber outlet 230B serves as an outlet of the inertial fluid chamber 23 and is connected to (communicates with) the low pressure pipe PL and the high pressure pipe PH (FIG. 1) in parallel.

As described above, the inertial fluid chamber 23 includes the third fluid compartment 231 disposed at the most downstream, the fourth fluid compartment 232, and the fifth fluid compartment 233 disposed at the most upstream. As shown in FIG. 10, the fifth fluid compartment 233, the fourth fluid compartment 232, and the third fluid compartment 231 are sequentially arranged from the fluid chamber inlet 230A to the fluid chamber outlet 230B with respective cross sections orthogonal to the hydraulic oil flow direction decreasing stepwise in the hydraulic oil flow direction. Each of the third fluid compartment 231, the fourth fluid compartment 232, and the fifth fluid compartment 223 has a constant cross section. Although the inertial fluid chamber 23 of the third embodiment includes the three stepped pipe channels, the inertial fluid chamber 23 may include four or more stepped pipe channels as described later.

With reference to FIG. 10, L (mm) denotes the total length of the inertial fluid chamber 23 in the hydraulic oil flow direction. In the third embodiment, the third fluid compartment 231, the fourth fluid compartment 232, and the fifth fluid compartment 233 each have a length of L/3 or one third of L. In addition, $A_{p1}$, $A_{p2}$, $A_{p3}$ denote the cross sections of the third fluid compartment 231, the fourth fluid compartment 232, and the fifth fluid compartment 233, respectively ($A_{p1}<A_{p2}<A_{p3}$). In this case, the ratios of the cross sections preferably satisfy the following formulas 2 and 3.

$$a_2=A_{p2}/A_{p1}<5 \quad \text{(Formula 2)}$$

$$a_3=A_{p3}/A_{p1}<5 \quad \text{(Formula 3)}$$

When the energy recovery system 1 including the inertial fluid chamber 23 according to the third embodiment is applied, for example, to a high-pressure piping system of a construction machine, a ½ inch pipe has an inner diameter Φ16.1 (mm), and a 1¼ inch pipe has an inner diameter 35.5 (mm). Thus, the relationship between these inner diameters is expressed in terms of the ratio of their cross sections as 4.84 ($=(35.5/16.1)^2$). Therefore, in view of the cost and mounting feasibility of the energy recovery system 1 to be mounted on a construction machine or some other machine, the ratios $a_2$, $a_3$ of the cross sections of the pipe channels are preferably less than 5 as shown in the formulas 2 and 3. It is more preferable to satisfy the following relationships:

$2<a_2<2.5$, and $4.5<a_3$. Further, the present inventors have found, through laborious experiments and verifications, that the ratios $a_2=2.25$ and $a_3=5$ are most preferable in the case of a three stepped configuration. These preferable setting values of $a_2=2.25$ and $a_3=5$ are applicable to inertial fluid chambers 23 of different lengths as long as its three stepped pipe channels have the same length.

Figure 11:
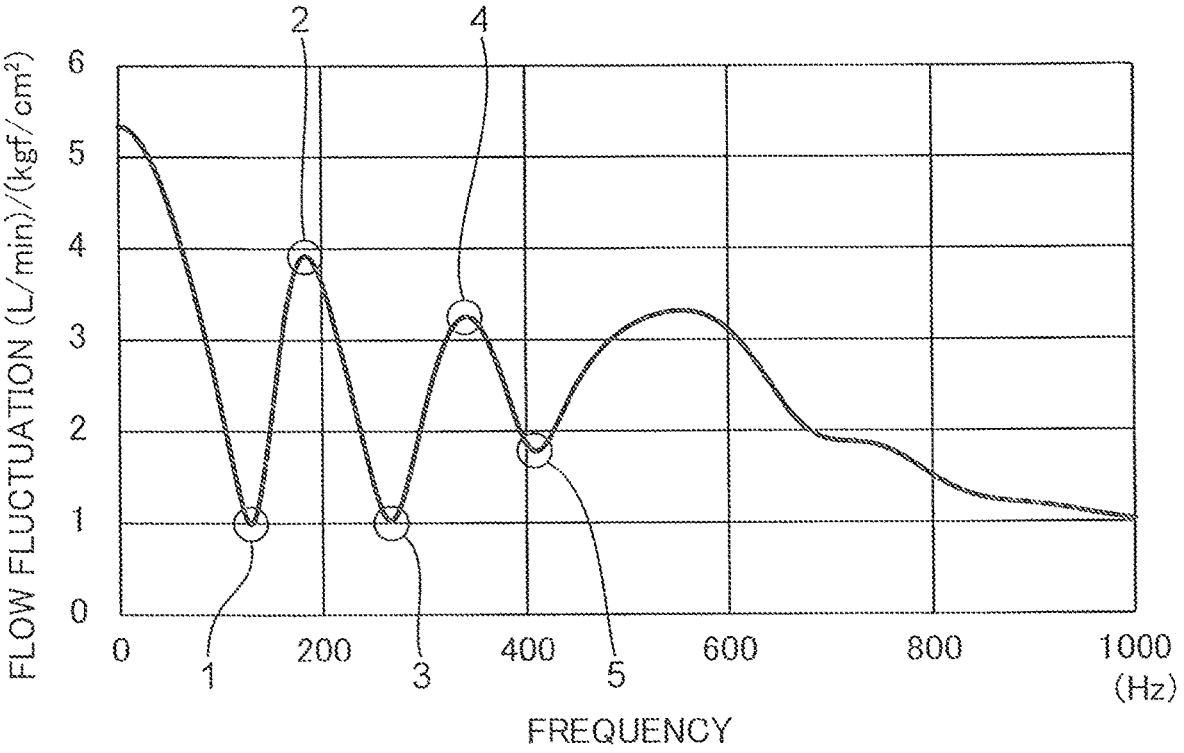
FIG. 11 is a graph showing a first example of a relationship between the frequency of pressure fluctuations that occur in a flow conduit for a working fluid and flow fluctuations (frequency response of flow fluctuations) of the working fluid in the energy recovery system according to the third embodiment of the present invention.
Figure 12:
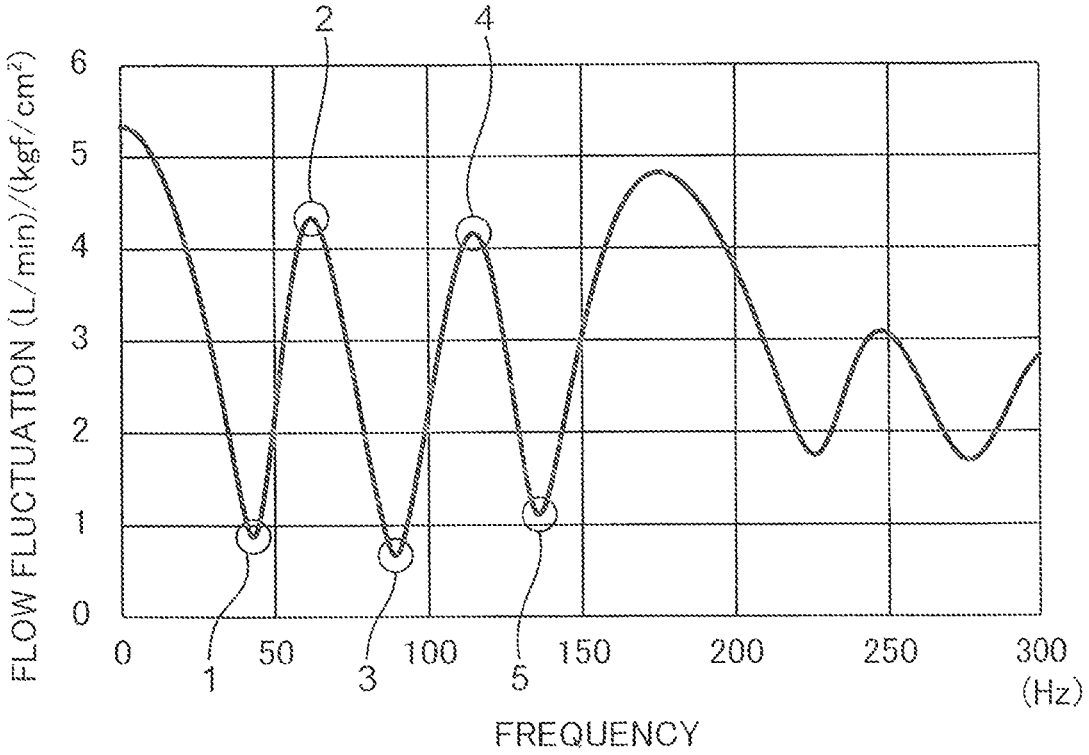
FIG. 12 is a graph showing a second example of the relationship between the frequency of pressure fluctuations that occur in the flow conduit for the working fluid and flow fluctuations (frequency response of flow fluctuations) of the working fluid in the energy recovery system according to the third embodiment of the present invention.

FIGS. 11 and 12 are graphs showing examples of a relationship between the frequency of pressure fluctuations that occur in the flow conduit for hydraulic oil and flow fluctuations (frequency response of flow fluctuations) of the hydraulic oil in the energy recovery system 1 according to the third embodiment. FIGS. 11 and 12 correspond to FIG. 3 of the first embodiment. Specifically, the inertial fluid chamber 23 is provided in place of the inertial fluid chamber 21 in FIG. 1. The opening of the high pressure valve 3H is fully opened (free end) and the opening of the low pressure valve 3L is fully closed (fixed end), and in this state sinusoidal pressure fluctuations are intentionally applied to the high pressure source HP. FIGS. 11 and 12 each show a waveform representing flow fluctuations (frequency response) of hydraulic oil near the fluid chamber outlet 230B of the inertial fluid chamber 23 at this time, and correspond to FIG. 3 of the first embodiment. The inertial fluid chamber 23 has a total length L of 3 m in FIG. 11, and has a total length of 9 m in FIG. 12. The ratios of the cross sections in the inertial fluid chamber 23 are as follows: $a_2=2.25$, and $a_3=5$. The data shown in FIGS. 11 and 12, similarly to FIG. 3, may be computer simulated or measured by a flow meter provisionally provided near the fluid chamber outlet 230B.

With reference to FIG. 11 showing the case where the total length L of the inertial fluid chamber 23 is 3 m, the magnitude of the hydraulic oil flow fluctuations changes according to the frequency of the applied pressure fluctuations, based on the vibrational characteristics of the entire hydraulic oil flow conduit. In the graph of FIG. 11, the symbol "1" indicates the first anti-resonance frequency, the symbol "2" indicates the first resonance frequency, the symbol "3" indicates the second anti-resonance frequency, the symbol "4" indicates the second resonance frequency, and the symbol "5" indicates the third anti-resonance frequency, of the flow conduit (system) (the same applies to FIG. 12). As can be seen from the graph, the anti-resonance and resonance frequencies appear alternately also in FIG. 11. Since, as shown in FIG. 10, the cross sections of the fifth fluid compartment 233, the fourth fluid compartment 232, and the third fluid compartment 231 decrease stepwise in this order in the hydraulic oil flow direction with the ratios of the cross sections set as $a_2=2.25$ and $a_3=5$, the second anti-resonance frequency (266 Hz) is twice the first anti-resonance frequency (133 Hz) and the third anti-resonance frequency (399 Hz) is three times the first anti-resonance frequency in FIG. 11.

Similarly in FIG. 12 showing the case where the total length L of the inertial fluid chamber 23 is 9 m, the second anti-resonance frequency (90 Hz) is twice the first anti-resonance frequency (45 Hz) and the third anti-resonance frequency (135 Hz) is three times the first anti-resonance frequency.

FIGS. 13A to 13E are graphs each showing change in a characteristic value when the switching frequency for the high pressure valve 3H and the low pressure valve 3L is set to the first anti-resonance frequency (the frequency "1" in FIG. 11, which is 133 Hz) in the case where the inertial fluid chamber 23 has the total length of 3 m shown in FIG. 11. FIGS. 13A to 13E correspond to FIGS. 4A to 4E of the first embodiment. FIGS. 13A to 13E show the case where the duty ratio d is 0.75 as described above.

Figure 13A:
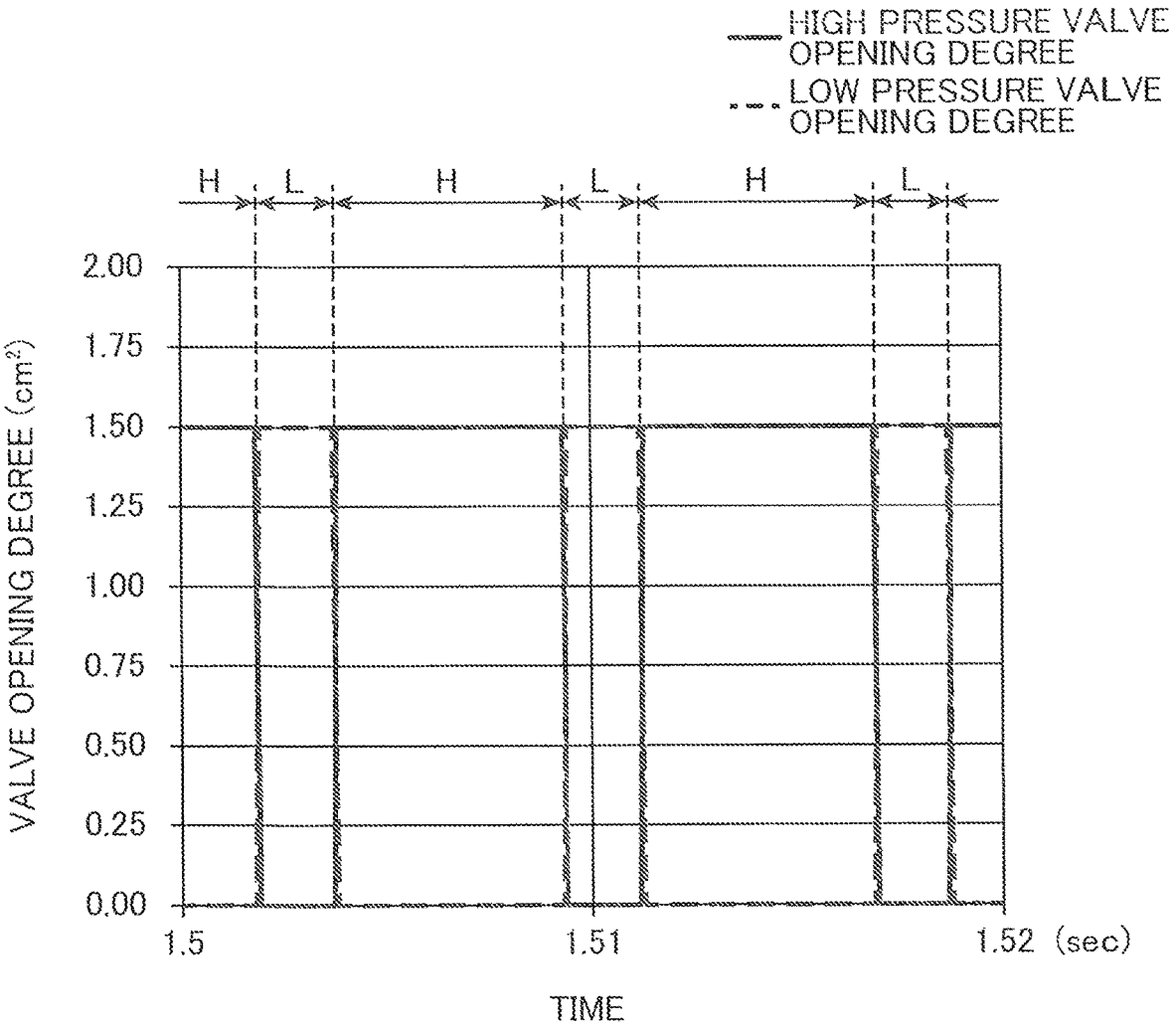
FIG. 13A is a graph showing change over time in the opening degree of a high pressure valve and a low pressure valve.
Figure 13B:
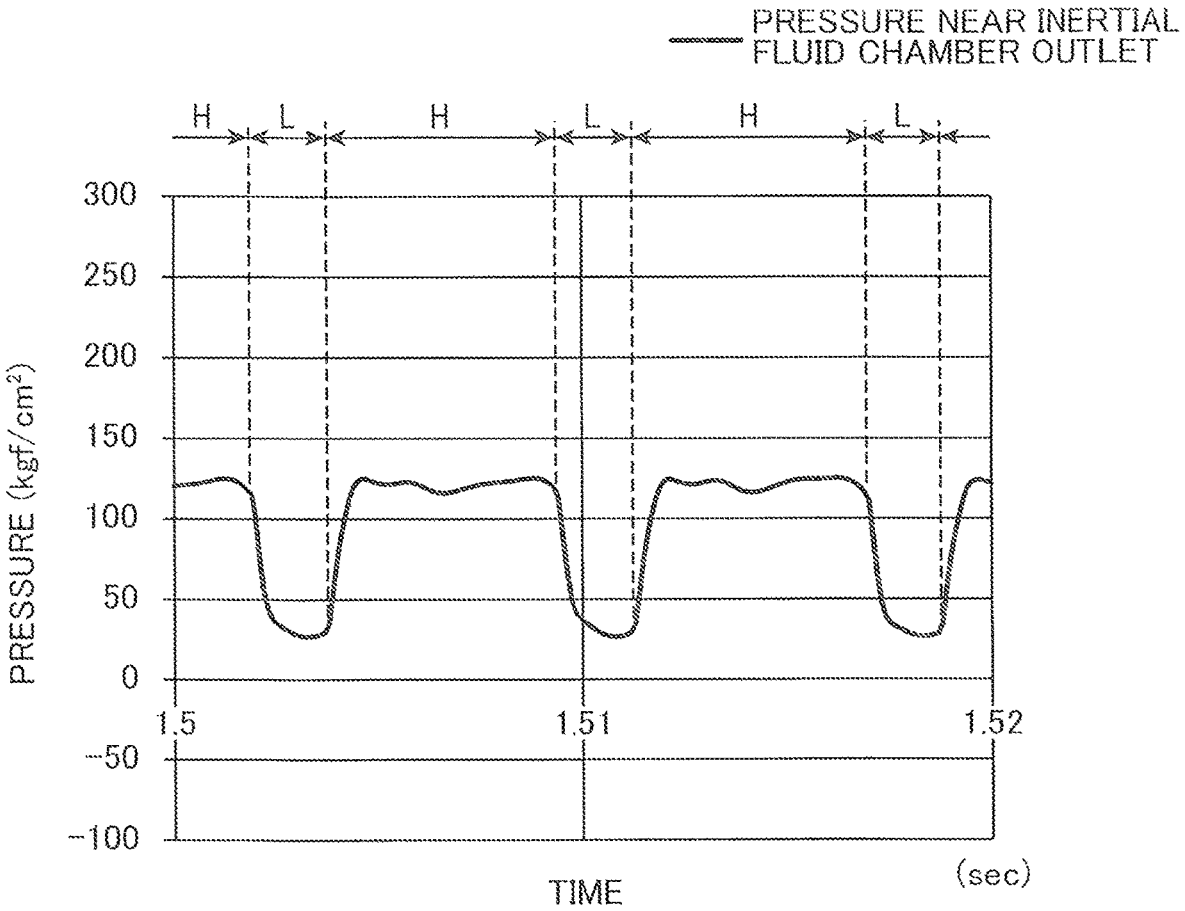
FIG. 13B is a graph showing change over time in the pressure of working fluid near the outlet of the inertial fluid chamber, the graph corresponding to the valve control shown in FIG. 13A.
Figure 13C:
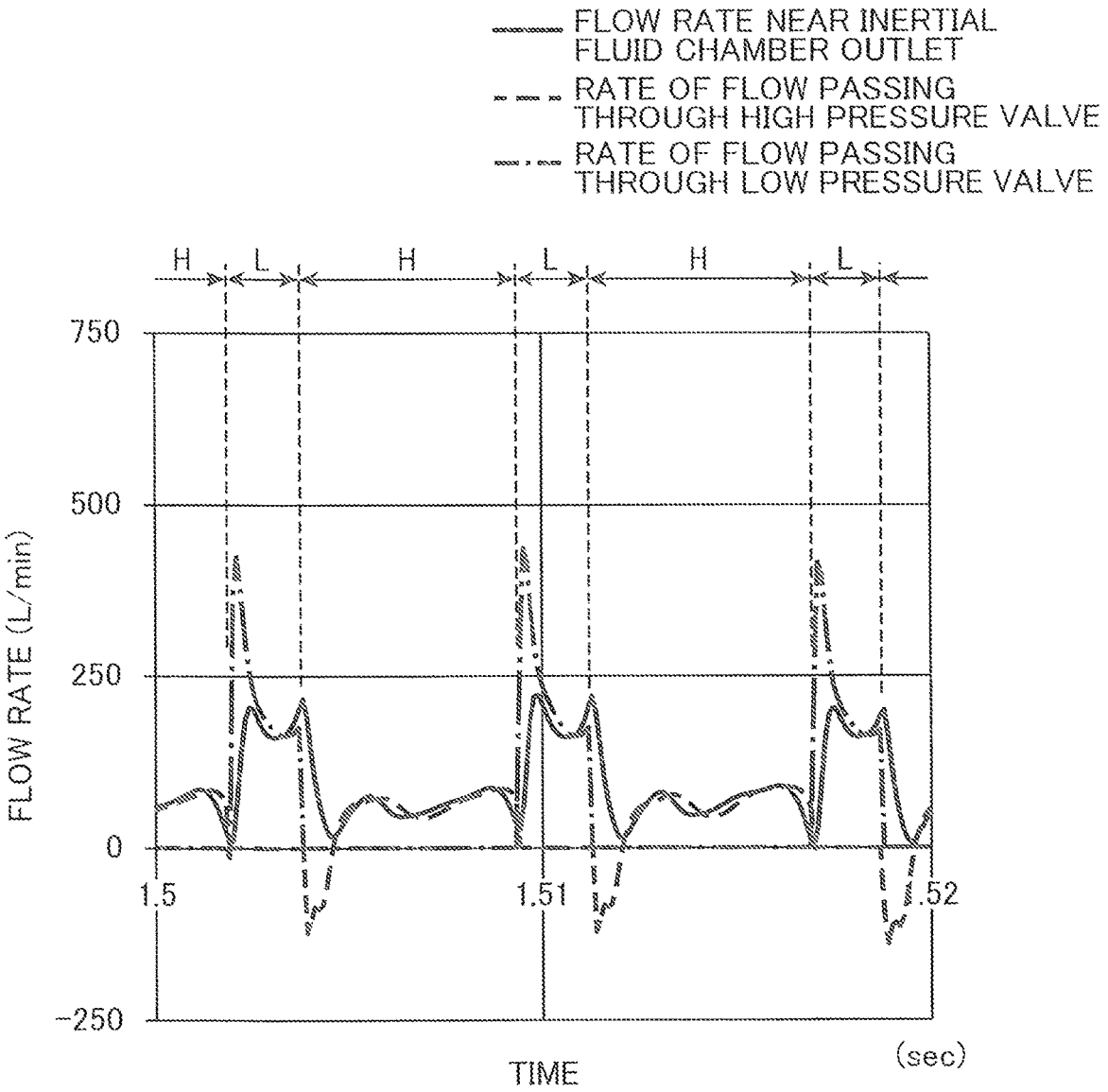
FIG. 13C is a graph showing changes over time in the flow rate of the working fluid near the outlet of the inertial fluid chamber, the flow rate of working fluid passing through the high pressure valve, and the flow rate of working fluid passing through the low pressure valve, the graph corresponding to the valve control shown in FIG. 13A.
Figure 13D:
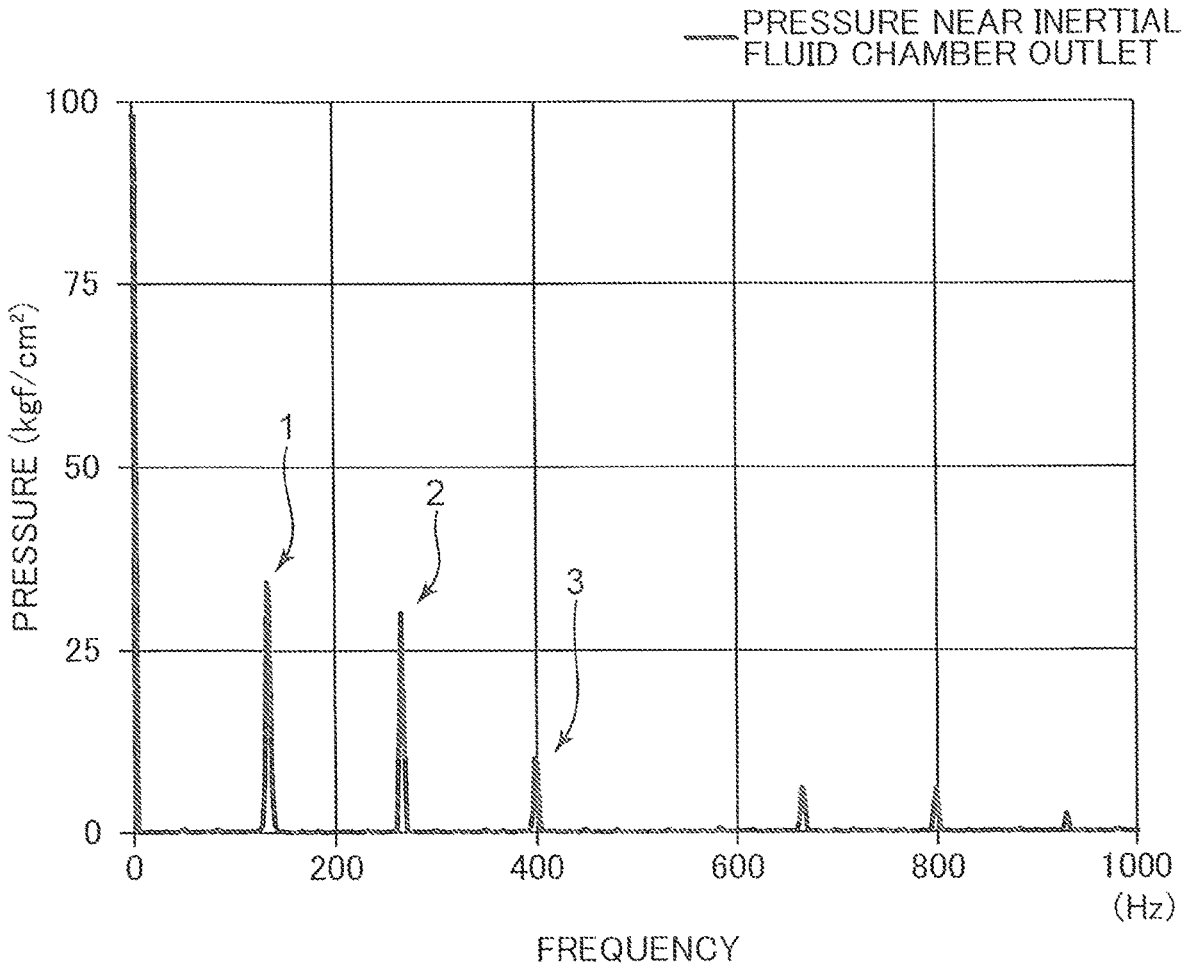
FIG. 13D is a graph showing frequency response of the pressure fluctuations of the working fluid near the outlet of the inertial fluid chamber, the graph corresponding to the valve control shown in FIG. 13A.
Figure 13E:
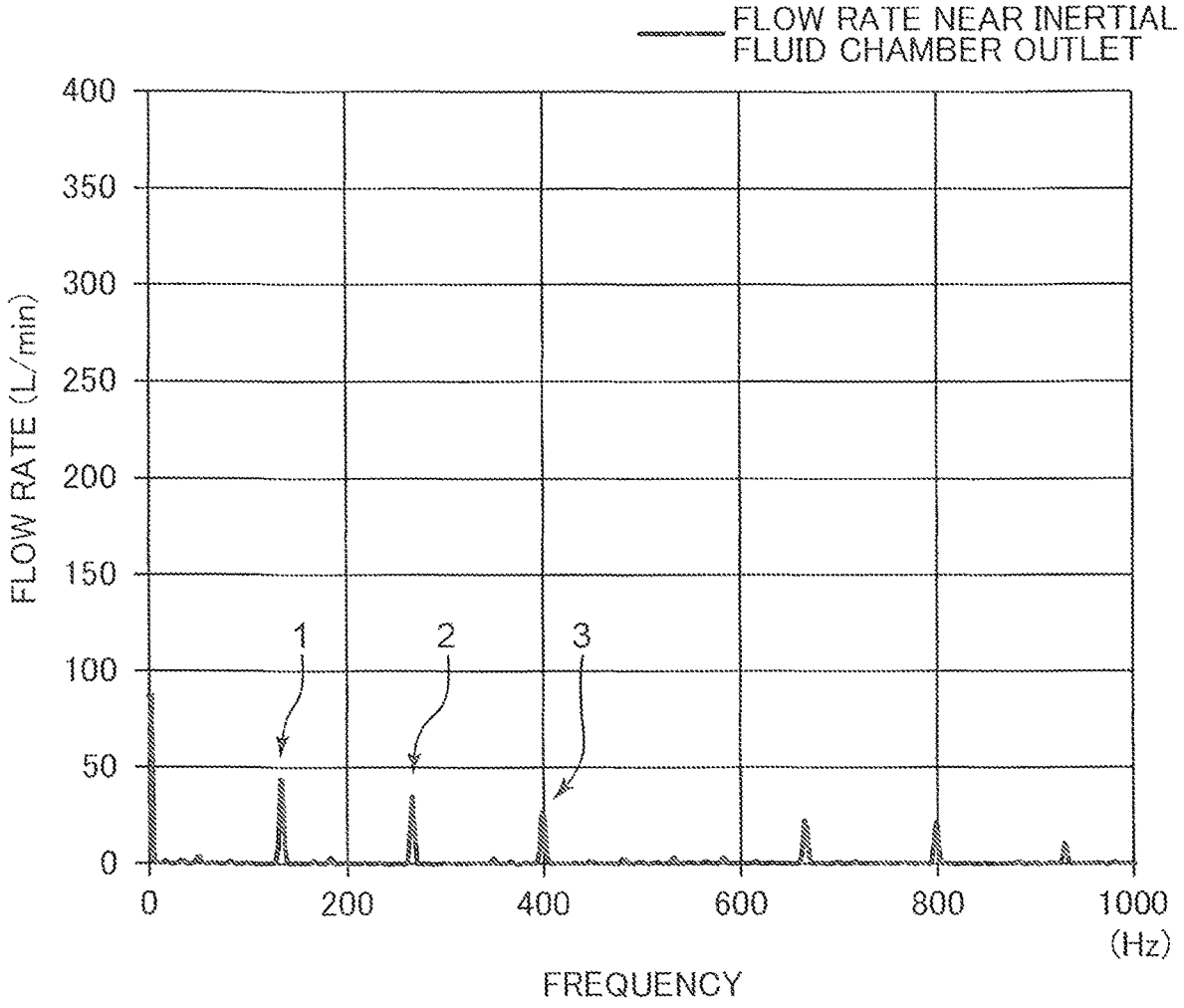
FIG. 13E is a graph showing frequency response of the flow fluctuations of the working fluid near the outlet of the inertial fluid chamber, the graph corresponding to the valve control shown in FIG. 13A.

The inertial fluid chamber 23 has a plurality of fluid sub-chambers (pipe channels) decreasing stepwise in size as shown in the third embodiment. This makes it possible to reduce the hydraulic oil flow fluctuations and thereby improve the energy recovery efficiency. With regard to the inertial fluid chamber 21 according to the above-described first embodiment, FIGS. 8A to 8E show the characteristic values when the switching frequency f for the high pressure valve 3H and the low pressure valve 3L is set to the first anti-resonance frequency (the frequency "1" in FIG. 3, which is 88 Hz) with the duty ratio d of 0.75. In comparison with the periodic backward flows detected in the flow rate near the inertial fluid chamber outlet shown in FIG. 8C (the portions where the flow rate is zero or below), in FIG. 13C, the time periods during which a periodic backward flow is detected in the flow rate near the inertial fluid chamber outlet is short. This makes it possible to reduce the hydraulic oil flow fluctuations and thereby allow efficient recovery of hydraulic oil energy. In addition, in FIGS. 8A to 8E, the frequency (the second harmonic of the fundamental frequency) that is twice the switching frequency f for the high pressure valve 3H and the low pressure valve 3L is close to the first resonance frequency of the system, and therefore the second harmonic component of the fundamental frequency is great in the flow fluctuations (FIG. 8E). In contrast, in the results shown in FIGS. 13A to 13E, the second harmonic component of the fundamental frequency is suppressed in the flow fluctuations (FIG. 13E).

Figure 14A:
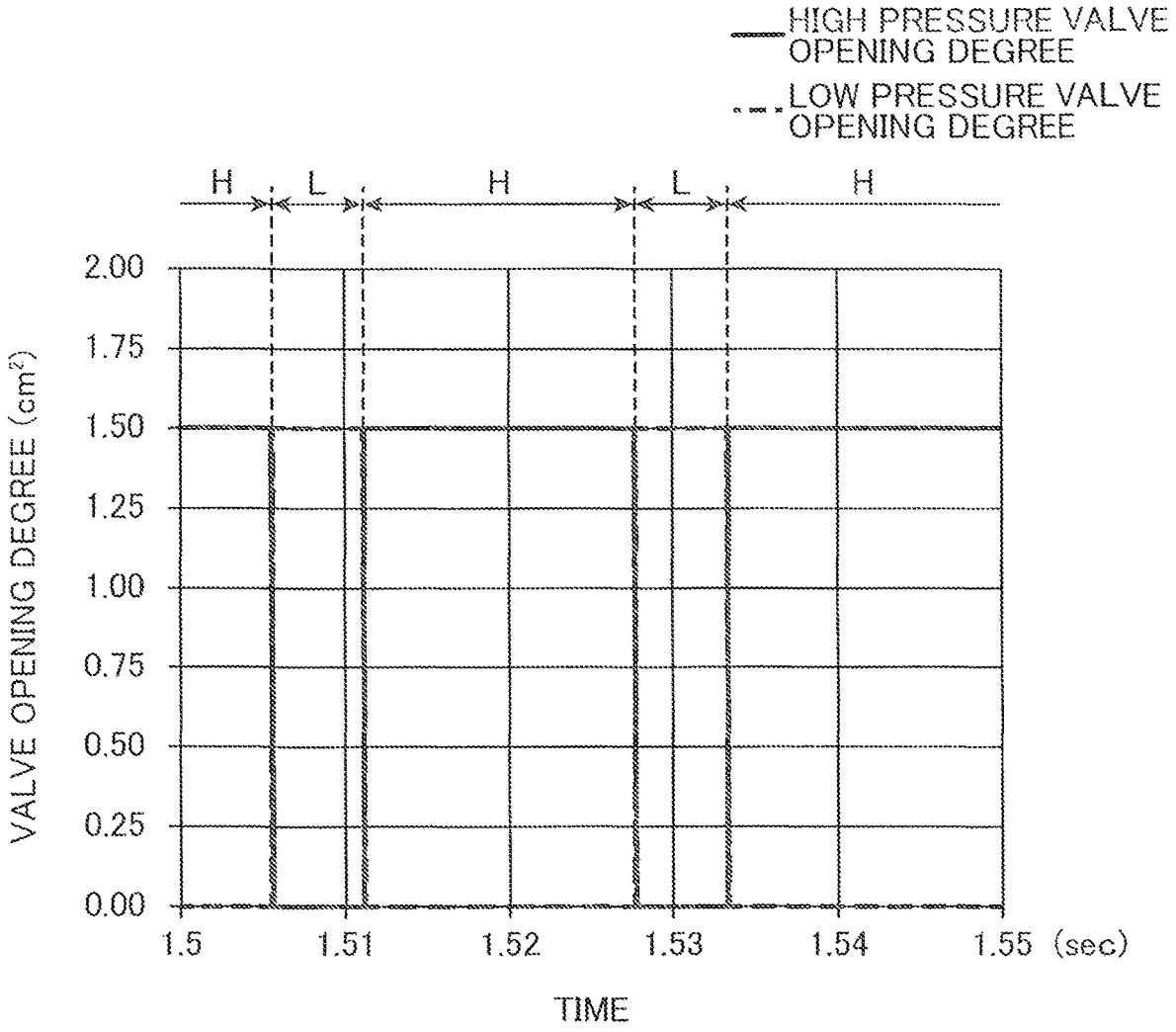
FIG. 14A is a graph showing change over time in the opening degree of the high pressure valve and the low pressure valve.
Figure 14B:
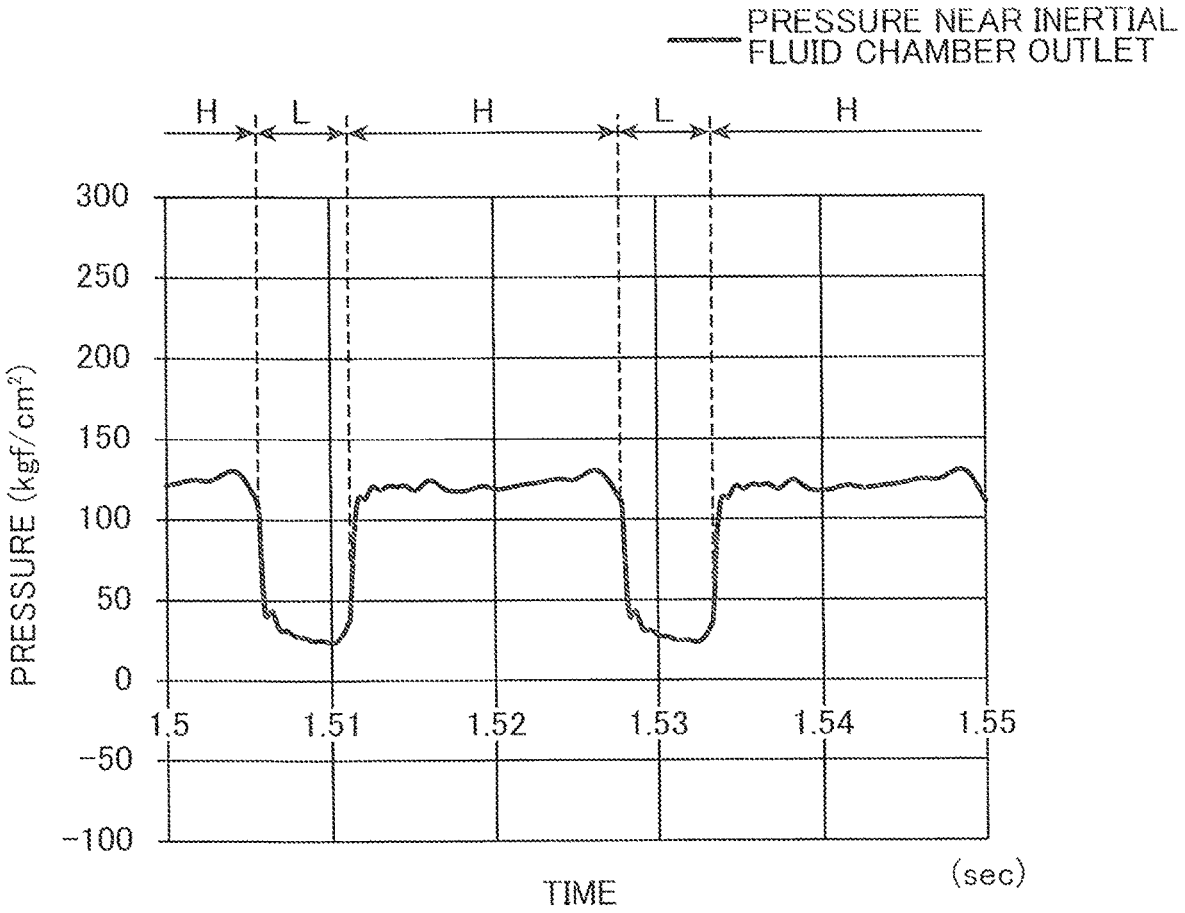
FIG. 14B is a graph showing change over time in the pressure of working fluid near the outlet of the inertial fluid chamber, the graph corresponding to the valve control shown in FIG. 14A.
Figure 14C:
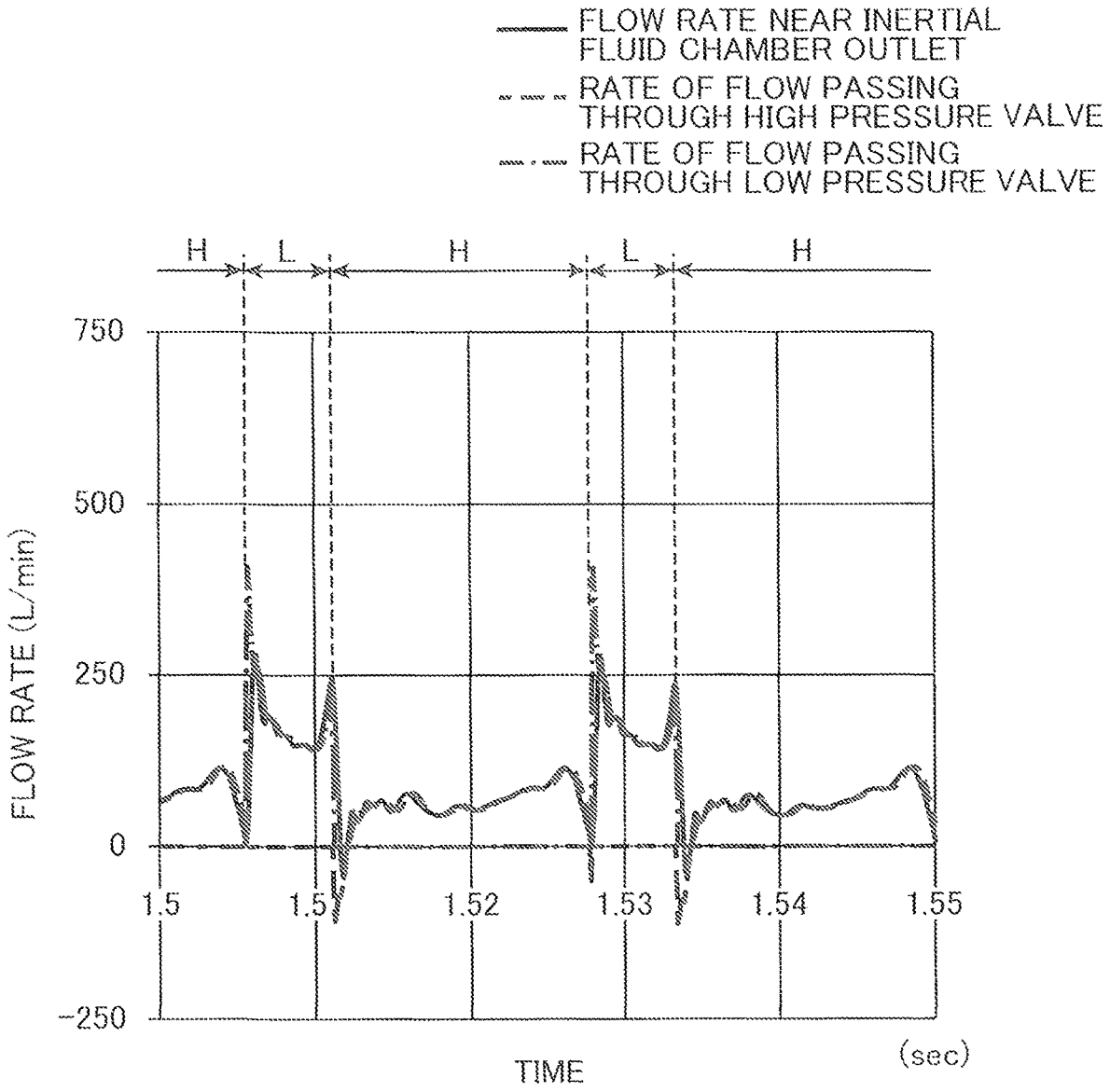
FIG. 14C is a graph showing changes over time in the flow rate of the working fluid near the outlet of the inertial fluid chamber, the flow rate of working fluid passing through the high pressure valve, and the flow rate of working fluid passing through the low pressure valve, the graph corresponding to the valve control shown in FIG. 14A.
Figure 14D:
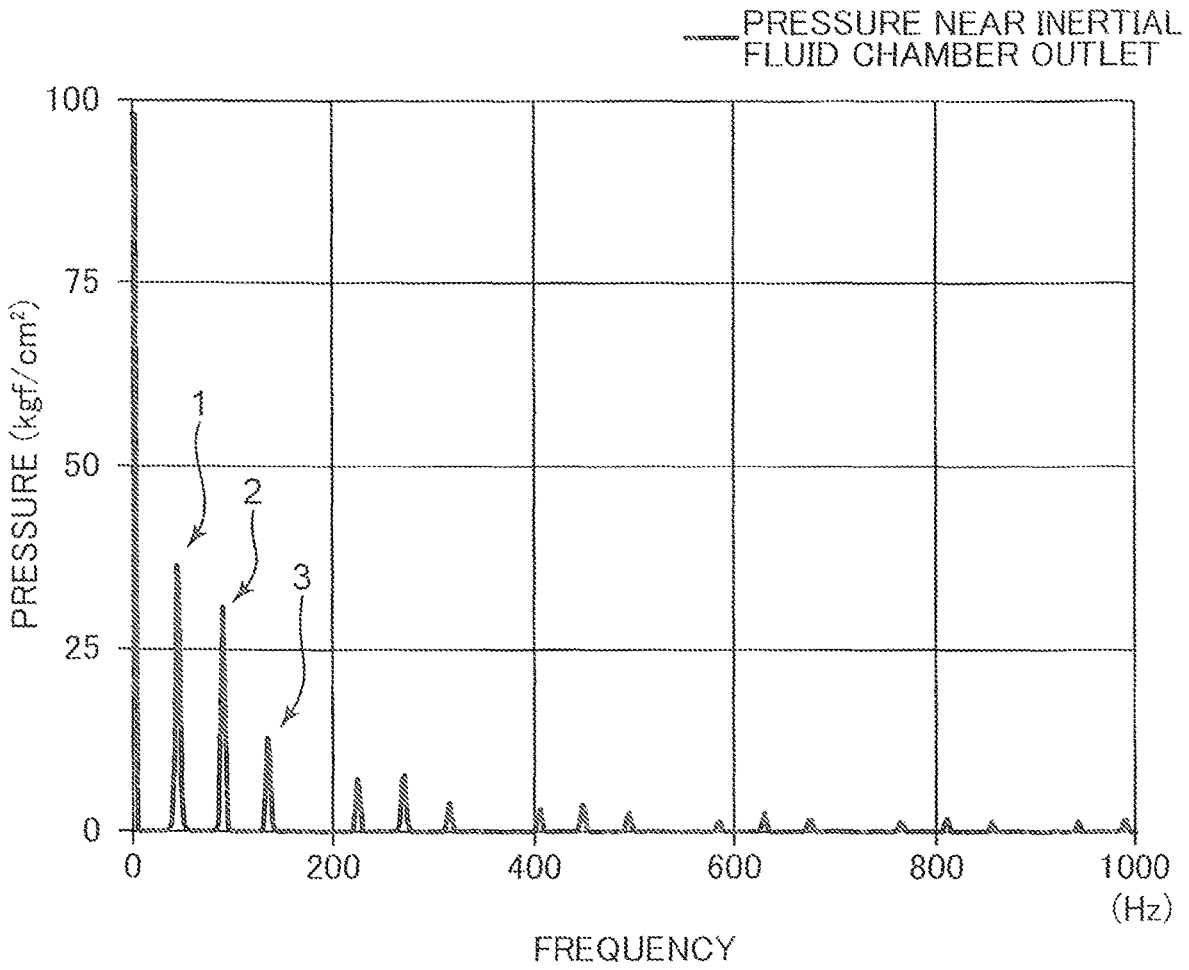
FIG. 14D is a graph showing frequency response of the pressure fluctuations of the working fluid near the outlet of the inertial fluid chamber, the graph corresponding to the valve control shown in FIG. 14A.
Figure 14E:
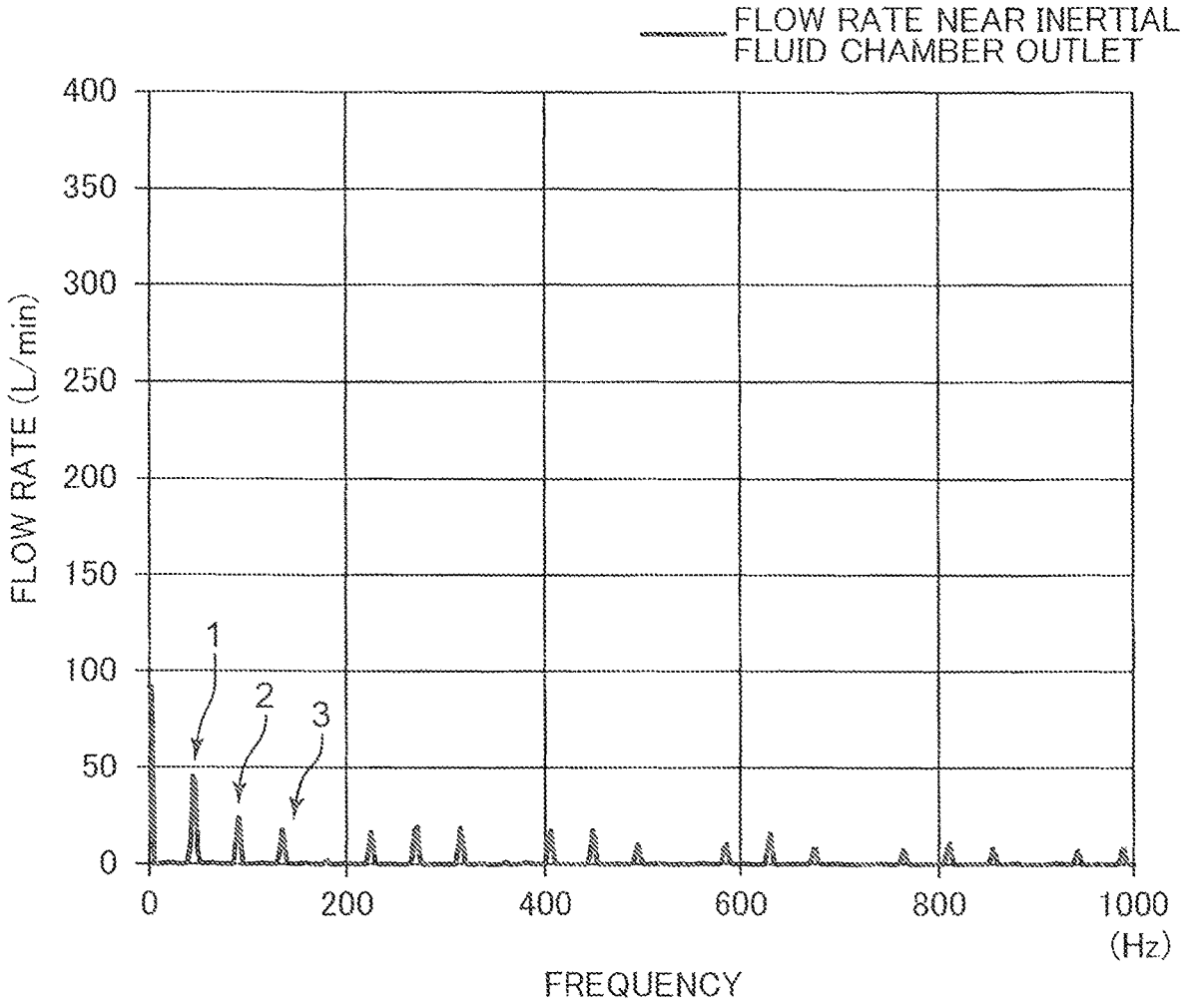
FIG. 14E is a graph showing frequency response of the flow fluctuations of the working fluid near the outlet of the inertial fluid chamber, the graph corresponding to the valve control shown in FIG. 14A.

Similarly, FIGS. 14A to 14E are graphs each showing change in a characteristic value when the switching frequency for the high pressure valve 3H and the low pressure valve 3L is set to the first anti-resonance frequency (the frequency "1" in FIG. 12, which is 45 Hz) in the case where the inertial fluid chamber 23 has a total length of 9 m shown in FIG. 12. FIGS. 14A to 14E also show the case where the duty ratio d is 0.75 as described above. In FIG. 14C, compared to FIG. 8C, the time periods during which a periodic backward flow is detected in the flow rate near the inertial fluid chamber outlet is short. This makes it possible, even when the switching frequency f for the high pressure valve 3H and the low pressure valve 3L is set to a low frequency, to reduce the hydraulic oil flow fluctuations and thereby allow efficient recovery of hydraulic oil energy. In addition, also in the results shown in FIGS. 14A to 14E, the second harmonic component of the fundamental frequency is suppressed in the flow fluctuations (FIG. 14E). Moreover, the results shown in FIGS. 14A to 14E demonstrate that the switching frequency f can be set lower than in the case of FIGS. 13A to 13E. This makes it possible to lower the demand for the opening and closing response performance of the high pressure valve 3H and the low pressure valve 3L. Consequently, it is possible to realize the recovery of hydraulic oil energy at a lower cost.

As described above, the inertial fluid chamber 23 of the third embodiment includes a plurality of fluid sub-chambers extending from the fluid chamber inlet 230A to the fluid chamber outlet 230B. These fluid compartments are connected to each other with the respective cross sections decreasing stepwise. In addition, the ratios of the cross sections are set to the specified values for optimization. This makes it possible to reduce the hydraulic oil flow fluctuations when the switching frequency f is set to the first anti-resonance frequency of the hydraulic oil flow conduit. The inertial fluid chamber 23 formed in this manner makes it possible to change the frequency response curve as shown in FIGS. 3, 11, and 12. Moreover, the inertial fluid chamber 23 with the stepwise decreasing cross sections, compared to the case of having a straight pipe shape (being straight), increases the first anti-resonance frequency and reduces the third anti-resonance frequency of the system. On the other hand, the second anti-resonance frequency does not change significantly. As a result, the optimization of the cross sections of the inertial fluid chamber 23 makes the second and third anti-resonance frequencies close to whole number multiples of (twice and three times) the first anti-resonance frequency.

The inertial fluid chamber 23 does not necessarily have a three stepped configuration. The inertial fluid chamber 23 may be formed to have four, five, or more steps. Also in these cases, it is possible to reduce the hydraulic oil flow fluctuations and thereby improve the energy recovery efficiency by designing the inertial fluid chamber 23 to have stepwise decreasing cross sections with their ratios set as described above. In addition, FIGS. 13A to 13E and FIGS. 14A to 14E described above show the cases where the duty ratio is 0.75; however, similar effects can be obtained with other duty ratios. Further, the inertial fluid chamber 23 of the present invention does not necessarily make the second anti-resonance frequency twice the first anti-resonance frequency and the third anti-resonance frequency three times the first anti-resonance frequency. The inertial fluid chamber 23 may have such a shape as to make the second anti-resonance frequency close to twice the first anti-resonance frequency and the third anti-resonance frequency close to three times the first anti-resonance frequency. Alternatively, the inertial fluid chamber 23 may be configured to make at least the second anti-resonance frequency close to twice the first anti-resonance frequency. In this case, the frequency is close enough if it falls within a range of plus or minus 5% of the target frequency.

<Range of Switching Frequency>

As described above, it is preferable to set the switching frequency f for the low pressure valve 3L and the high pressure valve 3H controlled by the controller 5 to a frequency close to an anti-resonance frequency of the flow conduit (system) through which hydraulic oil (working fluid) flows. In this case, the anti-resonance frequency is not necessarily the first anti-resonance frequency, and may be the second or third (the Nth-order, where N is a natural number) anti-resonance frequency. As shown in FIG. 3, there is a range in which the flow fluctuations increase as the order of the anti-resonance frequency increases. Therefore, the switching frequency f is preferably set to a frequency close to the first anti-resonance frequency.

Here, in FIG. 3, let the first anti-resonance frequency (indicated by the arrow "1") be frn (Hz), the first resonance frequency (indicated by the arrow "2") be frt (Hz), and let hydraulic oil flow fluctuations at these frequencies be Vfrn (L/min/(kgf/cm$^2$)) and Vfrt (L/min/(kgf/cm$^2$)), respectively. Then the switching frequency f to be set preferably satisfies the following formula 4.

$$f \leq (frn+frt)/2 \quad \text{(Formula 4)}$$

In this case, the switching frequency f is set to a position at least closer to the first anti-resonance frequency frn than to the first resonance frequency frt. This makes it possible to prevent increase in the flow fluctuations and hence the hydraulic oil backward flow. As a result, it is possible to reliably suppress the hydraulic oil flow fluctuations associated with the resonance of the hydraulic oil flow conduit including the inertial fluid chamber 21 (the inertial fluid chamber 22) and the valve flow conduit.

Further, the switching frequency f to be set preferably satisfies the following formula 5.

$$f \geq frn/2 \quad \text{(Formula 5)}$$

In other words, the switching frequency f is preferably at least higher than half the first anti-resonance frequency frn. In this case, the switching frequency is not too close to zero, which prevents increase in the flow fluctuations (FIG. 3). Therefore, it is possible to further reliably suppress the hydraulic oil flow fluctuations associated with the resonance of the hydraulic oil flow conduit.

Further, let flow fluctuations at the switching frequency f be Vf. Then, Vf preferably satisfies the following formula 6.

$$Vf \leq (Vfrn+Vfrt)/2 \quad \text{(Formula 6)}$$

In this case, the flow fluctuations Vf at the switching frequency f are set to have a waveform at least closer to that of the flow fluctuations Vfrn at the first anti-resonance frequency frn than to that of the flow fluctuations Vfrt at the first resonance frequency frt. This prevents increase in the flow fluctuations and hence the hydraulic oil backward flow. As a result, it is possible to further reliably suppress the hydraulic oil flow fluctuations associated with the resonance of the hydraulic oil flow conduit. Also in this case, it is further preferable to satisfy the above formula 5.

Further, more preferable ranges of the switching frequency f will be described. FIGS. 15A to 15G are graphs corresponding to FIG. 4C, and each showing change over time in the flow rate of hydraulic oil near the fluid chamber outlet 210 of the inertial fluid chamber 21 in the energy recovery system 1 shown in FIG. 1. The switching frequency f is set to 72.5 Hz in FIG. 15A, the switching frequency f is set to 80 Hz in FIG. 15B, the switching frequency f is set to 88 Hz in FIG. 15C, the switching frequency f is set to 100 Hz in FIG. 15D, the switching frequency f is set to 105 Hz in FIG. 15E, the switching frequency f is set to 110 Hz in FIG. 15F, and the switching frequency f is set to 125 Hz in FIG. 15G. In each case, the duty ratio d is set to 0.5 as described above.

Figure 15A:
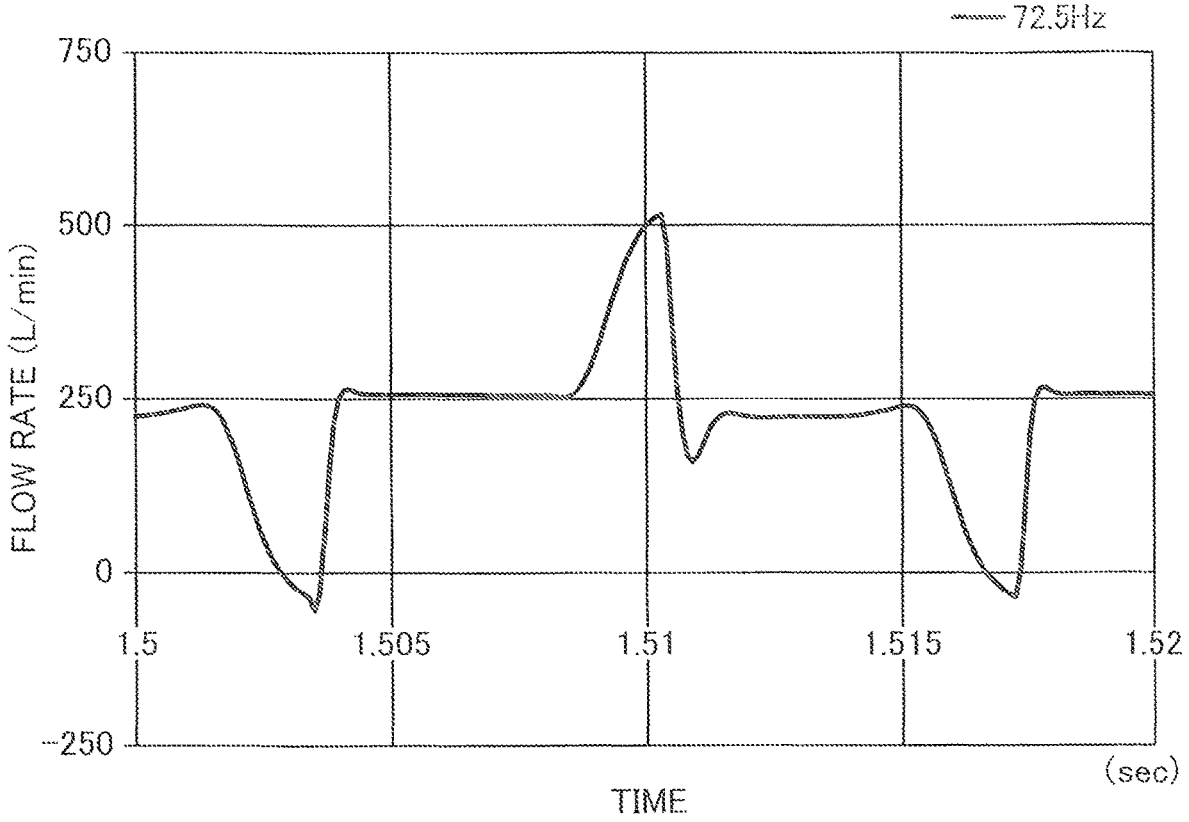
FIG. 15A is a graph showing change over time in the flow rate of working fluid near the outlet of the inertial fluid chamber in the energy recovery system shown in FIG. 1.
Figure 15B:
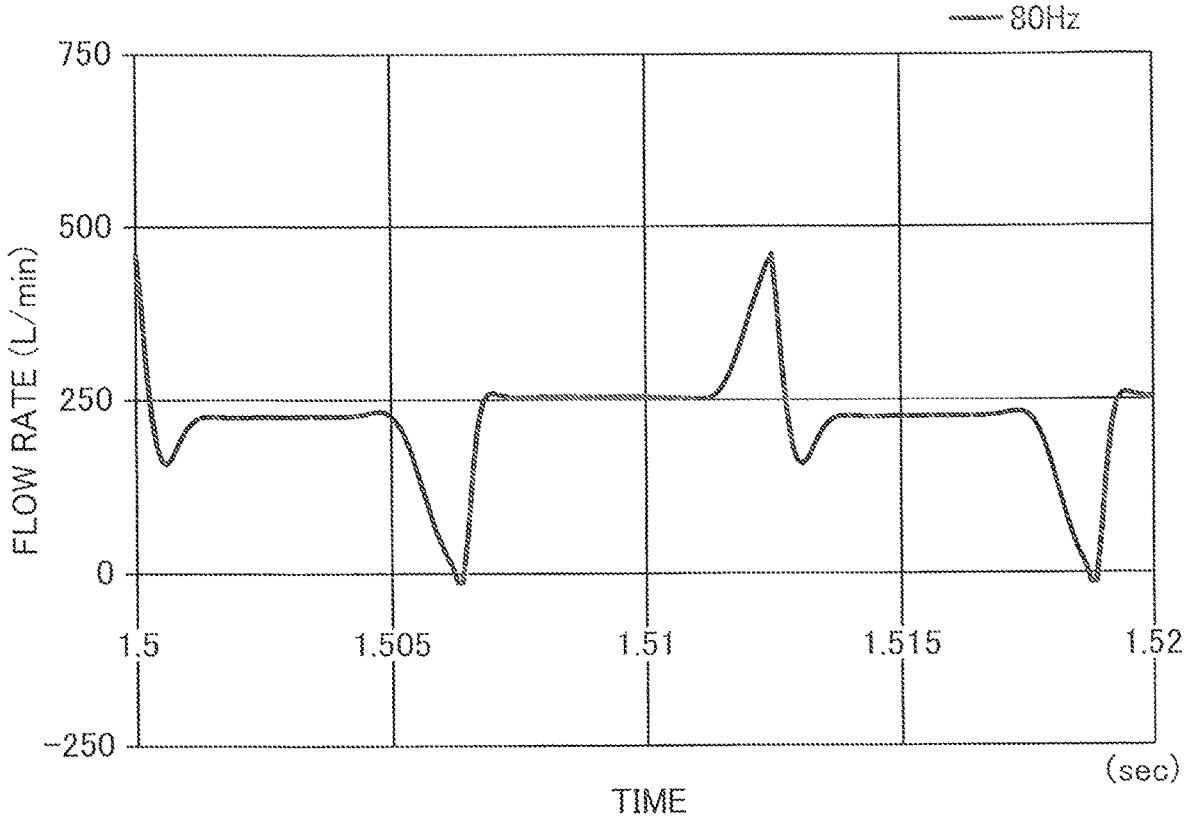
FIG. 15B is a graph showing change over time in the flow rate of working fluid near the outlet of the inertial fluid chamber in the energy recovery system shown in FIG. 1.
Figure 15C:
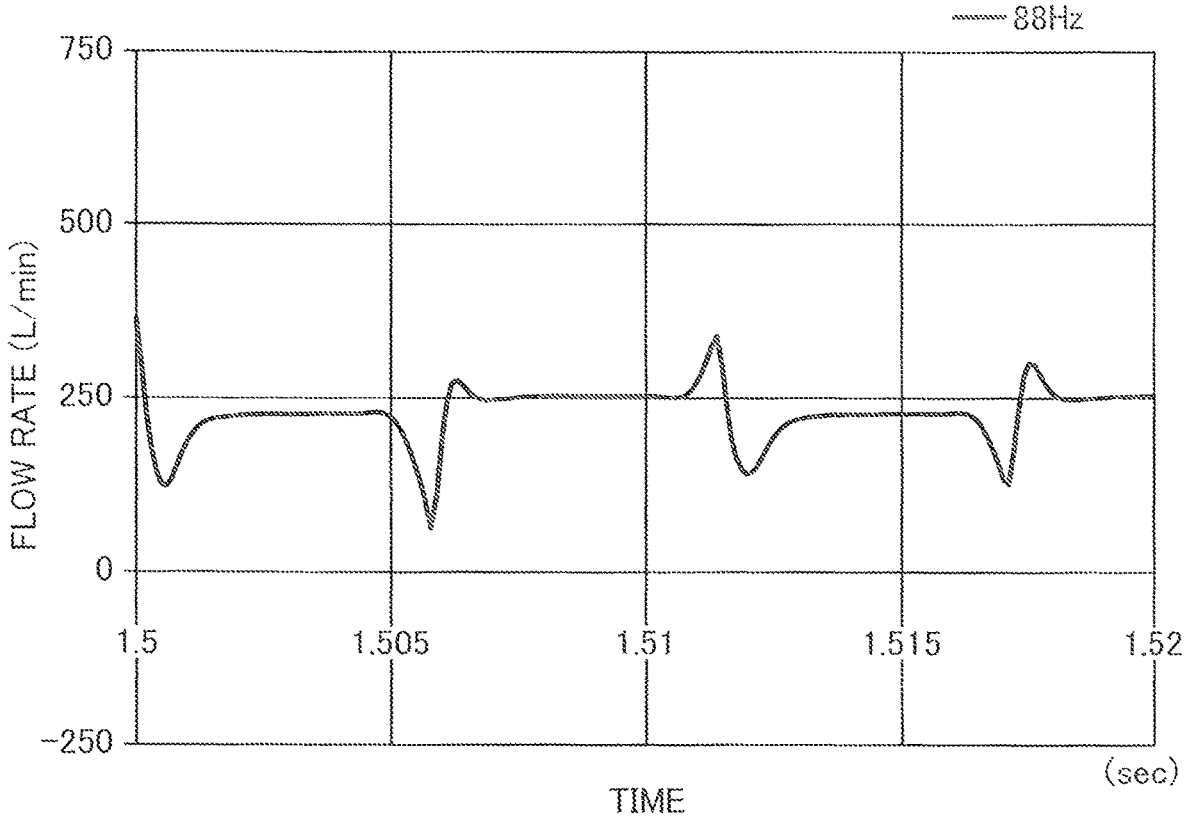
FIG. 15C is a graph showing change over time in the flow rate of working fluid near the outlet of the inertial fluid chamber in the energy recovery system shown in FIG. 1.
Figure 15D:
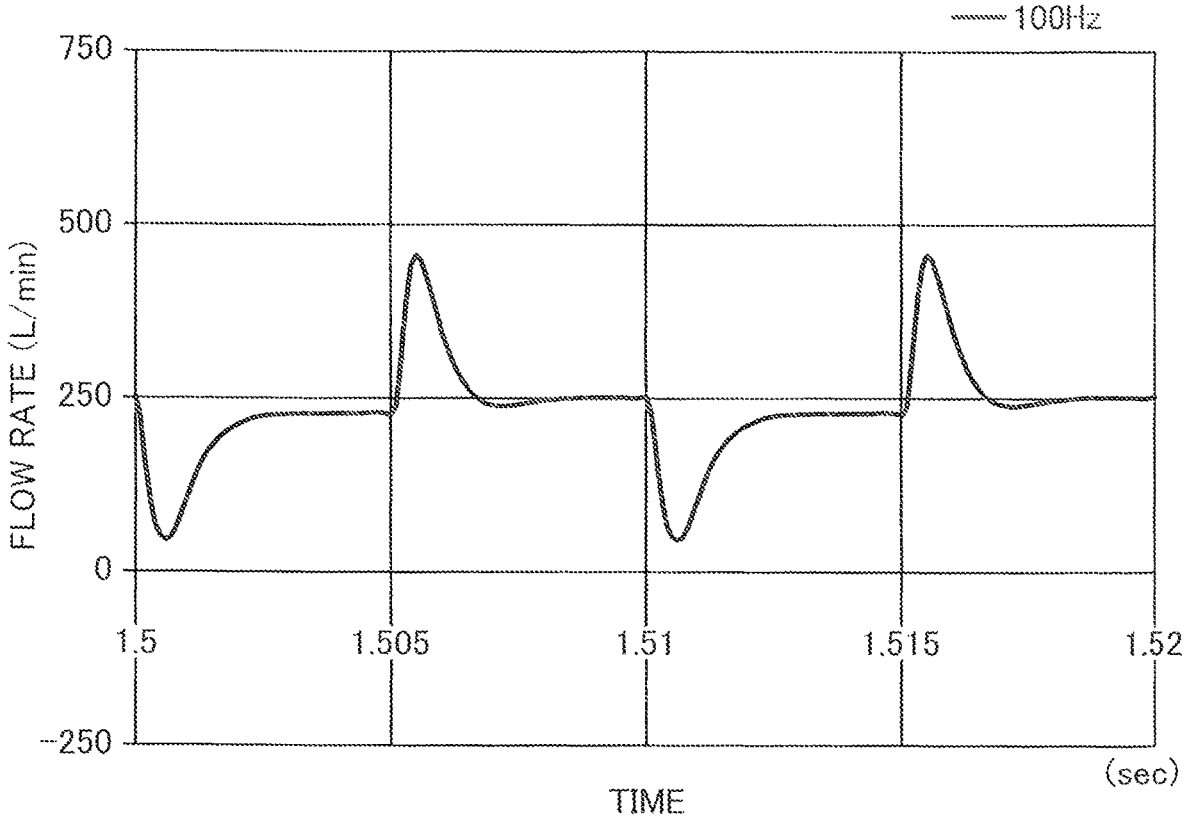
FIG. 15D is a graph showing change over time in the flow rate of working fluid near the outlet of the inertial fluid chamber in the energy recovery system shown in FIG. 1.
Figure 15E:
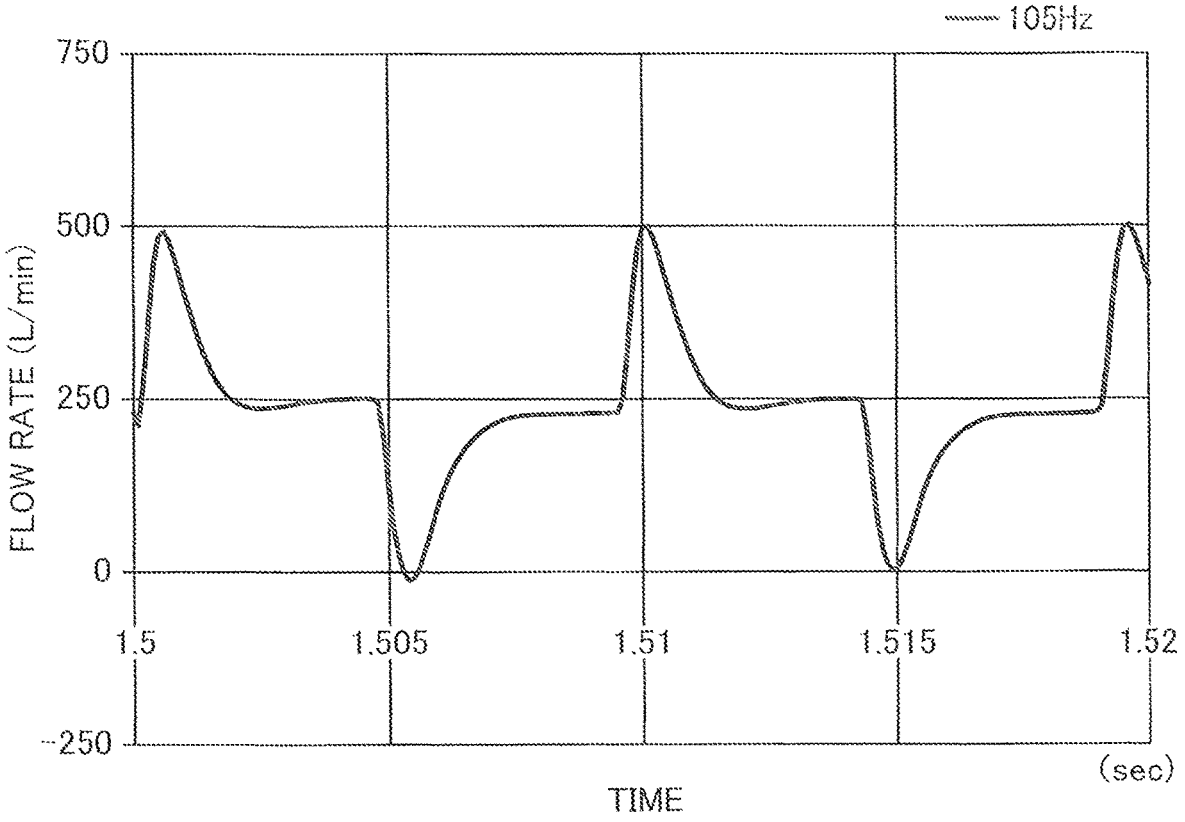
FIG. 15E is a graph showing change over time in the flow rate of working fluid near the outlet of the inertial fluid chamber in the energy recovery system shown in FIG. 1.
Figure 15F:
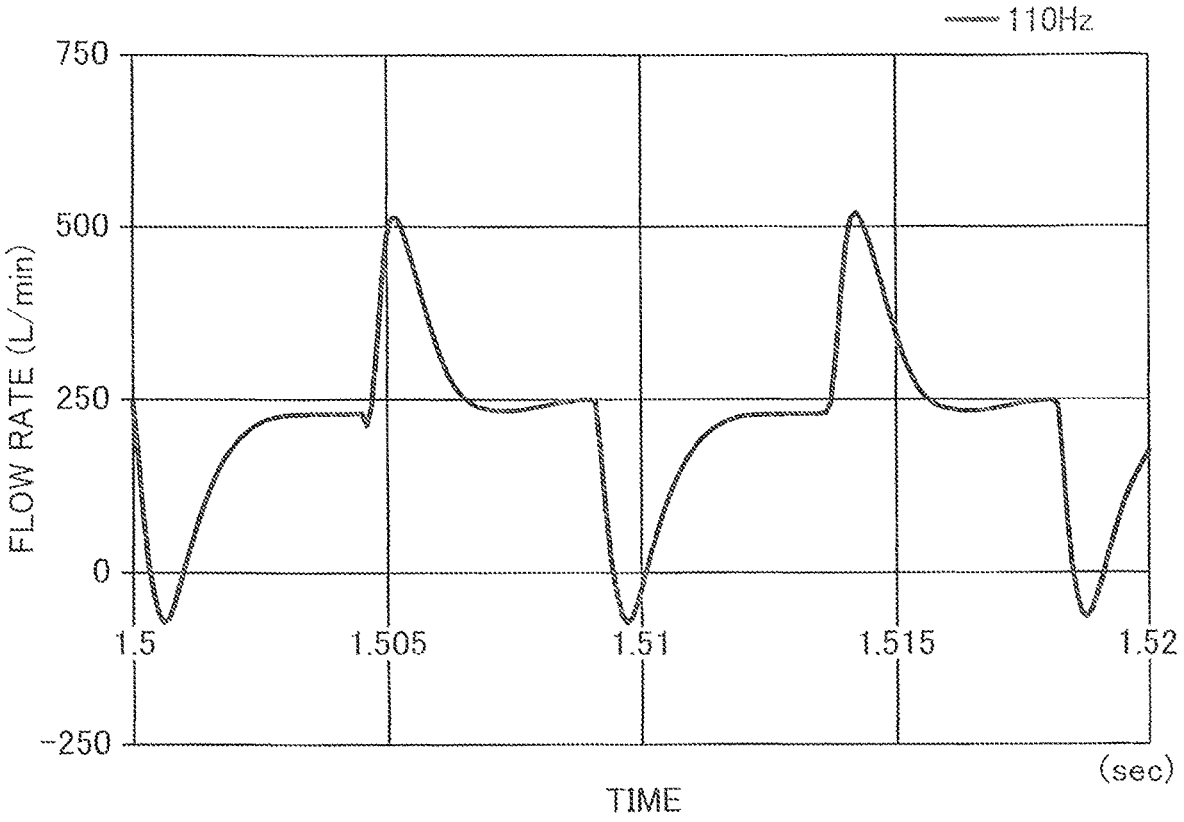
FIG. 15F is a graph showing change over time in the flow rate of working fluid near the outlet of the inertial fluid chamber in the energy recovery system shown in FIG. 1.
Figure 15G:
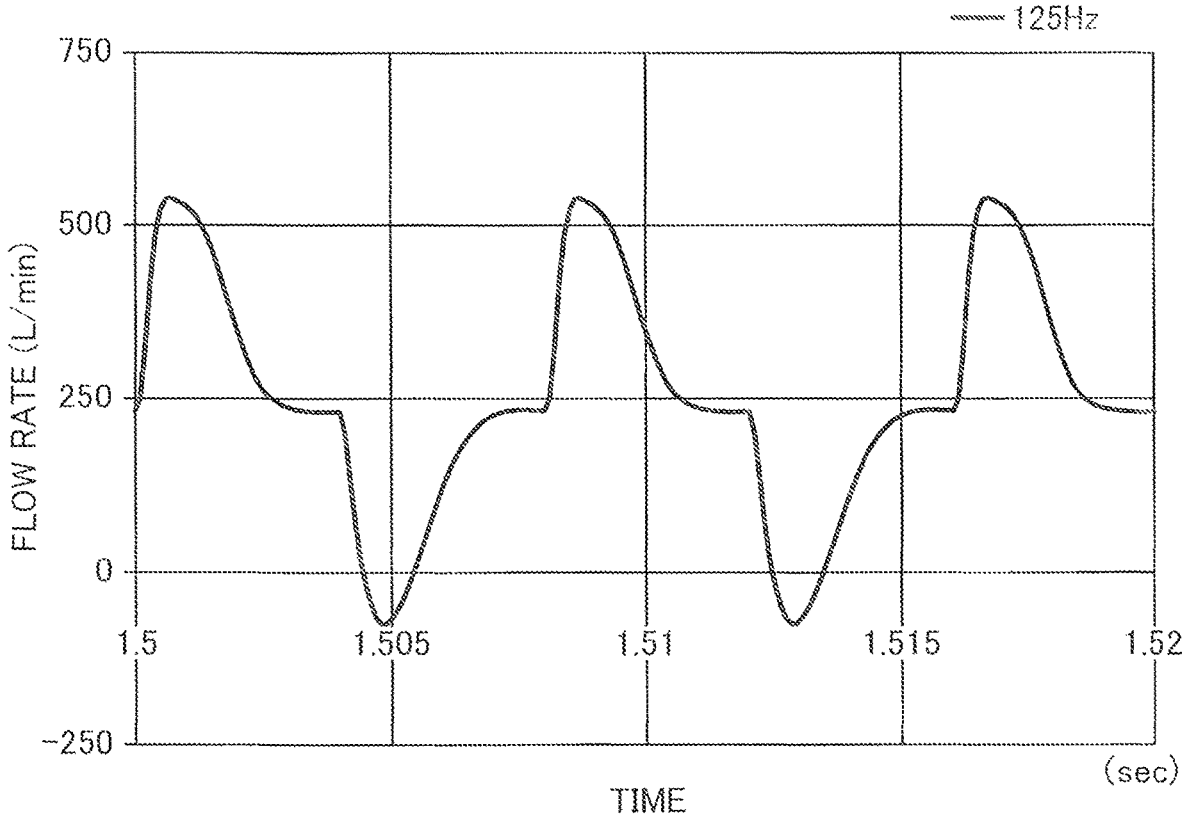
FIG. 15G is a graph showing change over time in the flow rate of working fluid near the outlet of the inertial fluid chamber in the energy recovery system shown in FIG. 1.

In FIG. 15A, the flow rate of the hydraulic oil near the fluid chamber outlet 210 of the inertial fluid chamber 21 is periodically negative, indicating occurrence of backward flow. In FIG. 15B, the hydraulic oil flow rate is negative for an instant; however, no backward flow occurred actually. In FIGS. 15C and 15D, the flow rate of the hydraulic oil near the fluid chamber outlet 210 of the inertial fluid chamber 21 is continuously positive, indicating reliable recovery of hydraulic oil in the high pressure source HP. In FIG. 15E, similarly to FIG. 15B, the hydraulic oil flow rate is negative for an instant; however, no backward flow occurred actually. In FIGS. 15F and 15G, similarly to FIG. 15A, the flow rate of the hydraulic oil near the fluid chamber outlet 210 of the inertial fluid chamber 21 is periodically negative, indicating occurrence of backward flow.

Figure 16:
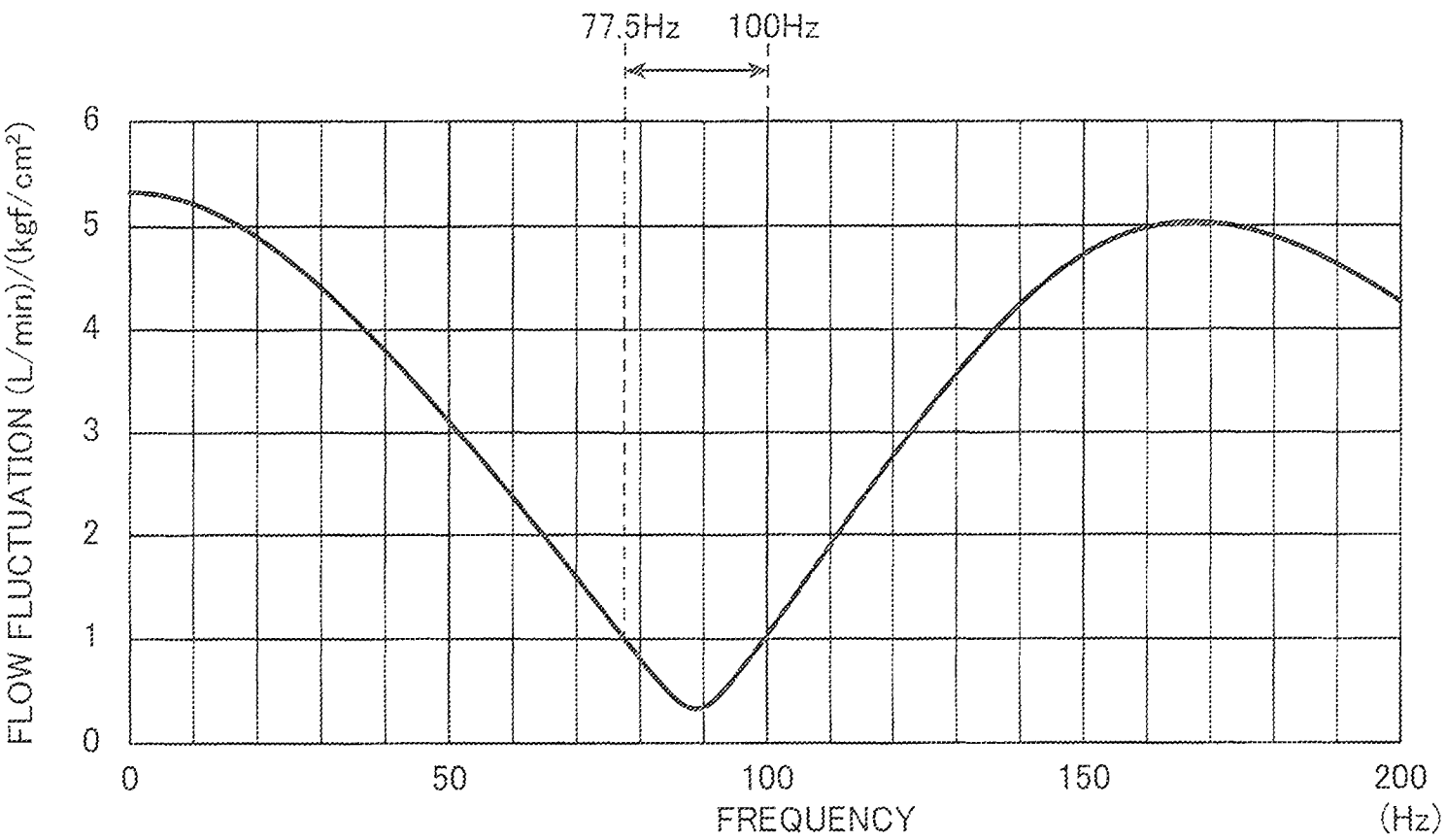
FIG. 16 is a graph showing an enlarged view of the vicinity of a (first) anti-resonance frequency and a (first) resonance frequency shown in FIG. 3.

FIG. 16 is a graph showing an enlarged view of the vicinity of the (first) anti-resonance frequency and the (first) resonance frequency shown in FIG. 3. The results of FIGS. 15A to 15G demonstrate that reliable energy recovery can be achieved without the occurrence of hydraulic oil backward flow when the switching frequency f is set within the range of 77.5 Hz to 100 Hz (as shown in the following formula 7). Specifically, when the (first) anti-resonance frequency of the flow conduit of the energy recovery system 1 is 88 Hz, it is preferable to satisfy the following relationship.

$$77.5 \leq f \leq 100 \text{ (Hz)} \quad \text{(Formula 7)}$$

The inventors of the present invention have performed similar examinations by changing the lengths of the inertial fluid chamber 21, the low-pressure-side branch channel 31, and the high-pressure-side branch channel 32 according to several standards, and confirmed that energy recovery with suppressed backward flow can be similarly achieved when the following formula 8 is satisfied.

Let the anti-resonance frequency of the system be frn.

$$0.88 \times frn \leq f \leq 1.13 \times frn \quad \text{(Formula 8)}$$

<Energy Recovery Method>

As described above, an energy recovery method according to the present invention is an energy recovery method for recovering energy from a working fluid, the method preparing a fluid chamber having a variable volume and the working fluid sealed therein, an inertial fluid container communicating with the fluid chamber, low pressure and high pressure containers disposed on the opposite side of the inertial fluid container from the fluid chamber and communicating with the inertial fluid container in parallel, a low pressure valve for permitting and prohibiting flow of the working fluid between the inertial fluid container and the low pressure container, a high pressure valve for permitting and prohibiting flow of the working fluid between the high pressure container and the inertial fluid container, and a valve flow conduit, extending from the inertial fluid container to the low pressure valve and the high pressure valve, for guiding the working fluid. The method subsequently controls in response to a decrease in volume of the fluid chamber, the high pressure valve and the low pressure valve such that the inertial fluid container alternately communicates with the low pressure container and the high pressure container, with a switching frequency close to an Nth-order (where N is a natural number) anti-resonance frequency of a flow conduit for the working fluid including at least the inertial fluid container and the valve flow conduit, thereby generating inertial forces of the working fluid flowing toward the low pressure container in the inertial fluid container, and causing the working fluid to flow into the high pressure container by the inertial forces.

According to this method, it is possible to cause the working fluid to flow into the high pressure container by the inertial forces generated when the working fluid flows from the inertial fluid container toward the low pressure container in the inertial fluid container. Further, since the switching frequency for controlling the opening and closing operations of the high pressure valve and the low pressure valve is set to the frequency close to the Nth-order anti-resonance frequency of the hydraulic fluid flow conduit, it is possible to suppress flow fluctuations of the working fluid associated with the resonance of the working fluid flow conduit including the inertial fluid container and the valve flow conduit. This makes it possible to prevent reduction in the energy recovery efficiency due to the flow fluctuations of the working fluid in the flow conduit.

The energy recovery system 1 and the energy recovery method according to each embodiment of the present invention have been described. The present invention is not limited to the embodiments described above. Various modifications as described below can be made in the energy recovery system and the energy recovery method according to the present invention.

(1) In the above-described embodiments, the inertial fluid chamber 21, the inertial fluid chamber 22, and the inertial fluid chamber 23 have a circular cross section; however, the present invention is not limited to such configuration. The inertial fluid chamber 21, the inertial fluid chamber 22, and the inertial fluid chamber 23 may have a cross section in a shape other than a circle.

(2) In the second embodiment described above, the inertial fluid chamber 22 includes the middle fluid compartment 223 to thereby make the frequency that is twice the first anti-resonance frequency of the hydraulic oil flow conduit away from the first resonance frequency of the hydraulic oil flow conduit; however, the present invention is not limited to such configuration. The inertial fluid chamber 22 may partially have a curved pipe serving as a curved flow conduit to thereby make a frequency that is twice the first anti-resonance frequency of the hydraulic oil flow conduit away from the first resonance frequency of the hydraulic oil flow conduit, or may have other shapes and configurations.

The present invention provides an energy recovery system for recovering energy from a working fluid. The energy recovery system comprises: a fluid chamber having a variable volume and the working fluid sealed therein; an inertial fluid container, including a first internal space communicating with the fluid chamber, for receiving the working fluid discharged from the fluid chamber as the volume of the fluid chamber decreases; a low pressure container, including a second internal space set at a lower pressure than the fluid chamber and communicating with the first internal space of the inertial fluid container, for receiving the working fluid discharged from the inertial fluid container; a high pressure container, including a third internal space set at a higher pressure than the second internal space of the low pressure container and communicating with the first internal space of the inertial fluid container, for receiving the working fluid discharged from the inertial fluid container; a low pressure valve having a low pressure opening for permitting flow of the working fluid between the inertial fluid container and the low pressure container, and operable to open and close the low pressure opening; a high pressure valve having a high pressure opening for permitting flow of the working fluid between the high pressure container and the inertial fluid container, and operable to open and close the high pressure opening; a valve flow conduit, extending from the inertial fluid container to the low pressure valve and the high pressure valve, for guiding the working fluid; and a valve controller for controlling, in response to a decrease in volume of the fluid chamber, the opening and closing operations of the high pressure valve and the low pressure valve such that the inertial fluid container alternately communicates with the low pressure container and the high pressure container, thereby generating inertial forces of the working fluid flowing toward the low pressure container in the first internal space of the inertial fluid container, and causing the working fluid to flow into the high pressure container by the inertial forces. The valve controller sets a switching frequency for switching the inertial fluid container between communicating with the low pressure container and communicating with the high pressure container to a frequency close to an Nth-order (where N is a natural number) anti-resonance frequency of a flow conduit for the working fluid including at least the inertial fluid container and the valve flow conduit.

According to this configuration, the valve controller controls, in response to a reduction in volume of the fluid chamber, the opening and closing operations of the high pressure valve and the low pressure valve such that the inertial fluid container alternately communicates with the low pressure container and the high pressure container. This makes it possible to cause the working fluid to flow into the high pressure container by the inertial forces generated when the working fluid flows from the inertial fluid container toward the low pressure container in the first internal space of the inertial fluid container. Further, the switching frequency for controlling the opening and closing operations of the high pressure valve and the low pressure valve is set to the frequency close to the Nth-order anti-resonance frequency of the working fluid flow conduit. This makes it possible to suppress flow fluctuations of the working fluid associated with the resonance of the working fluid conduit including the inertial fluid container and the valve flow conduit. Consequently, it is possible to prevent reduction in the energy recovery efficiency due to the flow fluctuations of the working fluid in the flow conduit.

In the above-described configuration, it is preferable that the valve controller sets the switching frequency to a frequency close to a first anti-resonance frequency of the working fluid flow conduit.

According to this configuration, it is possible to further suppress the flow fluctuations of the working fluid associated with the resonance of the working fluid flow conduit including the inertial fluid container and the valve flow conduit.

In the above-described configuration, it is preferable that the frequency close to the first anti-resonance frequency is closer to the first anti-resonance frequency than to a first resonance frequency of the working fluid flow conduit.

According to this configuration, it is possible to reliably suppress the flow fluctuations of the working fluid associated with the resonance of the working fluid flow conduit including the inertial fluid container and the valve flow conduit.

In the above-described configuration, it is preferable that the frequency close to the first anti-resonance frequency is at least higher than half the first anti-resonance frequency.

According to this configuration, it is possible to further reliably suppress the flow fluctuations of the working fluid associated with the resonance of the working fluid flow conduit including the inertial fluid container and the valve flow conduit.

In the above-described configuration, it is preferable that the frequency close to the first anti-resonance frequency causes flow fluctuations of the working fluid having a waveform closer to a waveform of flow fluctuations of the working fluid occurring in the working fluid conduit at the first anti-resonance frequency than to a waveform of flow fluctuations of the working fluid occurring in the working fluid conduit at a first resonance frequency of the working fluid flow conduit.

According to this configuration, it is possible to reliably suppress the flow fluctuations of the working fluid associated with the resonance of the working fluid flow conduit including the inertial fluid container and the valve flow conduit.

In the above-described configuration, it is preferable that the inertial fluid container has such a shape as to make a frequency that is twice a first anti-resonance frequency of the working fluid flow conduit away from a first resonance frequency of the working fluid flow conduit.

According to this configuration, it is possible suppress the flow fluctuations of the working fluid associated with the resonance of the working fluid conduit including the inertial fluid container and the valve flow conduit even when the frequency that is twice the first anti-resonance frequency of the working fluid flow conduit is excited.

In the above-described configuration, it is preferable that the inertial fluid container is in the form of a cylinder extending in a flow direction of the working fluid, and includes a first pipe channel communicating with the fluid chamber, a second pipe channel communicating with the first pipe channel and having a greater inner diameter than the first pipe channel, and a third pipe channel communicating with the second pipe channel and the valve flow conduit and having a smaller inner diameter than the second pipe channel.

According to this configuration, it is possible to reliably suppress the flow fluctuations of the working fluid associated with the resonance of the working fluid conduit including the inertial fluid container and the valve flow conduit even when the frequency that is twice the first anti-resonance frequency of the working fluid flow conduit is excited.

In the above-described configuration, it is preferable that the inertial fluid container is in the form of a cylinder linearly extending in a flow direction of the working fluid, and the valve controller sets a duty ratio for switching the inertial fluid container between communicating with the low pressure container and communicating with the high pressure container to a value close to 0.5.

According to this configuration, it is possible to suppress the flow fluctuations of the working fluid associated with the resonance of the working fluid flow conduit including the inertial fluid container and the valve flow conduit.

In the above-described configuration, it is preferable that the valve controller sets the duty ratio within the range of 0.45 to 0.55.

According to this configuration, it is possible to reliably suppress the flow fluctuations of the working fluid associated with the resonance of the working fluid flow conduit including the inertial fluid container and the valve flow conduit.

In the above-described configuration, the inertial fluid container may have such a shape as to make a second anti-resonance frequency of the working fluid flow conduit close to a frequency that is twice the first anti-resonance frequency of the working fluid flow conduit.

According to this configuration, it is possible to reliably suppress the flow fluctuations of the working fluid associated with the resonance of the working fluid flow conduit including the inertial fluid container and the valve flow conduit.

In the above-described configuration, the inertial fluid container may have such a shape as to make a third anti-resonance frequency of the working fluid flow conduit close to a frequency that is three times the first anti-resonance frequency of the working fluid flow conduit.

According to this configuration, it is possible to further reliably suppress the flow fluctuations of the working fluid associated with the resonance of the working fluid flow conduit including the inertial fluid container and the valve flow conduit.

In the above-described configuration, the inertial fluid container may be in the form of a cylinder extending in a flow direction of the working fluid, and include a container inlet communicating with the fluid chamber, a container outlet communicating with the valve flow conduit, and a plurality of pipe channels sequentially arranged from the container inlet to the container outlet with respective cross sections orthogonal to the working fluid flow direction decreasing stepwise in the working fluid flow direction.

According to this configuration, it is possible to reliably suppress the flow fluctuations of the working fluid associated with the resonance of the working fluid flow conduit including the inertial fluid container and the valve flow conduit.

The invention claimed is:

1. An energy recovery system for recovering energy from a working fluid, comprising:

a fluid chamber having a variable volume and the working fluid sealed therein;

an inertial fluid container, including a first internal space communicating with the fluid chamber, for receiving the working fluid discharged from the fluid chamber as the volume of the fluid chamber decreases;

a low pressure container, including a second internal space set at a lower pressure than the fluid chamber and communicating with the first internal space of the inertial fluid container, for receiving the working fluid discharged from the inertial fluid container;

a high pressure container, including a third internal space set at a higher pressure than the second internal space of the low pressure container and communicating with the first internal space of the inertial fluid container, for receiving the working fluid discharged from the inertial fluid container;

a low pressure valve having a low pressure opening for permitting flow of the working fluid between the inertial fluid container and the low pressure container, and operable to open and close the low pressure opening;

a high pressure valve having a high pressure opening for permitting flow of the working fluid between the high pressure container and the inertial fluid container, and operable to open and close the high pressure opening;

a valve flow conduit, extending from the inertial fluid container to the low pressure valve and the high pressure valve, for guiding the working fluid; and a valve controller for controlling, in response to a decrease in volume of the fluid chamber, the opening and closing operations of the high pressure valve and the low pressure valve such that the inertial fluid container alternately communicates with the low pressure container and the high pressure container, thereby generating inertial forces of the working fluid flowing toward the low pressure container in the first internal space of the inertial fluid container, and causing the working fluid to flow into the high pressure container by the inertial forces, wherein the valve controller sets a switching frequency for switching the inertial fluid container between communicating with the low pressure container and communicating with the high pressure container to a frequency close to an Nth-order (where N is a natural number) anti-resonance frequency of a flow conduit for the working fluid including at least the inertial fluid container and the valve flow conduit.

2. The energy recovery system according to claim 1, wherein the valve controller sets the switching frequency to a frequency close to a first anti-resonance frequency of the working fluid flow conduit.

3. The energy recovery system according to claim 2, wherein the frequency close to the first anti-resonance frequency is closer to the first anti-resonance frequency than to a first resonance frequency of the working fluid flow conduit.

4. The energy recovery system according to claim 3, wherein the frequency close to the first anti-resonance frequency is at least higher than half the first anti-resonance frequency.

5. The energy recovery system according to claim 2, wherein the frequency close to the first anti-resonance frequency causes, in the working fluid flow conduit, flow fluctuations of the working fluid having a waveform closer to a waveform of flow fluctuations of the working fluid occurring in the working fluid conduit at the first anti-resonance frequency than to a waveform of flow fluctuations of the working fluid occurring in the working fluid conduit at a first resonance frequency of the working fluid flow conduit.

6. The energy recovery system according to claim 2, wherein the inertial fluid container has such a shape as to make a second anti-resonance frequency of the working fluid flow conduit close to a frequency that is twice the first anti-resonance frequency of the working fluid flow conduit.

7. The energy recovery system according to claim 6, wherein the inertial fluid container has such a shape as to make a third anti-resonance frequency of the working fluid flow conduit close to a frequency that is three times the first anti-resonance frequency of the working fluid flow conduit.

8. The energy recovery system according to claim 6, wherein the inertial fluid container is in the form of a cylinder extending in a flow direction of the working fluid, and includes a container inlet communicating with the fluid chamber, a container outlet communicating with the valve flow conduit, and a plurality of pipe channels sequentially arranged from the container inlet to the container outlet with respective cross sections orthogonal to the working fluid flow direction decreasing stepwise in the working fluid flow direction.

9. The energy recovery system according to claim 1, wherein the inertial fluid container has such a shape as to make a frequency that is twice a first anti-resonance frequency of the working fluid flow conduit away from a first resonance frequency of the working fluid flow conduit.

10. The energy recovery system according to claim 9, wherein the inertial fluid container is in the form of a cylinder extending in a flow direction of the working fluid, and includes a first pipe channel communicating with the fluid chamber, a second pipe channel communicating with the first pipe channel and having a greater inner diameter than the first pipe channel, and a third pipe channel communicating with the second pipe channel and the valve flow conduit and having a smaller inner diameter than the second pipe channel.

11. The energy recovery system according to claim 1, wherein the inertial fluid container is in the form of a cylinder linearly extending in a flow direction of the working fluid, and the valve controller sets a duty ratio for switching the inertial fluid container between communicating with the low pressure container and communicating with the high pressure container to a value close to 0.5.

12. The energy recovery system according to claim 11, wherein the valve controller sets the duty ratio within the range of 0.45 to 0.55.

13. An energy recovery method for recovering energy from a working fluid, comprising:

preparing a fluid chamber having a variable volume and the working fluid sealed therein, an inertial fluid container communicating with the fluid chamber, low pressure and high pressure containers disposed on the opposite side of the inertial fluid container from the fluid chamber and communicating with the inertial fluid container in parallel, a low pressure valve for permitting and prohibiting flow of the working fluid between the inertial fluid container and the low pressure container, a high pressure valve for permitting and prohibiting flow of the working fluid between the high pressure container and the inertial fluid container, and a valve flow conduit, extending from the inertial fluid container to the low pressure valve and the high pressure valve, for guiding the working fluid; and controlling, in response to a decrease in volume of the fluid chamber, the high pressure valve and the low pressure valve such that the inertial fluid container alternately communicates with the low pressure container and the high pressure container, with a switching frequency close to an Nth-order (where N is a natural number) anti-resonance frequency of a flow conduit for the working fluid including at least the inertial fluid container and the valve flow conduit, thereby generating inertial forces of the working fluid flowing toward the low pressure container in the inertial fluid container, and causing the working fluid to flow into the high pressure container by the inertial forces.

* * * * *